US007946777B2

(12) United States Patent
Yamauchi et al.

(10) Patent No.: US 7,946,777 B2
(45) Date of Patent: May 24, 2011

(54) MULTI-REFILL WRITING INSTRUMENT

(75) Inventors: Osami Yamauchi, Aichi (JP); Masashi Ando, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 1387 days.

(21) Appl. No.: 11/391,422

(22) Filed: Mar. 29, 2006

(65) Prior Publication Data

US 2006/0222437 A1 Oct. 5, 2006

(30) Foreign Application Priority Data

| | | |
|---|---|---|
| Mar. 29, 2005 | (JP) | P.2005-094157 |
| Jul. 8, 2005 | (JP) | P.2005-200217 |
| Jul. 8, 2005 | (JP) | P.2005-200218 |
| Jul. 8, 2005 | (JP) | P.2005-200229 |
| Jul. 8, 2005 | (JP) | P.2005-200245 |
| Jul. 8, 2005 | (JP) | P.2005-200246 |
| Jul. 13, 2005 | (JP) | P.2005-204953 |

(51) Int. Cl.
*B43K 27/00* (2006.01)

(52) U.S. Cl. ..... 401/31

(58) Field of Classification Search ..... 401/29–33
See application file for complete search history.

(56) References Cited

U.S. PATENT DOCUMENTS

| | | | | |
|---|---|---|---|---|
| 2,561,824 | A * | 7/1951 | Schmieglitz | 401/31 |
| 3,294,068 | A | 12/1966 | Hechtle et al. | |
| 3,871,775 | A | 3/1975 | Zepell | |
| 3,898,008 | A | 8/1975 | Ganz | |
| 3,912,401 | A | 10/1975 | Zepell | |
| 4,172,674 | A * | 10/1979 | Paroty | 401/116 |
| 5,749,663 | A * | 5/1998 | Takahashi | 401/31 |
| 6,899,482 | B2 * | 5/2005 | Katami | 401/31 |

FOREIGN PATENT DOCUMENTS

| | | | |
|---|---|---|---|
| CH | 656 839 | A5 | 7/1986 |
| CN | 2366284 | Y | 3/2001 |
| CN | 2488695 | Y | 5/2002 |
| DE | 18 85 162 | | 12/1963 |
| DE | 15 61 861 | A1 | 10/1970 |
| DE | 2531604 | A1 | 2/1977 |

(Continued)

OTHER PUBLICATIONS

Korean Office Action dated Nov. 30, 2009 in Korean Application No. 10-2006-0028261, 8 pages.

(Continued)

*Primary Examiner* — Huyen Le
(74) *Attorney, Agent, or Firm* — Sughrue Mion, PLLC

(57) ABSTRACT

A multi-refill writing instrument includes a barrel, writing bodies accommodated in the barrel so as to be movable back and forth, elastic bodies urging the writing bodes backward, operating bodies connected to rear ends of the corresponding writing bodies and window holes formed in a side wall of the barrel so as to extend in the axial direction. The operating bodies protrude from the barrel to an outside through the window holes in the radial direction, one of the operating bodies slides forward along the window hole so that a nib of the writing body connected to the one operating body protrudes from the barrel through a front hole, and a nib of another writing body in a protruding state is retracted into the barrel, and the writing bodies and the operating bodes are pulled out from the barrel and inserted into the barrel.

46 Claims, 58 Drawing Sheets

FOREIGN PATENT DOCUMENTS

| | | | |
|---|---|---|---|
| DE | 26 44 958 | A1 | 4/1977 |
| DE | 3405543 | A1 | 8/1985 |
| FR | 2332871 | A | 6/1977 |
| FR | 2 616 108 | A1 | 12/1988 |
| GB | 578390 | | 6/1946 |
| GB | 1134939 | A | 11/1968 |
| JP | 46-41929 | | 12/1971 |
| JP | 64-001596 | A | 1/1989 |
| JP | 8-192596 | A | 7/1996 |
| JP | 9-207494 | A | 8/1997 |
| JP | 10-264587 | A | 6/1998 |
| JP | 11-208186 | A | 8/1999 |
| JP | 2001-121882 | A | 5/2001 |
| JP | 2001-239791 | A | 9/2001 |
| JP | 2003-011583 | A | 1/2003 |
| JP | 2003-11583 | A | 1/2003 |
| JP | 2003-11584 | A | 1/2003 |
| JP | 2004-358725 | A | 12/2004 |
| JP | 2005-66963 | A | 3/2005 |
| TW | 413153 | Y | 11/2000 |

OTHER PUBLICATIONS

Taiwanese Office Action dated Jul. 30, 2009.

Chinese Office Action dated Aug. 22, 2008.

European Search Report, dated Nov. 25, 2010, issued in Application No. 06006549.7.

Japanese Office Action issued on Nov. 9, 2010 in the corresponding Japanese Patent Application No. 2005-200218.

Japanese Office Action issued on Nov. 9, 2010 in the corresponding Japanese Patent Application No. 2006-086231.

* cited by examiner

MULTI-REFILL WRITING INSTRUMENT

BACKGROUND OF THE INVENTION

1. Field of the Invention

The present invention relates to a multi-refill writing instrument. More specifically, the invention relates to a multi-refill writing instrument having a plurality of writing bodies in a barrel thereof.

2. Description of the Background Art

In a conventional multi-refill writing instrument described in Japanese Patent Unexamined Publication No. JP-A-2003-11583, sliding bodies are connected to the writing bodies and have protruding portions at rear ends thereof, protruding potions project from the barrel to the outside, and the protruding portions are detachably mounted to the sliding bodies. In this way, when replacing the writing bodies according to user's preference, the user can select the shape or color of the protruding portion without inadvertently selecting the writing body.

In the conventional multi-refill writing instrument, when replacing the writing body accommodated in the barrel with a different type of writing body, the user separates the writing body and the protruding portion from the sliding body, with the sliding body remaining in the barrel, and mounts a new writing body and a new protruding portion to the sliding body. Therefore, it is complicated to replace the writing body, which makes it difficult for the user to rapidly and reliably replace the writing body. In addition, when a plurality of writing bodies are replaced at the same time, there is a fear that a writing body and a protruding portion not corresponding to the writing body may be mounted to one sliding portion. Further, since the protruding portion has a small size, the protruding portion is apt to be lost.

SUMMARY OF THE INVENTION

The invention is made to solve the above-mentioned problems, and it is an object of the invention to provide a multi-refill writing instrument capable of replaceably accommodating writing bodies which is selected by the user and operating bodies corresponding to the writing bodies in a barrel and of rapidly and reliably replacing the writing bodies and the operating bodies. Note that, in the invention, a 'front side' means a pen tip side, and a 'rear side' means an opposite side thereof.

[1] According to an aspect of the invention, there is provided a multi-refill writing instrument comprising:

a barrel 2;

a plurality of writing bodies 6 accommodated in the barrel so as to be movable in a axial direction of the barrel;

a plurality of elastic bodies 8 urging the writing bodes backward;

a plurality of operating bodies 7 connected to rear ends of the corresponding writing bodies; and a plurality of window holes 41 formed in a side wall of the barrel so as to extend in the axial direction, wherein the operating bodies protrude from the barrel to an outside through the window holes in the radial direction, one of the operating bodies slides forward along the window hole so that a nib 61 of the writing body connected to the one operating body protrudes from the barrel through a front hole 31, and simultaneously, a nib 31 of another writing body in a protruding state is retracted into the barrel, and the writing bodies and the operating bodes are adapted to be pulled out from the barrel and to be inserted into the barrel. (first aspect of the invention).

According to the multi-refill writing instrument 1 (first aspect of the invention), the user can pull out the writing body 6 from the barrel 2 to replace the writing body with new writing body 6, and can also pull out the operating body 7 from the barrel 2 to replace the operating body with new operating body 7 appropriately corresponding to the writing body 6, which makes it possible to prevent misconnection between the writing body 6 and the operating body. For example, in a structure in which the operating body 7 cannot be pulled out from the barrel 2 at the time of replacement, the type of a replaceable writing body 6 is limited to only the writing body 6 corresponding to the operating body 7 accommodated in the barrel 2, which makes it difficult for the user to freely replace the writing body 6 with new one that the user selected. In addition, in the multi-refill writing instrument 1 (first aspect of the invention), it is unnecessary to replace small parts unlike the background art, which makes it possible to rapidly and reliably perform replacement.

In this aspect of the invention, it is preferable that the operating body 7 corresponding to the writing body 6 be an operating body 7 having a discriminating mark corresponding to the writing body 6 thereon. For example, any of the following marks is used as the discriminating mark: a mark indicating an ink color, a mark indicating the size of a pen tip, a mark indicating the width of calligraphy, and a mark indicating the type of a pen tip. In addition, in the invention, for example, the writing bodies 6 include a ballpoint pen, a marking pen, and a mechanical pencil. Further, in the invention, the barrel 2 may include a front barrel 3 having a front hole 31 at a front end through which the nib 61 of the writing body 6 can protrude and a rear barrel 4 that has window holes 41 on a side wall thereof and has an opening portion 42 at the rear end thereof. In addition, the rear barrel 4 may move in the axial direction relative to the front barrel 3. A mechanical pencil may be used as the writing body 6. In this case, it is possible to draw a lead out by moving the rear barrel 4 forward. In the invention, two or more writing bodies 6 may be accommodated in the barrel 2. More specifically, two, three, four, five, or sixth writing bodies can be accommodated in the barrel 2.

Note that, the writing body and the operating body connected to the rear end of the writing body may be constructed by a single member in which the writing body and the operating body are integrally formed.

[2] In the multi-refill writing instrument according to this aspect (first aspect of the invention), preferably, the writing bodies are adapted, to be pulled out from the barrel for replacement, an opening portion, which is capable of opening and closing, is formed in a rear end of the barrel so that the window holes are opened rearward, and the operating bodies are adapted to be pulled out from the barrel and to be inserted into the barrel through the opening portion. (second aspect of the invention).

Note that, in the multi-refill writing instrument 1 according to this aspect (second aspect of the invention), the writing bodies 6 may be replaced through the opening portion 42 provided at the rear end of the barrel 2 or it may be replaced through an opening portion provided at the front end of the barrel 2. The opening portion 42 provided at the rear end of the barrel 2 is exposed at least when the operating bodies 7 are pulled out from the barrel 2 or when the operating bodies 7 are inserted into the barrel 2.

[3] In the multi-refill writing instrument 1 according to this aspect (second aspect of the invention), preferably, the writing bodies and the operating bodies are adapted to be pulled out from the barrel and to be inserted into the barrel through the opening portion. (third aspect of the invention).

According to the multi-refill writing instrument 1 (third aspect of the invention), it is possible to replace two parts, the writing body 6 and the operating body 7, through the same portion (that is, the opening portion 42) Therefore, it is possible to rapidly and reliably replace the writing body 6 and the operating body 7 with a simple structure. In addition, according to the multi-refill writing instrument 1 (third aspect of the invention), the opening portion 42 provided at the rear end of the barrel 2 is opened at least when the operating bodies 7 are pulled out from the barrel 2 or when the operating bodies 7 are inserted into the barrel 2.

[4] In the multi-refill writing instrument 1 according to this aspect (third aspect of the invention), it is preferable that the writing bodies and the operating bodies connected to each other are adapted to be pulled out from the barrel and to be inserted into the barrel through the opening portion. (fourth aspect of the invention).

According to the multi-refill writing instrument 1 (fourth aspect of the invention), the writing body 6 and the operating body 7 connected to each other are adapted to be pulled out from the barrel 2 or to be inserted into the barrel 2. Therefore, it is possible to more simply replace the writing body 6 and the operating body 7, and thus the user can reliably and rapidly replace the operating body and the writing body. In addition, in the multi-refill writing instrument 1 (fourth aspect of the invention), since the writing body 6 and the operating body 7 connected to each other are provided, it is unnecessary for the user to connect the writing body 6 and the operating body 7, which makes it possible to reliably prevent misconnection between the writing body 6 and the operating body 7 corresponding to the writing body 6 at the time of the replacement of the writing body 6.

[5] In the multi-refill writing instrument according to this aspect (first aspect of the invention), it is preferable that the writing bodies and the operating bodies connected to each other are adapted to be pulled out from the barrel and to be inserted into the barrel. (fifth aspect of the invention).

According to the multi-refill writing instrument 1 (fifth aspect of the invention), the writing body 6 and the operating body 7 connected to each other are adapted to be pulled out from the barrel 2, or to be inserted into the barrel 2. Therefore, it is possible to more simply replace the writing body 6 and the operating body 7, and thus the user can reliably and rapidly replace the operating body and the writing body. In addition, in the multi-refill writing instrument 1 (fifth aspect of the invention), since the writing body 6 and the operating body 7 connected to each other are provided, it is unnecessary for the user to connect the writing body 6 and the operating body 7, which makes it possible to reliably prevent misconnection between the writing body 6 and the operating body 7 corresponding to the writing body 6 at the time of the replacement of the writing body 6.

[6] In the multi-refill writing instrument 1 according to this aspect (second aspect of the invention), preferably, an abutting wall portion is formed at the rear end of the barrel so as to contact with the operating bodies of the writing bodes whose nibs are in the retracted state when the opening portion is closed, and when the opening portion is opened, at least a part of the abutting wall portion is detached from the rear end of the barrel. (sixth aspect of the invention).

According to the multi-refill writing instrument 1 (sixth aspect of the invention), when the opening portion 42 is closed, a portion of or the entire abutting wall portion 51 is detached from the rear end of the barrel 2. Therefore, when the opening portion 42 is opened, a portion of or the entire abutting wall portion 51 does not exist at a position where the operating bodies 7 of the writing bodies 6 in the retracted state can abut. Therefore, when the operating bodies 7 are replaced, it is possible to ensure sufficient openness of the opening portion 42 provided at the rear end of the barrel, and thus to easily pull out the operating bodies 7 from the barrel 2. In a structure in which the entire abutting wall portion 51 is fixed to the rear end of the barrel 2 so that it cannot move in any direction, the window holes 41 whose rear ends are opened by the opening portion 42 provided at the rear end of the barrel 2 have insufficient openness to replace the operating bodies 7 from the barrel through the opening hole 42, which makes it difficult to pull out the operating bodies 7 from the barrel through the opening hole 42.

[7] In the multi-refill writing instrument 1 according to this aspect (second aspect of the invention), it is preferable that, when the opening portion is opened, the operating bodies in the retracted state protrude from the barrel to the outside through the opening portion by urging force of the elastic bodies. (seventh aspect of the invention).

According to the multi-refill writing instrument 1 (seventh aspect of the invention), when the opening portion 42 is opened, the operating bodies 7 protrude from the barrel 2 to the outside through the opening portion 42. Therefore, without making the opening portion 42 provided at the rear end of the barrel 2 downward, it is possible to easily pull out the operating bodies 7 from the barrel.

[8] Preferably, the multi-refill writing instrument 1 according to this aspect (first aspect of the invention), further comprising:

an elastic body supporting portion, with which the front end of the elastic body contacts in the axial direction, provided on an inner wall of the barrel, wherein a holding portion for holding the front end of the elastic body in the radial direction are formed in the elastic body supporting portion. (eighth aspect of the invention).

According to the multi-refill writing instrument 1 (eighth aspect of the invention), when the operating bodies 7 are pulled out from the barrel 2, it is possible to prevent the elastic bodies 8 from falling out from the barrel 2 since the front ends of the elastic bodies 8 are held in the radial direction by the holding portions 92. If the elastic bodies 8 fall out from the barrel 2, it is necessary to insert the elastic bodies 8 into the barrel 2 again when new operating bodies 7 are inserted into the barrel 2. In this case, there is a fear that the elastic bodies 8 may be lost. The structure of holding the front ends of the elastic bodies 8 by the holding portions 92 includes, for example, a structure of holding the outer surfaces of the front ends of the elastic bodies 8 inward in the radial direction and a structure of holding the inner surfaces of the front ends of the elastic bodies 8 outward in the radial direction.

[9] Preferably, the multi-refill writing instrument 1 according to this aspect (second aspect of the invention) further includes guide portions provided on both inner walls of the opening portion at the rear end of the barrel so as to regulate an inserting direction of side surfaces of the operating body. (ninth aspect of the invention).

According to the multi-refill writing instrument 1 (ninth aspect of the invention), the guide portions 421 can prevent the operating body 7 from being inserted into the barrel 2 in the wrong direction. In addition, it is preferable that the guide portions 421 is formed such that the operating bodies 7 can be inserted into the barrel 2 only when the operating portions 71 thereof protrude outward in the radial direction. In this way, when the operating body 7 is inserted into the barrel with the inside and the outside thereof reversed to each other (that is, when operating portion 71 of the operating body 7 faces inward), the operating body 7 cannot be inserted into the barrel 2 through the opening portion 42, which makes it possible to prevent the operating body 7 from being mounted in the wrong direction.

[10] Preferably, the multi-refill writing instrument 1 according to this aspect (second aspect of the invention) further includes a lid portion provided at the rear end of the barrel so as to open and close the opening portion. (tenth aspect of the invention).

According to the multi-refill writing instrument 1 (tenth aspect of the invention), the lid portion 5 makes it possible to reliably close the opening portion 42. When the lid portion 5 is not provided, it is difficult to reliably close the opening portion 42.

[11] In the multi-refill writing instrument 1 according to this aspect (tenth aspect of the invention), it is preferable that an abutting wall portion is formed on a front surface of the lid portion so as to contact with the operating bodies of the writing bodies in the retracted state. (eleventh aspect of the invention).

According to the multi-refill writing instrument 1 (eleventh aspect of the invention), when the operating bodies 7 are replaced, the lid portion 5 is opened, and the abutting wall portion 51 is moved to a contact position with the operating bodies 7. Then, it is possible to ensure sufficient openness of the operating portion 42 provided at the rear end of the barrel, and thus to easily pull out the operating bodies 7 from the barrel 2. In a structure in which the abutting wall portion 51 is fixed to the rear end of the barrel 2 so that it cannot move in any direction, the window holes 41 whose rear ends are opened by the opening portion 42 provided at the rear end of the barrel 2 have insufficient openness to replace the operating bodies 7 from the barrel through the opening hole 42, which makes it difficult to easily pull out the operating bodies 7 from the barrel through the opening hole 42.

Further, in the multi-refill writing instrument 1 (eleventh aspect of the invention), when the openable lid portion 5 closes up the opening portion 42, the abutting wall portion 51 may be arranged at least at a proper contact position with the operating bodies 71, and it is not necessary to close the entire opening portion 42. In addition, at least one part of the lid portion 5 is detachably mounted to the rear end of the barrel 2 by pressing, engagement, or screwing. When the operating bodies 7 of the writing bodies 6 come into contact with the abutting wall portion 51, the lid portion 5 is mounted such that it cannot fall out even if the urging force of the elastic bodies 8 is applied thereto.

[12] In the multi-refill writing instrument 1 according to this aspect (eleventh aspect of the invention), it is preferable that the lid portion closes the opening portion while pressing the operating bodies forward. (twelfth aspect of the invention).

According to the multi-refill writing instrument 1 (twelfth aspect of the invention), the lid portion 5 closes up the opening portion 42 while pressing the operating bodies 7 forward. Therefore, before closing up the opening portion 42 with the lid portion 5, it is unnecessary for the user to press the operating bodies 7 in the protruding state forward by a user's finger. Thus, it is possible to easily close the opening portion 42 with the lid portion 5.

[13] In the multi-refill writing instrument 1 according to this aspect (first aspect of the invention, it is preferable that the operating bodies have the same colors as those of ink contained in the writing bodies connected thereto. (thirteenth aspect of the invention).

According to the multi-refill writing instrument 1 (thirteenth aspect of the invention), the operating bodies 7 have the same colors or substantially the same colors as those of the ink contained in the ink containing tubes. Therefore, the operating bodies 6 exposed through the window holes 41 of the barrel 2 make it possible to easily discriminate the colors of ink contained in the writing bodies 6 having nibs protruding from the barrel. Further, in the multi-refill writing instrument 1 (thirteenth aspect of the invention), in particular, when the lid portion 5 is separated from the opening portion 42 to cause the operating bodies 7 to protrude through the opening portion 42 (in case of seventh aspect of the invention), it is possible to easily discriminate the operating body 7 connected to the writing body 6 with an ink color to be replaced, by viewing the ink color of the operating body 7 connected to the writing body 6 protruding through the opening portion 42. In addition, before the writing body 6 connected to the colored operating body 7 is accommodated in the barrel 2 (that is, the writing body 6 is outside of the barrel 2), it is possible to easily discriminate the ink colors of the writing bodies 6 at a relatively long distance by viewing the colors of the operating bodies 7.

[14] In the multi-refill writing instrument 1 according to this aspect (tenth aspect of the invention), it is preferable that a portion of the lid portion is pivotably connected to the rear end of the barrel. (fourteenth aspect of the invention).

According to the multi-refill writing instrument 1 (fourteenth aspect of the invention), when opening or closing the lid portion 5 relative to the opening portion 42, the lid portion 5 is not separated from the barrel 2 since it is pivotably connected to the rear end of the barrel 2. Therefore, it is possible to prevent the lid portion 5 from being lost. When the lid portion 5 is lost, the abutting wall portion 51 coming into contact with the operating portions 71 of the writing bodies 6 in the retracted state is also lost, causing the multi-refill writing instrument not to be used. Further, the lid portion 5 may be pivoted backward from the opening portion 42, or it may be rotated in the circumferential direction relative to the opening portion 42.

[15] In the multi-refill writing instrument 1 according to this aspect (fourteenth aspect of the invention), preferably, an engaging portion is provided at the other end of the lid portion, which is other than the portion to which the rear end of the barrel pivotably connects, and an engaged portion which engages with the engaging portion of the lid portion is provided at the rear end of the barrel. (fifteenth aspect of the invention).

According to the multi-refill writing instrument 1 (fifteenth aspect of the invention), the lid portion 5 can be easily opened relative to the opening portion 42, and it can reliably close up the opening portion 42.

[16] In the multi-refill writing instrument 1 according to this aspect (tenth aspect of the invention), it is preferable that the lid portion closing the opening portion is detachably screwed to the rear end of the barrel. (sixteenth aspect of the invention).

According to the multi-refill writing instrument 1 (sixteenth aspect of the invention), since the lid portion 5 is detachably screwed to the rear end of the barrel 2, it is possible to reliably close up the opening portion 42. When the lid portion 5 is not provided, it is difficult to reliably close up the opening portion 42.

[17] In the multi-refill writing instrument 1 according to this aspect (sixteenth aspect of the invention), preferably, a female screw portion is provided on an inner peripheral surface of the lid portion, and a male screw portion engaged with the female screw portion is provided on an outer peripheral surface of the rear end of the barrel. (seventeenth aspect of the invention).

According to the multi-refill writing instrument 1 (seventeenth aspect of the invention), the rear end of the barrel 2 is divided in the radial direction by the window holes 41 whose rear ends are opened by the opening portion 42, causing the barrel to be easily deformed outward in the radial direction. However, in this aspect, since the female screw portion 54 is provided on the inner peripheral surface of the lid portion 5 and the male screw portion 45 engaged with the female screw portion 54 is provided on the outer surface of the rear end of the barrel 2, it is possible to prevent the outward deformation of the rear end of the barrel 2 in the radial direction.

[18] In the multi-refill writing instrument 1 according to this aspect (tenth aspect of the invention), preferably, at least two engaging portions are provided on the lid portion, and engaged portions engaged with the engaging portions are provided on the rear end portions of the barrel which are divided in the radial direction by the opening portion. (eighteenth aspect of the invention).

According to the multi-refill writing instrument 1 (eighteenth aspect of the invention), since the lid portion 5 is detachably provided at the rear end of the barrel 2, it is possible to reliably close the opening portion 42. When the lid portion 5 is not provided, it is difficult to reliably close up the opening portion 42. In particular, the lid portion 5.includes at least two engaging portions 53A and 53B, and the engaged portions 45A and 45B engaged with the engaging portions 53A and 53B are provided on the rear end portions of the barrel 2 which are divided in the radial direction by the opening portion 42. That is, in this aspect, since two engaging parts composed of the engaging portions 53A and 53B and the engaged portion 45A and 45B are provided, it is possible to reliably maintain stable engagement between the lid portion 5 and the rear end of the barrel 2. In a structure in which the engaging portions 53A and 53B and the engaged portions 45A and 45B are provided in only one engaging part, when the engaging portions 53A and 53B and the engaged portions 45A and 45B are engaged with each other to mount the lid portion 5 to the rear end of the barrel 2, the lid portion 5 may not be reliably fixed to the rear end of the barrel 2, resulting in unstable mounting therebetween.

Further, in this aspect, since the lid portion 5 is stably mounted to the rear end of the barrel 2 by two or more engaging parts, there is no fear that the lid portion 5 may be separated from the rear end of the barrel even when the rear ends of the operating bodies 7 connected to the rear ends of the writing bodies 6 whose nibs are in the retracted state press on the abutting wall portion 51 by the urging force of the elastic bodies 8. When only one engaging part is provided, the lid portion 5 may be separated from the rear end of the barrel by the pressing force of the operating bodies on the abutting wall portion 51 of the lid portion 5.

[19] In the multi-refill writing instrument 1 according to this aspect (eighteenth aspect of the invention), preferably, the engaging portions are provided on the inner surface of the lid portion, and the engaged portions are provided on the outer surface of the rear end of the barrel. (nineteenth aspect of the invention).

According to the multi-refill writing instrument 1 (nineteenth aspect of the invention), the rear end of the barrel 2 is divided in the radial direction by the window holes 41 whose rear ends are opened by the opening portion 42, causing the barrel to be easily deformed outward in the radial direction. However, in this aspect, since the engaging portions 53A and 53B are provided on the inner surface of the lid portion 5 in the radial direction and the engaged portions 45A and 45B are provided on the outer surface of the rear end of the barrel 2 in the radial direction, it is possible to prevent the outward deformation of the rear end of the barrel 2 in the radial direction.

[20] In the multi-refill writing instrument 1 according to this aspect (eighteenth aspect of the invention), it is preferable that the abutting wall portion is inserted into the opening portion to regulate an inward deformation of the inner wall of the opening portion. (twentieth aspect of the invention).

According to the multi-refill writing instrument 1 (twentieth aspect of the invention), when the engaging portions 53A and 53B formed on the inner surface of the lid portion 5 in the radial direction are engaged with the engaged portions 45A and 45B formed on the outer surface of the rear end of the barrel 2, the rear end of the rear barrel 4 divided in the radial direction by the window holes 41 whose rear ends are opened is apt to be deformed inward in the radial direction. However, in this aspect, the abutting wall portion 51 is inserted into the opening portion 42 to regulate the inward deformation of the inner wall of the opening portion 52. Therefore, when the engaging portions 53A and 53B of the lid portion 5 are engaged with the engaged portions 45A and 45B of the rear end of the rear barrel 4, it is possible to prevent the rear end of the barrel 2 from being deformed inward in the radial direction.

[21] In the multi-refill writing instrument 1 according to this aspect (eighteenth aspect of the invention), preferably, the lid portion includes:

a main body; and at least two leg portions which protrude forward from the main body, wherein engaging portions are formed in an inner surfaces of the leg portions in the radial direction thereof, and engaged portions, with which the engaging portions engage in the axial direction by getting over the engaging portions, are formed on the outer surfaces of the side walls of the rear end of the barrel. (twenty first aspect of the invention).

According to the multi-refill writing instrument 1 (twenty first aspect of the invention), the engaging portions 53A and 53B are provided on at least two leg portions, and the engaged portions 45A and 45B engaged with the engaging portions 53A and 53B are provided on the side walls between the window holes 41 at the rear end of the barrel 2. Therefore, it is unnecessary to form the lid portion 5 so as to protrude from the rear end of the barrel 2 to the outside.

[22] In the multi-refill writing instrument according to this aspect (eighteenth aspect of the invention), preferably, the lid portion includes:

a main body; and at least two leg portions which protrude forward from the main body, wherein engaging portions are formed in an inner surfaces of the leg portions in the radial direction thereof, and engaged portions, with which the engaging portions slidably engage in the radial direction, are formed on both sides of the opening portion at the rear end of the barrel. (twenty second aspect of the invention).

According to the multi-refill writing instrument 1 (twenty second aspect of the invention), it is possible to increase the amount of engagement between the engaging portions 53A and 53B and the engaged portions 45A and 45B (for example, the height of projecting portions and the depth of groove portions), and thus to maintain stable engagement therebetween.

[23] In the multi-refill writing instrument 1 according to this aspect (eighteenth aspect of the invention), preferably, the lid portion includes:

a main body; and two engaging portions which are formed on both sides of the main body in the radial direction, wherein engaged portions are formed on both sides of the opening portion of the rear end of the barrel, and the engaging portions and the engaged portions are engaged with each other by rotating the lid portion with respect to the rear end of the barrel in the circumferential direction. (twenty third aspect of the invention).

According to the multi-refill writing instrument 1 (twenty third aspect of the invention), it is possible to increase the amount of engagement between the engaging portions 53A and 53B and the engaged portions 45A and 45B (for example, the height of projecting portions and the depth of groove portions), and thus to maintain stable engagement therebetween.

[24] In the multi-refill writing instrument 1 according to this aspect (first aspect of the invention), preferably, at least one part of a peripheral wall of each of the window holes is separable from the barrel in the radial direction, and when the at least one part of the peripheral wall of each of the window holes is separated from the barrel in the radial direction, the operating bodies are adapted to be pulled out from the barrel and to be inserted into the barrel through the separated part of the peripheral wall of each of the window holes. (twenty fourth aspect of the invention).

According to the multi-refill writing instrument 1 (twenty fourth aspect of the invention), the structure of separating at least one part of the peripheral wall of each window hole 41 in the radial direction includes a structure of forming an opening portion communicating with the window holes 41 in the peripheral walls of the window holes 41 and a structure of forming an opening portion not communicating with the window holes 41 in the peripheral walls of the window holes 41. Further, in the multi-refill writing instrument 1 (twenty fourth aspect of the invention), the peripheral walls of the window holes 41 of the barrel 2 may be separated from each other to replace the writing bodies 6, or the writing bodies 6 may be replaced through an opening portion provided in the front end of the barrel 2 (for example, the barrel 2 is composed of a front barrel 3 and a rear barrel 4 having an opening portion at the front end thereof, which are detachably separable from each other, and when the front barrel 3 is separated from the rear barrel 4, the opening portion of the rear barrel 4 is exposed). In this structure, the peripheral wall of the window hole 41 means the side wall of the barrel 2 arranged around the window hole 41.

[25] In the multi-refill writing instrument 1 according to this aspect (twenty fourth aspect of the invention), preferably, the operating bodies and the writing bodies are adapted to be pulled out from the barrel and to be inserted into the barrel through the separated part of the peripheral wall of each of the window holes. (twenty fifth aspect of the invention).

[26] In the multi-refill writing instrument 1 according to this aspect (twenty fourth aspect of the invention), preferably, a front end and/or a rear end of the peripheral wall of each of the window holes are separable in the radial direction, and the window holes are opened forward or backward by separating the front ends or the rear ends of the peripheral walls of the window holes in the radial direction. (twenty sixth aspect of the invention).

According to the multi-refill writing instrument 1 (twenty sixth aspect of the invention), when replacing the operating bodies 7, it is possible to pull out the operating bodies 7 protruding through the window holes 41 from the barrel 2 through the window holes separated forward or backward.

[27] In the multi-refill writing instrument 1 according to this aspect (twenty fourth aspect of the invention), preferably, as the rear ends of the peripheral walls of the window holes are separated in the radial direction, side walls of the rear end of the barrel are separated from each other in the radial direction, the lid portion is detachably mounted to the side walls of the rear end of the barrel, and the side walls of the rear end of the barrel are incorporated with each other by mounting the lid portion to the side walls of the rear end of the barrel. (twenty seventh aspect of the invention).

According to the multi-refill writing instrument 1 (twenty seventh aspect of the invention), at the time of writing, the lid portion 5 is, mounted to the side wall of the rear end of the barrel 2, which makes it possible to maintain stable engagement between the side walls of the rear end of the barrel 2 and thus to prevent the side walls of the rear end of the barrel 2 from being separated from each other in the radial direction. At the time of writing, if in a case where the side walls of the rear end of the barrel 2 are separated from each other in the radial direction, there is fear that the operating bodies 7 may spring out from the barrel by urging force.

[28] In the multi-refill writing instrument 1 according to this aspect (twenty fourth aspect of the invention), it is preferable that the operating bodies and the writing bodies connected to each other are adapted to be pulled out from the barrel and to be inserted into the barrel. (twenty eighth aspect of the invention).

[29] In the multi-refill writing instrument 1 according to this aspect (first aspect of the invention), preferably, the barrel includes:

a front barrel which has a front hole at a front end thereof; and a rear barrel which is detachably connected to a rear end of the front barrel, the rear barrel has the window holes and cut-out portions for opening the window holes forward, when the rear barrel is separated from the front barrel, the operating bodies are adapted to be pulled out from the barrel and to be inserted into the barrel through the cut-out portions. (twenty ninth aspect of the invention).

[30] In the multi-refill writing instrument 1 according to this aspect (twenty ninth aspect of the invention), it is preferable that the operating bodies and the writing bodies connected to each other are adapted to be pulled out from the barrel and to be inserted into the barrel. (thirtieth aspect of the invention).

[31] In the multi-refill writing instrument 1 according to this aspect (twenty ninth aspect of the invention), preferably, a front end portion of the rear barrel is divided into a plurality of parts by the cut-out portions, and a plurality of engaging holes into which the front end portions of the rear barrel are adapted to be inserted are provided in the front barrel. (thirty first aspect of the invention).

According to the multi-refill writing instrument 1 (thirty first aspect of the invention), the front end portions of the rear barrel 4 (that is, a plurality of divided front end portions of the rear barrel 4) are inserted into the engaging holes 32 of the front barrel 3, which makes it possible to prevent the front end portions of the rear barrel 4 from being deformed inward and outward in the radial direction. Further, in the multi-refill writing instrument 1 (thirty first aspect of the invention), it is preferable that the number of divided front end portions of the rear barrel 4 be equal to the number of engaging holes 32. In this way, when a plurality of divided front end portions of the rear barrel 4 are inserted into the engaging holes 32 of the front barrel 3, it is possible to accurately and reliably fitting the rear barrel 4 into the front barrel 3.

[32] In the multi-refill writing instrument 1 according to this aspect (thirty first aspect of the invention), preferably, an elastic body supporting portion contacting with the front ends of the elastic bodies in the axial direction is provided on an inner wall of the front barrel, and the engaging holes are formed between an outer wall of the elastic body supporting portion and the inner wall of the front barrel. (thirty second aspect of the invention).

According to the multi-refill writing instrument 1 (thirty second aspect of the invention), the elastic body supporting portion 8 make it easy to form the engaging holes 32. It is preferable that the elastic body supporting portion 8 is separately formed from the front barrel 3 and be fixed to the inner wall of the front barrel 3. Alternatively, the elastic body supporting portion 8 may be integrally formed with the front barrel 3.

[33] In the multi-refill writing instrument 1 according to this aspect (twenty ninth aspect of the invention), preferably, the elastic body supporting portion contacting with the front ends of the elastic bodies in the axial direction is formed on the inner wall of the front barrel, and holding portions for holding the front ends of the elastic bodies in the radial direction thereof are formed at the elastic body supporting portion. (thirty third aspect of the invention).

(Refill)

[34] According to the invention, there is provided a refill for a multi-refill writing instrument as set forth in the first aspect of the present invention, the refill comprising:

a ballpoint pen tip holding a ball rotatably at a front end thereof;

an ink containing tube which has a front end connected to the ballpoint pen tip and contains ink therein; and an operating body which is connected to a rear end of the ink containing tube and has the same color as that of the ink contained in the ink containing tube, wherein a plurality of the refills are accommodated in the barrel at the time of use, the operating body connected to the rear end of the refill protrudes from the side wall of the barrel, and the ballpoint pen tip protrudes from or is retracted into the barrel by operating the operating body to slide forward. (thirty fourth aspect of the invention).

According to the refill 1 for a multi-refill writing instrument (thirty fourth aspect of the invention), the operating body 4 (that is, the ink color display portion) protruding backward in the axial direction by a relatively long distance is viewed from the outside, which makes it possible to easily discriminate the color of the ink contained in the ink containing tube 3 and thus to easily discriminate the color of ink at a relatively long distance. As a result, there is no fear that, when purchasing the refill 1 for a multi-refill writing instrument displayed in a shop or when inserting a new refill 1 for a multi-refill writing instrument into the barrel 6, the user may select the refill 1 for a multi-refill writing instrument having a color different from the color that the user wants to use.

Note that in the present invention, the ink containing tube and the operating body connected to the rear end of the writing body may be a single member in which the ink containing tube and the operating body are integrally formed.

[35] In the refill 1 for a multi-refill writing instrument according to this aspect (thirty fourth aspect of the invention), it is preferable that the operating body includes a small-diameter portion and a large-diameter portion having a dimension larger than that of the small-diameter portion in the radial direction. (thirty fifth aspect of the invention).

According to the refill 1 for a multi-refill writing instrument (thirty fifth aspect of the invention), an ink color display portion having a large area is provided on the large-diameter portion 41, which makes it possible to discriminate the color of ink easier. Further, in the refill 1 for a multi-refill writing instrument (thirty fifth aspect of the invention), when the user pulls out the ink containing tube 3 and the operating body 4 connected to each other from the barrel 6 or inserts them into the barrel 6, the user can easily pick up the large-diameter portion 41 of the operating body 4, and thus this structure is convenient for use. In addition, preferably, one or more large-diameter portions 41 are provided in the operating body 4.

[36] In the refill 1 for a multi-refill writing instrument according to this aspect (thirty fifth aspect of the invention), it is preferable that the large-diameter portion has a dimension larger than the external diameter of the ink containing tube in the radial direction. (thirty sixth aspect of the invention).

According to the refill 1 for a multi-refill writing instrument (thirty sixth aspect of the invention), an ink color display portion having a large area is provided on the large-diameter portion 41, which makes it possible to discriminate the color of ink easier. Further, in the refill 1 for a multi-refill writing instrument (thirty sixth aspect of the invention), when the user pulls out the ink containing tube 3 and the operating body 4 connected to each other from the barrel 6 or inserts them into the barrel 6, the user can easily pick up the large-diameter portion 41 of the operating body 4, and thus this structure is convenient for use. In addition, preferably, one or more large-diameter portions 41 are provided in the operating body 4. In this case, it is possible to obtain an ink color display portion having a larger area.

[37] In the refill 1 for a multi-refill writing instrument according to this aspect (thirty fifth aspect of the invention), it is preferable that the large-diameter portion is a plate member having flat portions on both sides thereof. (thirty seventh aspect of the invention).

According to the refill 1 for a multi-refill writing instrument (thirty seventh aspect of the invention), the flat portions 41*a* serve as the ink color display portions having large areas, and thus it is possible to effectively form the ink color display portions having large areas. Further, in the refill 1 for a multi-refill writing instrument (thirty seventh aspect of the invention), when a plurality of refills are tied into a bundle, an increase in the volume of the rear end of the bundle does not occur due to contact between the operating bodies 4, and thus it is easy to handle a bundle of refills. In addition, the flat portion 41*a* may have a slightly protruding portion or a step portion thereon when the entire large-diameter portion 41 is formed of a plate shape.

[38] In the refill 1 for a multi-refill writing instrument according to this aspect (thirty fifth aspect of the invention), it is preferable that the large-diameter portion is provided at a rear portion of the operating body. (thirty eighth aspect of the invention).

According to the refill 1 for a multi-refill writing instrument (thirty eighth aspect of the invention), the large-diameter portion 41 protrudes from the rear end of the ink containing tube 3 backward, and appears to be a flag hung on a flagpole, which makes it possible to improve the appearance of the operating body 4 (the ink color display portion). Further, in the refill 1 for a multi-refill writing instrument (thirty eighth aspect of the invention), the large-diameter portion 41 is formed at the rear end of the operating body 4. Therefore, when the user pulls out the ink containing tube 3 and the operating body 4 connected to each other from the barrel 6 or inserts them into the barrel 6, the user can easily pick up the large-diameter portion 41 of the operating body 4, and thus this structure is convenient for use.

[39] In the refill 1 for a multi-refill writing instrument according to this aspect (thirty fourth aspect of the invention), preferably, in a state that a visible area of the operating body is maximum, the visible area of the operating body is set to be 10% or more of a visible area of the ink containing tube. (thirty ninth aspect of the invention).

According to the refill 1 for a multi-refill writing instrument (thirty ninth aspect of the invention), it is possible to more reliably discriminate the color of ink. When the visible area of the operating body 4 is less than 10% of the visible area of the ink containing tube 3, it is difficult to discriminate the color of ink by means of the operating body 4. In this structure, the visible area means an area when the refill 1 for a multi-refill writing instrument is viewed from a predetermined direction.

[40] In the refill 1 for a multi-refill writing instrument according to this aspect (thirty fourth aspect of the invention), it is preferable that the refill is accommodated in a packing bag made of a transparent material. (fortieth aspect of the invention).

According to the refill 1 for a multi-refill writing instrument (fortieth aspect of the invention), it is possible to easily view the operating body 4 having the same color as that of ink contained in the ink containing tube, and to prevent the operating body 4 from being falling off from the ink containing tube 3 until the user purchases the refill.

[41] In the refill 1 for a multi-refill writing instrument according to this aspect (fortieth aspect of the invention), it is preferable that the refill is accommodated in the packing bag such that the maximum visible area of the operating body is visible from an external front side of the packing bag. (forty first aspect of the invention).

According to this aspect (forty first aspect of the invention), the refill 1 for a multi-refill writing instrument is accommodated in the packing bag 5 such that the maximum visible area of the operating body 4 is visible from the external front side of the packing bag 5. Therefore, the thickness of a portion of the packing pack 5 accommodating the operating body 4 does not increase, which makes it possible to pile up a plurality of packing bags 5 having the refills 1 for a multi-refill writing instrument therein in a limited space for storage.

[42] In the refill 1 for a multi-refill writing instrument according to this aspect (fortieth aspect of the invention), preferably, the operating body includes a large-diameter portion having a dimension larger than the external diameter of the ink containing tube, the large-diameter portion is a plate member having flat portions on both sides thereof, and the refill is accommodated in the packing bag such that the flat portion of the large-diameter portion of the operating body is visible from an external front side of the packing bag. (forty second aspect of the invention).

According to this aspect (forty second aspect of the invention), the refill 1 for a multi-refill writing instrument is accommodated in the packing bag 5 such that the flat portion 41*a* (the maximum visible area) of the large-diameter portion 41 of the operating body 4 is visible from the external front side of the packing bag 5. Therefore, the thickness of a portion of the packing pack 5 accommodating the operating body 4 does not increase, which makes it possible to pile up a plurality of packing bags 5 having the refills 1 for a multi-refill writing instrument therein in a limited space for storage.

[43] In the refill 1 for a multi-refill writing instrument according to this aspect (fortieth aspect of the invention), preferably, the packing bag has a hanging hole at one end thereof, and the refill is accommodated in the packing bag such that the operating body is arranged close to the hanging hole. (forty third aspect of the invention).

According to the refill 1 for a multi-refill writing instrument (forty third aspect of the invention), the packing bag 5 is hung up with the ballpoint pen tip 2 (nib) facing downward, which makes it possible to prevent ink from being retreated toward the rear side of the ink containing tube 3. Since the operating body 4 is arranged so as to face upward, the user can easily unpack the packing bag 5 while discriminating the ink color of the operating body 4.

[44] In the refill 1 for a multi-refill writing instrument according to this aspect (fortieth aspect of the invention), preferably, the packing bag has a hanging hole at one end thereof, and the refill is accommodated in the packing bag such that the ballpoint pen tip is arranged close to the hanging hole. (forty fourth aspect of the invention).

According to the refill 1 for a multi-refill writing instrument (forty fourth aspect of the invention), the packing bag 5 is hung up with the ballpoint pen tip 2 (nib) facing upward, which makes it possible to prevent ink from leaking from the leading end of the ballpoint pen tip 2.

[45] In the refill 1 for a multi-refill writing instrument according to this aspect (fortieth aspect of the invention), preferably, the packing bag includes:

a hanging hole that is provided at one end thereof; and a colored portion that is provided around the hanging hole on the surface thereof and is colored in the same color as that of the ink contained in the ink containing tube. (forty fifth aspect of the invention). Alternatively, the hanging hole 51 may be formed in a cut-out or a hook shape.

According to the refill 1 for a multi-refill writing instrument (forty fifth aspect of the invention), the user can simultaneously view the colored portion 52 formed around the hanging hole 51 on the surface of the packing bag 5 and the operating body 4 colored in the same color as that of ink. Thus, the user can easily discriminate the colors of ink at a relative long distance.

[46] In the refill 1 for a multi-refill writing instrument according to this aspect (thirty fourth aspect of the invention), preferably, the ink containing tube is formed of a transparent or semitransparent material, and the ink contained in the ink containing tube is a dye ink. (forty sixth aspect of the invention).

According to the refill 1 for a multi-refill writing instrument (forty sixth aspect of the invention), the ink contained in the ink containing tube 3 is a dye ink (ink containing a dye as a coloring agent). Comparing with a structure in which a pigment-based ink is used, even if the color of the ink containing tube 3 can be discriminated, it is not easy to discriminate the color of ink. However, the operating body 4 colored in the same color as that of ink is conspicuous, and thus the appearance of the entire refill is improved. As the dye ink, an aqueous ink or an oil ink may be used.

[47] In the refill 1 for a multi-refill writing instrument according to this aspect (thirty fourth aspect of the invention), it is preferable that a resin film is fixed to the front end of the ballpoint pen tip to prevent the ballpoint pen tip from being dried. (forty seventh aspect of the invention).

According to the refill 1 for a multi-refill writing instrument (forty seventh aspect of the invention), since the resin film 21 is fixed to the front end of the ballpoint pen tip 2 to prevent the ballpoint pen tip 2 from being dried, it is possible to prevent the ballpoint pen tip from being dried until the user uses the refill, and thus it is convenient to store the refill with the operating body 4 connected to the ink containing tube. In particular, the refill 1 for a multi-refill writing instrument (forty seventh aspect of the invention) is effective for an aqueous ink that is apt to evaporate.

EFFECTS OF THE INVENTION

According to the multi-refill writing instrument described in first aspect of the invention, the user can replace a writing body with a new one having a color that the user selected and also replace an operating body corresponding to the writing body. In addition, it is possible to prevent misconnection between the writing body and the operating body. Further, it is unnecessary to replace small parts unlike the conventional multi-refill writing instrument, which makes it possible to rapidly and reliably perform the replacement.

According to the multi-refill writing instrument described in second aspect of the invention, the user can replace a writing body with a new one having a color that the user selected and also replace an operating body corresponding to the writing body. In addition, it is possible to prevent misconnection between the writing body and the operating body. Further, it is unnecessary to replace small parts unlike the conventional multi-refill writing instrument, which makes it possible to rapidly and reliably perform the replacement.

According to the multi-refill writing instrument described in third aspect of the invention, it is possible to simply replace the writing body and the operating body and thus to rapidly and reliably perform the replacement thereof.

According to the multi-refill writing instrument described in fourth aspect of the invention, it is possible to more simply replace the writing body and the operating body, and thus any user can rapidly and reliably perform the replacement thereof. When the writing body and the operating body connected to each other is provided to the user, the user does not need to connect the writing body to the operating body, which makes it possible to reliably prevent misconnection between the writing body and the operating body connected to the writing body when the writing body is replaced.

According to the multi-refill writing instrument described in fifth aspect of the invention, it is possible to simply replace the writing body and the operating body and thus to rapidly and reliably perform the replacement thereof.

According to the multi-refill writing instrument described in sixth aspect of the invention, it is possible to ensure sufficient openness of the opening portion of the rear end of the barrel when the operating body is replaced, and thus to easily pull out the operating body from the barrel.

According to the multi-refill writing instrument described in seventh aspect of the invention, it is possible to easily pull out the operating body from the barrel without inclining the opening portion of the rear end of the barrel downward.

According to the multi-refill writing instrument described in eighth aspect of the invention, when the operating body is pulled out from the barrel, it is possible to prevent the elastic body from falling out from the barrel.

According to the multi-refill writing instrument described in ninth aspect of the invention, the guide portion prevents the operating body from being inserted into the barrel in the wrong direction.

According to the multi-refill writing instrument described in tenth aspect of the invention, it is possible to reliably close the opening portion with the lid portion.

According to the multi-refill writing instrument described in eleventh aspect of the invention, when the operating body is replaced, the abutting wall portion is moved to a contact position with the operating body to ensure sufficient openness of-the opening portion of the rear end of the barrel, which enables to easily pull out the operating body from the barrel.

According to the multi-refill writing instrument described in twelfth aspect of the invention, it is possible to easily perform an operation of closing the opening portion with the lid portion.

According to the multi-refill writing instrument described in thirteenth aspect of the invention, it is possible to easily discriminate the ink color of the writing body to be operated so as for a nib thereof to protrude from the barrel by means of the operating body exposed through the window hole of the barrel.

According to the multi-refill writing instrument described in fourteenth aspect of the invention, it is possible to prevent the lid portion from being lost.

According to the multi-refill writing instrument described in fifteenth aspect of the invention, it is possible to easily separate the lid portion from the opening portion, and to reliably keep the lid portion covered the opening portion.

According to the multi-refill writing instrument described in sixteenth aspect of the invention, it is possible to reliably close the opening portion.

According to the multi-refill writing instrument described in seventeenth aspect of the invention, it is possible to prevent the rear end of the barrel from being deformed outward in the radial direction.

According to the multi-refill writing instrument described in eighteenth aspect of the invention, it is possible to maintain stable mounting between the lid portion and the rear end of the barrel.

According to the multi-refill writing instrument described in nineteenth aspect of the invention, it is possible to prevent the rear end of the barrel from being deformed outward in the radial direction.

According to the multi-refill writing instrument described in twentieth aspect of the invention, when the engaging portions of the lid portion are engaged with the engaged portions of the rear end of the rear barrel, it is possible to prevent the rear end of the barrel from being deformed inward in the radial direction.

According to the multi-refill writing instrument described in twenty first aspect of the invention, it is unnecessary to form the lid portion so as to protrude from the rear end of the barrel by a relatively long distance.

According to the multi-refill writing instrument described in twenty second aspect of the invention, it is possible to increase the amount of engagement between the engaging portions and the engaged portions, and thus to maintain stable engagement therebetween.

According to the multi-refill writing instrument described in twenty third aspect of the invention, it is possible to increase the amount of engagement between the engaging portions and the engaged portions, and thus to maintain stable engagement therebetween.

According to the multi-refill writing instrument described in twenty fourth aspect of the invention, the user can replace a writing body with a new one having a color that the user selected and also replace an operating body corresponding to the writing body. In addition, it is possible to prevent misconnection between the writing body and the operating body.

Further, it is unnecessary to replace small parts unlike the conventional multi-refill writing instrument, which makes it possible to rapidly and reliably perform the replacement.

According to the multi-refill writing instrument described in twenty fifth aspect of the invention, it is possible to replace the operating body and the writing body through the separated parts of the peripheral walls of the window holes. Therefore, the user can replace the writing body with a new one having a color that the user selected and also replace an operating body corresponding to the writing body. In addition, it is possible to prevent misconnection between the writing body and the operating body. Further, the writing body and the operating body can be simply replaced, which makes it possible to rapidly and reliably perform the replacement thereof.

According to the multi-refill writing instrument described in twenty sixth aspect of the invention, when the operating body is replaced, it is possible to pull out the operating body protruding through the window hole from the barrel through the window holes separated from the barrel forward or backward. Thus, it is possible to replace the operating body easier.

According to the multi-refill writing instrument described in twenty seventh aspect of the invention, at the time of writing, the lid portion is mounted to the side walls of the rear end of the barrel, which makes it possible to prevent the side walls of the rear end of the barrel from being separated from each other in the radial direction.

According to the multi-refill writing instrument described in twenty eighth aspect of the invention, it is possible to more simply replace the writing body and the operating body, and thus any user can rapidly and reliably perform the replacement thereof. When the writing body and the operating body connected to each other is provided to the user, the user does not need to connect the writing body to the operating body, which makes it possible to reliably prevent misconnection between the writing body and the operating body connected to the writing body when the writing body is replaced.

According to the multi-refill writing instrument described in twenty ninth aspect of the invention, the user can replace the writing body with a new one having a color that the user selected and also replace an operating body corresponding to the writing body. In addition, it is possible to prevent misconnection between the writing body and the operating body. Further, it is unnecessary to replace small parts unlike the conventional multi-refill writing instrument, which makes it possible to rapidly and reliably perform the replacement.

According to the multi-refill writing instrument described in thirtieth aspect of the invention, it is possible to more simply replace the writing body and the operating body, and thus any user can rapidly and reliably perform the replacement thereof. When the writing body and the operating body connected to each other is provided to the user, the user does not need to connect the writing body to the operating body, which makes it possible to reliably prevent misconnection between the writing body and the operating body connected to the writing body when the writing body is replaced.

According to the multi-refill writing instrument described in thirty first aspect of the invention, it is possible to prevent the front end portions of the rear barrel from being deformed inward and outward in the radial direction.

According to the multi-refill writing instrument described in thirty second aspect of the invention, it is easy to form the engaging holes.

According to the multi-refill writing instrument described in thirty third aspect of the invention, when the operating body is pulled out from the barrel, it is possible to prevent the elastic bodies from falling out from the barrel.

According to the refill for a multi-refill writing instrument described in thirty fourth aspect of the invention, it is possible to easily discriminate the colors of ink at a relatively long distance. As a result, there is no fear that the user may select a refill having an ink color different from the ink color that the user wants to use.

According to the refill for a multi-refill writing instrument described in thirty fifth aspect of the invention, it is possible to provide an ink color display portion having a large area to the large-diameter portion, which makes it easy to discriminate the color of ink.

According to the refill for a multi-refill writing instrument described in thirty sixth aspect of the invention, it is possible to provide an ink color display portion having a large area to the large-diameter portion, which makes it easy to discriminate the color of ink.

According to the refill for a multi-refill writing instrument described in thirty seventh aspect of the invention, it is possible to effectively form the ink color display portion having a large area.

According to the refill for a multi-refill writing instrument described in thirty eighth aspect of the invention, it is possible to improve the appearance of the operating body.

According to the refill for a multi-refill writing instrument described in thirty ninth aspect of the invention, it is possible to reliably discriminate the color of ink.

According to the refill for a multi-refill writing instrument described in fortieth aspect of the invention, it is possible for the user to easily perceive the operating body having the same color as that of the ink contained in the ink containing tube, and to prevent the operating body from being separated from the ink containing tube until the user purchases the refill.

According to the refill for a multi-refill writing instrument described in forty first aspect of the invention, the thickness of a portion of the packing pack accommodating the operating body does not increase, which makes it possible to pile up a plurality of packing bags having the refills for a multi-refill writing instrument therein in a limited space for storage.

According to the refill for a multi-refill writing instrument described in forty second aspect of the invention, the thickness of a portion of the packing bag accommodating the operating body does not increase, which makes it possible to pile up a plurality of packing bags having the refills for a multi-refill writing instrument therein in a limited space for storage.

According to the refill for a multi-refill writing instrument described in forty third aspect of the invention, the packing bag is hung up with the ballpoint pen tip facing downward, which makes it possible to prevent ink from being retreated toward the rear side of the ink containing tube. Since the operating body is arranged so as to face upward, the user can easily unpack the packing bag while discriminating the ink color of the operating body.

According to the refill for a multi-refill writing instrument described in forty fourth aspect of the invention, the packing bag is hung up with the ballpoint pen tip facing upward, which makes it possible to prevent ink from leaking from the leading end of the ballpoint pen tip.

According to the refill for a multi-refill writing instrument described in forty fifth aspect of the invention, it is possible to easily discriminate the color of ink at a relatively long distance.

According to the refill for a multi-refill writing instrument described in forty sixth aspect of the invention, the operating body having the same color as that of ink is conspicuous, and thus the appearance of the entire refill is improved.

According to the refill for a multi-refill writing instrument described in forty seventh aspect of the invention, it is possible to prevent the ballpoint pen tip from being dried until the user uses the refill, and thus it is convenient to store the refill with the operating body connected to the ink containing tube.

DETAILED DESCRIPTION OF THE PREFERRED EMBODIMENTS

Figure 1:
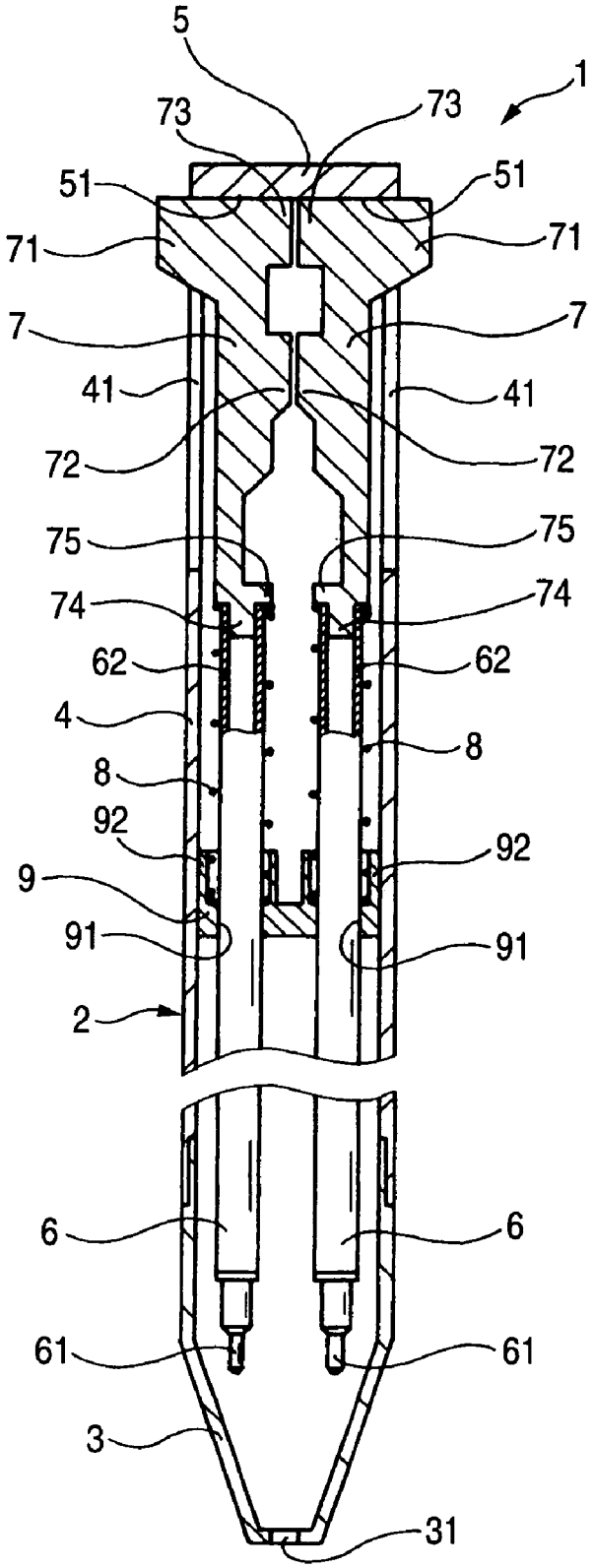
FIG. 1 is a longitudinal cross-sectional view illustrating a multi-refill writing instrument whose pen tips are in a retracted state (at the time of non-writing) according to a first embodiment of the invention.
Figure 2:
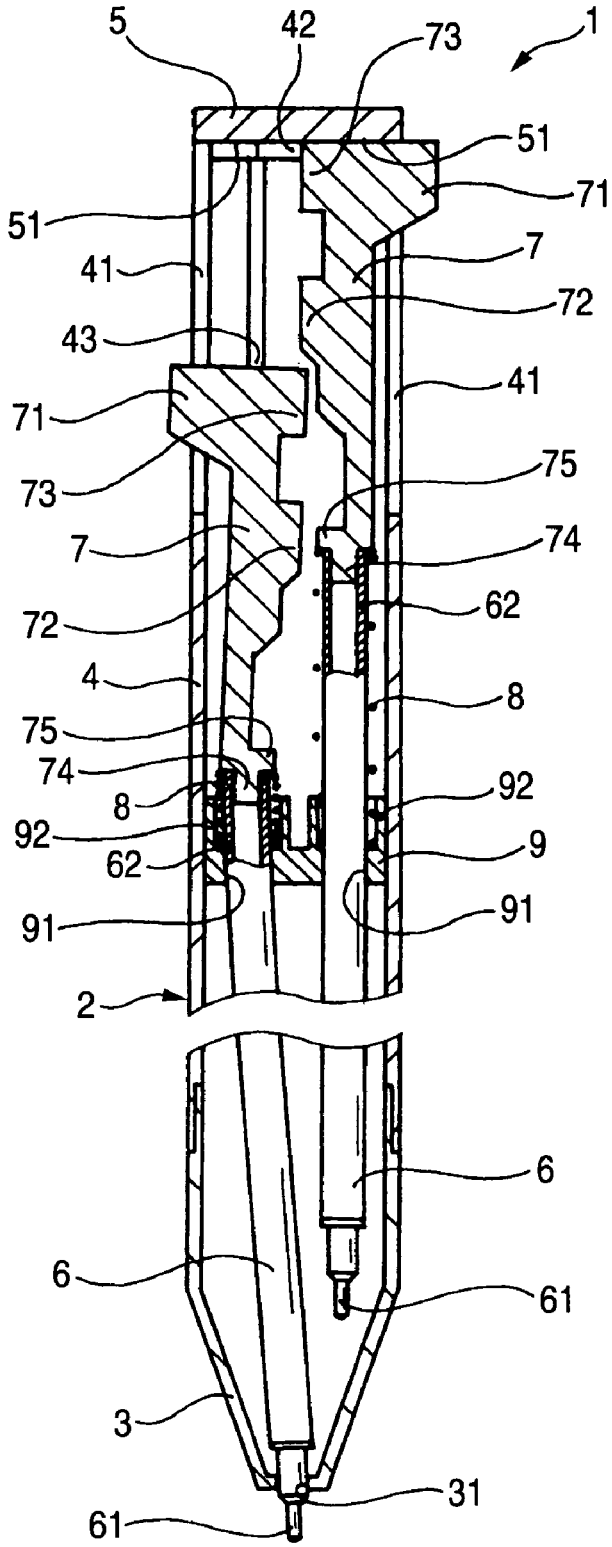
FIG. 2 is a longitudinal cross-sectional view illustrating the multi-refill writing instrument shown in FIG. 1 whose one pen tip is in a protruding state (at the time of writing)
Figure 3:
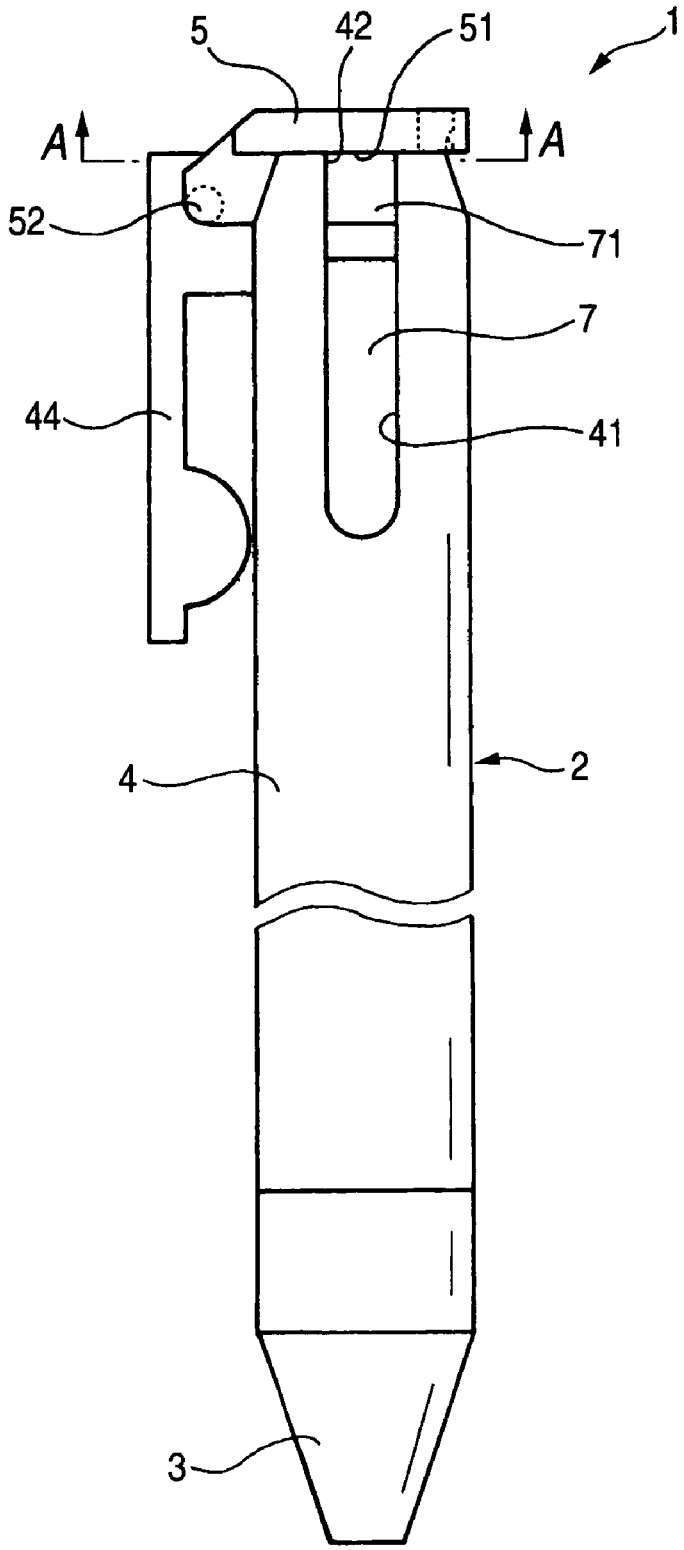
FIG. 3 is a side view illustrating a state in which a lid portion closes up a rear opening portion of the multi-refill writing instrument shown in FIG. 1.
Figure 4:
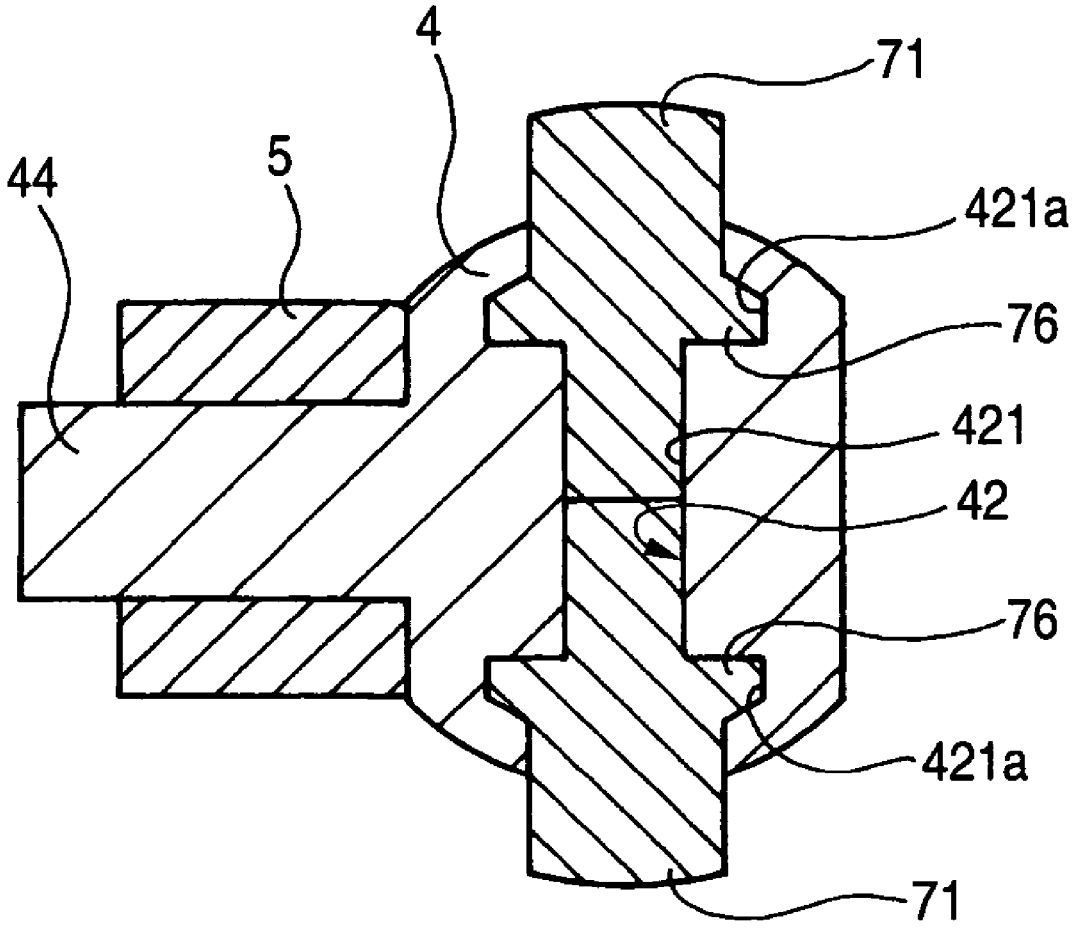
FIG. 4 is an enlarged cross-sectional view taken along the line A-A shown in FIG. 3.
Figure 5:
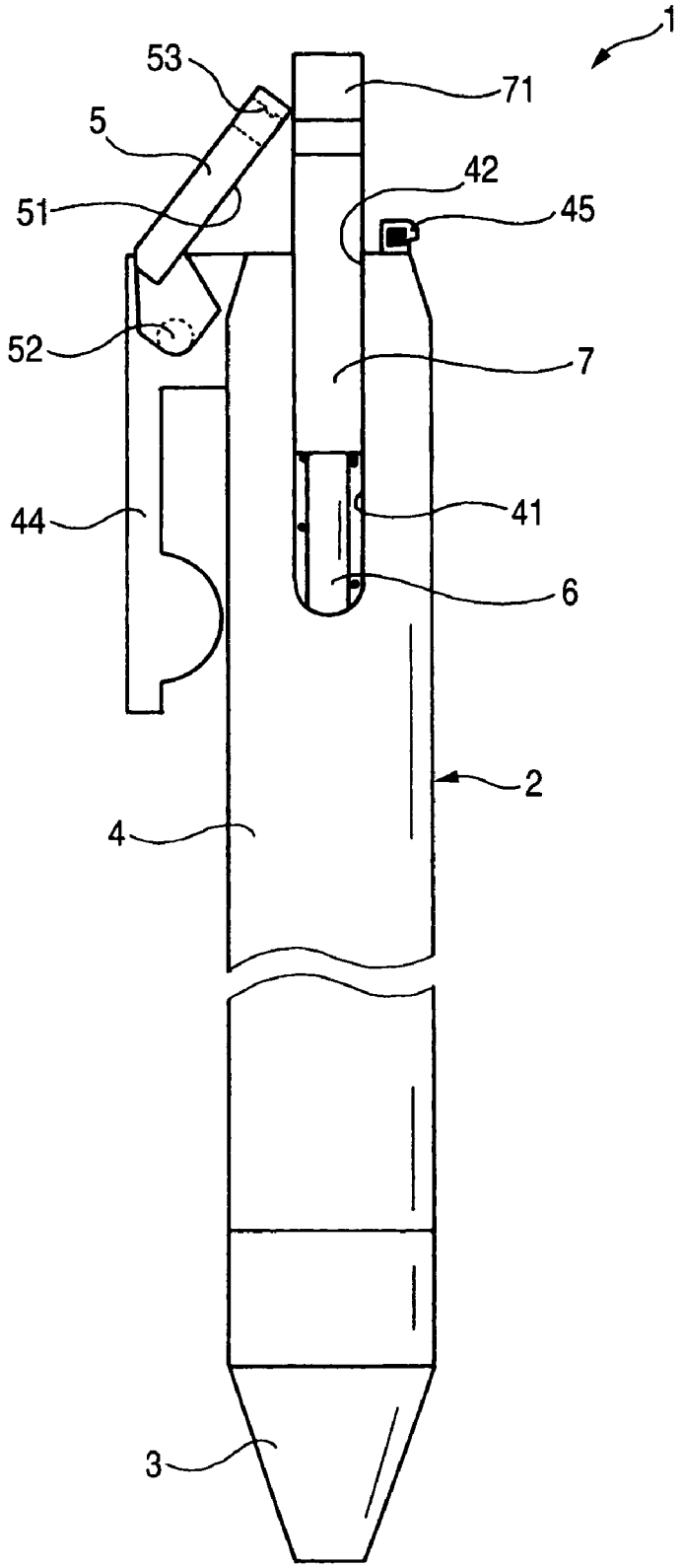
FIG. 5 is a side view illustrating a state in which the lid portion is separated from the rear opening portion of the multi-refill writing instrument shown in FIG. 1.
Figure 6:
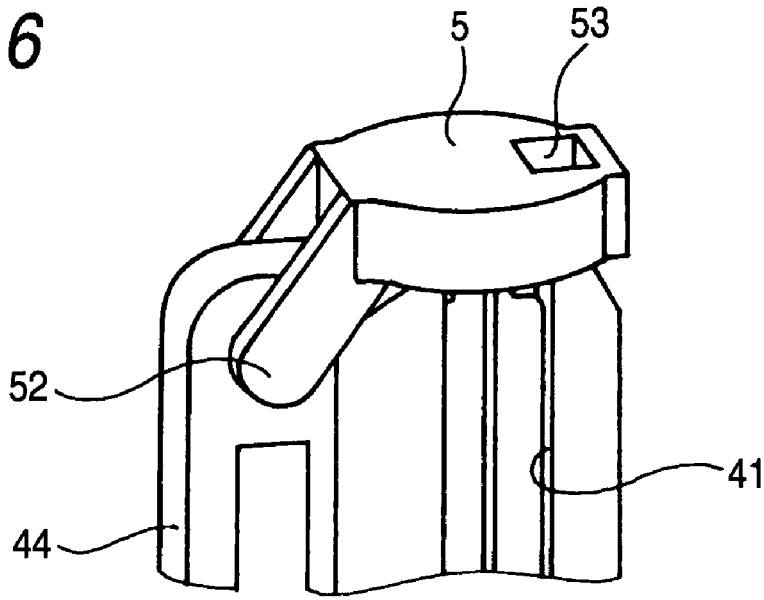
FIG. 6 is a substantial part of perspective view illustrating a state in which the lid portion closes up the rear opening portion of the multi-refill writing instrument shown in FIG. 1.
Figure 7:
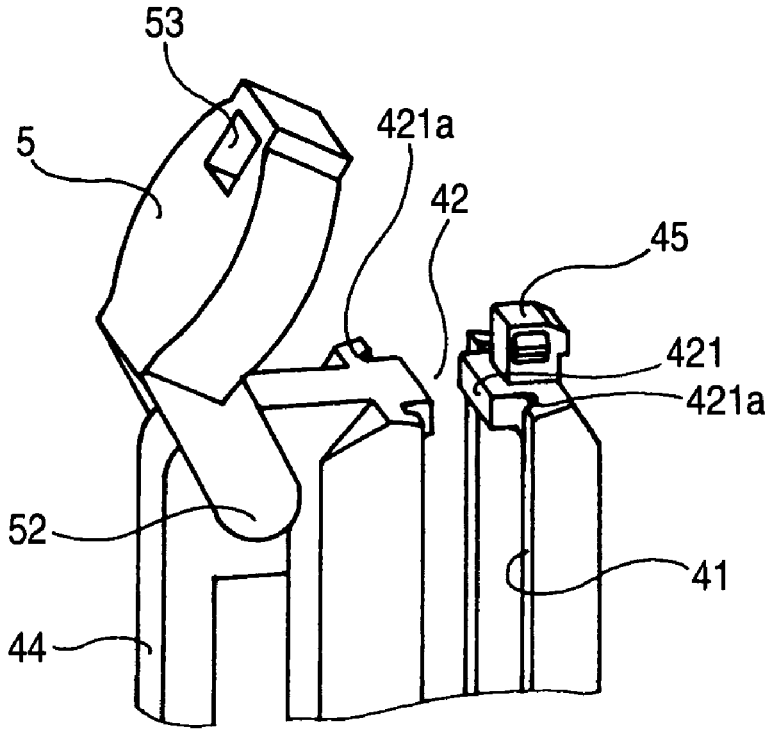
FIG. 7 is a substantial part of perspective view illustrating a state in which the lid portion is separated from the rear opening portion of the multi-refill writing instrument shown in FIG. 1.

Hereinafter, preferred embodiments of the invention will be described below.

First Embodiment

A first embodiment of the invention is shown in FIGS. 1 to 7. A multi-refill writing instrument 1 according to this embodiment includes a barrel 2 and a plurality of writing bodies (for example, two writing bodies) 6 accommodated in the barrel 2 such that it can move backward and forward. The writing bodies 6 are urged toward the rear side by elastic bodies 8 (specifically, compression coil springs).

(Barrel)

The barrel 2 includes a front barrel 3 having a tapered cylinder and a cylindrical rear barrel 4 that is screwed to the rear end of the front barrel 3 or is fitted thereinto by pressing. A front hole 31 is provided in a front end of a front barrel 3 in an axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two window holes) 41 extending in the axial direction are provided in the radial direction in the side wall of the rear part of the rear barrel 4. The two window holes are formed so as to be symmetric with respect to an axis line of the writing instrument. In addition, an opening portion 42 is formed in the rear end of the rear barrel 4 in the axial direction. The opening portion 42 communicates with the window holes 41 at the rear end of the rear barrel 4 (that is, the rear end of the barrel 2). In this way, the rear ends of the window holes 41 are cut out, so that the rear ends of the window holes 41 are opened. Meanwhile, the front ends of the window holes 41 are always closed.

Guide portions 421 are formed on both inner walls of the opening portion 42. When an operating body 7 is inserted, the guide portion 421 slidably contacts with the side surface of the operating body 7 to regulate the direction of the side surface of the operating body 7. In addition, concave portions 421*a*, into which retaining projections 76 of the operating body 7 can be inserted, are formed in each guide portion 421. The guide portions 421 are formed such that they can be inserted only when the operating portions 71 of the operating bodies 7 face outward in the radial direction.

Locking wall portions 43, which are composed of ribs extending in the axial direction, are formed on the inner surfaces of the side walls between the window portions 41 of the rear barrel 4. When the nib 61 protrudes from the barrel, the rear end of the operating body 7 of the writing body 6 is locked to the locking wall portion 43.

A clip 44 is provided on an outer surface of the side wall of the rear barrel 4 between the window holes 41.

(Lid Portion)

An openable lid portion 5 that closes the opening portion 42 is pivotally provided at the rear end of the rear barrel 4. One end of the lid portion 5 is pivotably connected to the base of the clip 44 by a hinge portion 52. The hinge portion 52 extends in the right and left directions of the clip 44 as viewing the front side of the clip 44 when the nib directs downward, and thus the lid portion 5 is pivotably moved substantially in front and rear directions. An abutting wall portion 51 is formed on the front surface of the lid portion 5. The rear ends of the operating bodies 7 connected to the rear ends of the inserted writing bodies 6 come in contact with the abutting wall portion 51. In this embodiment, more specifically, the lid portion 5 is pivotally connected to the rear barrel using the hinge portion 52 as a rotational shaft. Note that, the lid portion 5 may be integrally connected to the clip 44 by a flexible connecting portion or a flexible thin portion.

An engaging portion 53 is provided on the front surface of the other end of the lid portion 5 (more specifically, an engaging concave portion or an engaging hole portion is formed). Note that the other end of the lid portion 5 means an end other than the portion to which the rear end of the barrel pivotably connects. An engaged portion 45 that can engage with the engaging portion 53 is provided at the rear end of the rear barrel 4 (more specifically, an engaging convex portion is provided). An inward projection is formed on the inner surface of the engaging portion 53 (the engaging concave portion or the engaging hole portion), and an outward projection that can be fitted into the inward projection is formed on the outer surface of the engaged portion 45 (the engaging convex portion).

When the lid portion 5 closes up the opening portion 42, the engaging portion 53 and the engaged portion 45 are engaged with each other (more specifically, the outward projection is fitted into the inward projection), and rearward rearwardly urging force is generated by an elastic body 8 causes the operating body 7 to come in contact with the abutting wall portion 51 of the lid portion 5. The lid portion 5 is not opened as long as the engaged state is not released.

The structure of the engaging portion 53 and the engaged portion 45 is not limited to the above. For example, the engaging portion 53 may be composed of the engaging convex portion, and the engaged portion 45 may be composed of the engaging concave portion or the engaging hole portion.

(Writing Body)

The writing bodies 6 are ballpoint pen refills, and each of the writing bodies 6 is composed of a ballpoint pen tip (that is, the nib 61) holding a ball rotatably at a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the aqueous gel ink having shear thinning viscosity, the aqueous ink having low viscosity, or the oil ink having low viscosity is used, a follower, which is made of a high-viscosity liquid and is advanced with the consumption of ink, is filled into the rear side of the ink of the ink containing tube 62.

In the ballpoint pen tip, the ball rotatably held in the leading end thereof may be urged forward by, for example, an elastic member so as to come in close contact with an inner surface of the leading end. In addition, the ballpoint pen tip may be directly fitted to a front opening of the ink containing tube 62 by pressing. However, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, the retaining projections 76 are formed on both side walls of the operating body 7. The retaining projections 76 can be engaged with the inner surfaces of both side walls of the window holes 41.

When the nib 61 of the writing body 6 is in a retracted state, the rear end of the operating body 7 mounted to the writing body 6 comes in contact with the abutting wall portion 51 formed on the front surface of the lid portion 5. On the other hand, when the nib 61 of the writing body 6 protrudes from the barrel, the rear end of the operating body 7 mounted to the writing body 6 is locked to a locking wall portion 43 formed on the inner wall of the barrel 2.

When the operating portion 71 of the operating body 7 is operated to slide forward, the front protruding portion 72 of the operating body 7 connected to the rear end of the writing body 6 whose nib is in the retracted state comes in contact with the rear protruding portion 73 of the operating body 7 connected to another writing body 6 whose nib protrudes from the barrel, which causes the protruding state of the nib of another writing body 6 to be released.

(Discriminating Marks)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

In particular, when the ink containing tubes 62 are formed of an opaque material, or when the ink containing tubes 62 are formed of a transparent material and dye ink is contained in the ink containing tubes, it is difficult to discriminate the colors of the contained ink from the outside. However, in this embodiment, since the operating bodies 7 have substantially the same colors as those of the ink contained in the writing bodies, it is possible to easily discriminate the colors of ink contained in the writing bodies 6 for replacement, which exists outside the barrel 2, from the outside.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

(Elastic Body Supporting Portion)

An elastic body supporting portion 9 having a cylindrical shape is provided on the inner wall of the barrel 2 (that is, the inner wall of the rear barrel 4). A plurality of holes (for example, two holes) 91, through which the writing bodies 6 pass, are formed in the elastic body supporting portion 9 in the axial direction. The elastic bodies 8 are arranged between the rear surface of the elastic body supporting portion 9 and the front surfaces of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies 8 are locked to the front surfaces of the flange portions 75 of the operating bodies 7.

Holding portions 92, each composed of a cylindrical protruding portion which projects backward, are formed in the rear surface of the elastic body supporting portion 9 in the peripheries of the holes 91. The inner surfaces of the holding portions 92 hold the outer surfaces of the front end portions of the elastic bodies 8. In this way, when the writing bodies 6 and the operating bodies 7 are replaced, it is possible to prevent the elastic bodies 8 from falling off from the barrel 2 through the opening portion 42.

The elastic bodies 8 always urge the corresponding operating bodies 7 (that is, the writing bodies 6) backward. The elastic bodies 8 are compressed when the nibs of the writing bodies are retracted and when they protrude from the barrel (that is, the writing bodies 6 are urged toward the rear side), which makes it possible to the operating bodies 7 from being-rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating portion 71 of another writing body 6 whose nib is in the protruding state outward in the radial direction. Then, locking between the operating body 7 and the locking wall portion 43 of the barrel 2 is released, so that another writing body 6 is moved backward by the urging force of the elastic body 8, and the nib 61 of another writing body 6 is retracted into the barrel 2, causing the rear end of the operating portion 71 of another writing body 6 to come in contact with the abutting wall portion 51 of the front surface of the lid portion 5. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 43 formed on the inner wall of the barrel 2, thereby keeping the protruding state of the nib.

(Replacement of Writing Body and Operating Body)

Next, the replacement of the writing bodies 6 and the operating bodies 7 according to this embodiment will be described below.

In order to replace the writing bodies 6, in a state in which the lid portion 5 closes up the rear opening portion 42 of the barrel 2 (see FIGS. 3 and 5), an operating end portion of the lid portion 5 opposite to the hinge portion 52 is pushed backward to release engagement between the engaging portion 53 and the engaged portion 45, thereby pivoting the lid portion 5 backward. Then, the rear opening portion 42 of the barrel 2 is exposed. When the opening portion 42 is opened, the operating bodies 7 protrude backward through the opening portion 42 by the urging force of the elastic bodies 8. When the operating bodies 7 are pulled out from the rear end of the barrel 2 through the opening portion 42 (see FIGS. 5 and 7), the writing bodies 6 connected to the operating bodies 7 are also pulled out from the barrel 2 through the opening portion 42. Then, new writing bodies 6 and new operating bodies 7 connected to each other are-inserted into the barrel 2 through the opening portion 42. Subsequently, the lid portion 5 is pivoted forward to press the operating bodies 7 forward, with the rear ends of the inserted operating bodies 7 coming in contact with the abutting wall portion 51 of the lid portion 5. Thereafter, the engaging portion 53 engages with the engaged portion 45 to close up the opening portion 42. In this way, the replacement of the writing bodies 6 and the operating bodies 7 is completed.

Second Embodiment

Figure 8:
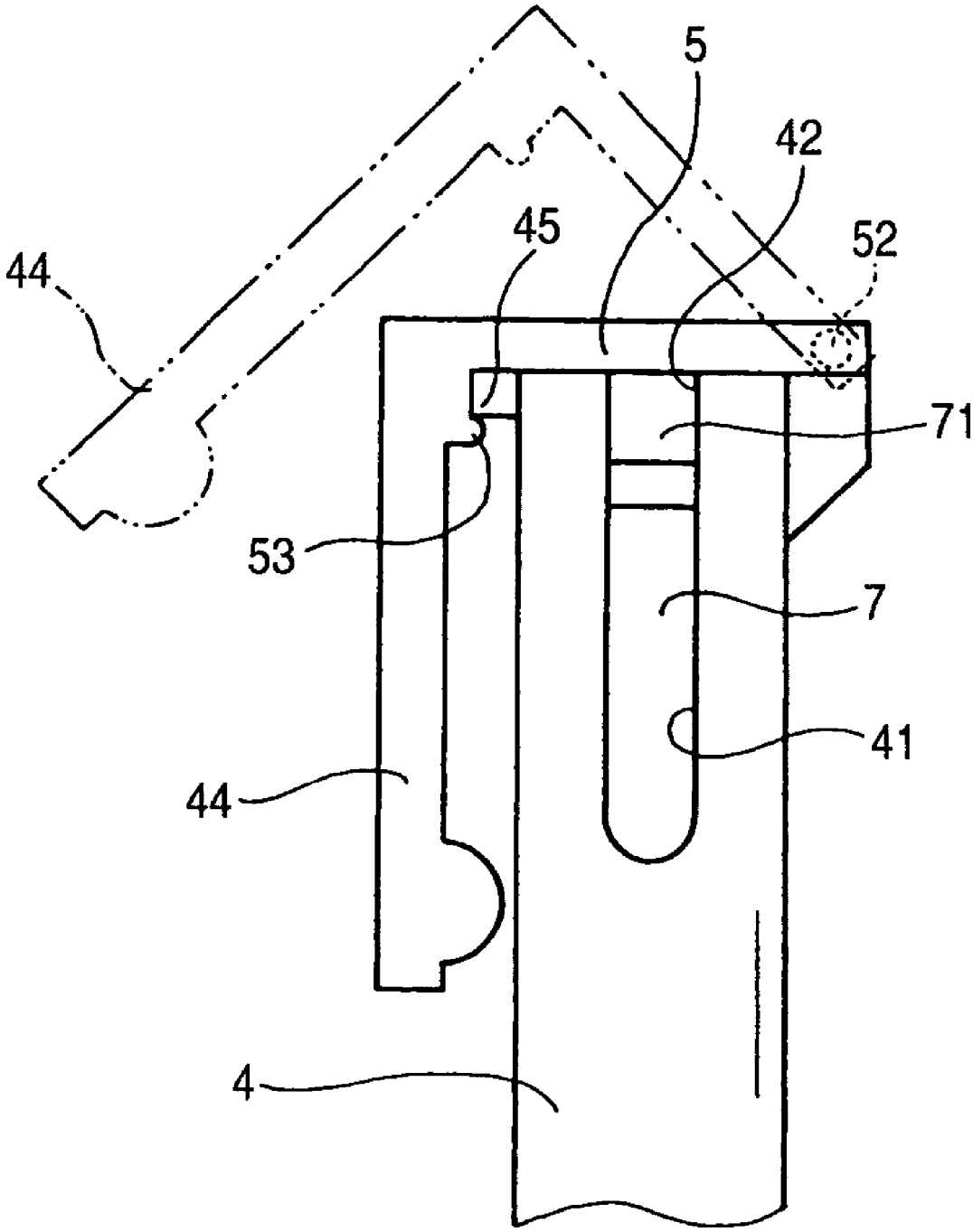
FIG. 8 is a substantial part of side view illustrating a multi-refill writing instrument according to a second embodiment of the invention.
Figure 9:
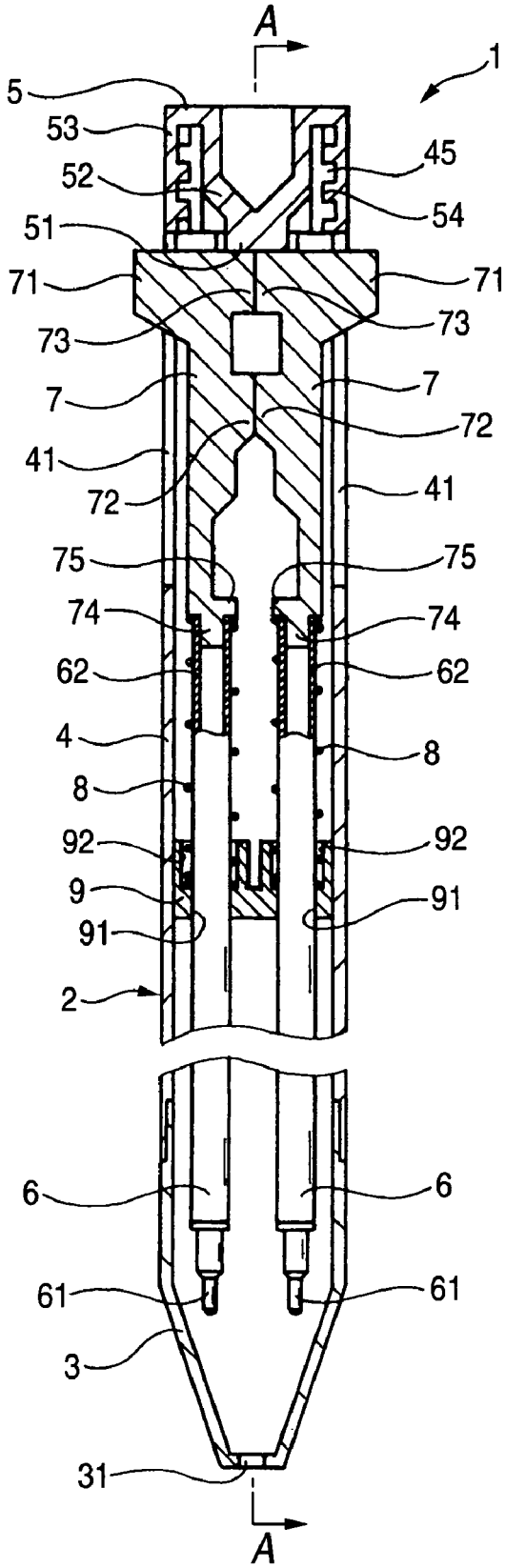
FIG. 9 is a longitudinal cross-sectional view illustrating a multi-refill writing instrument whose pen tips are in a retracted state (at the time of non-writing) according to a third embodiment of the invention.
Figure 10:
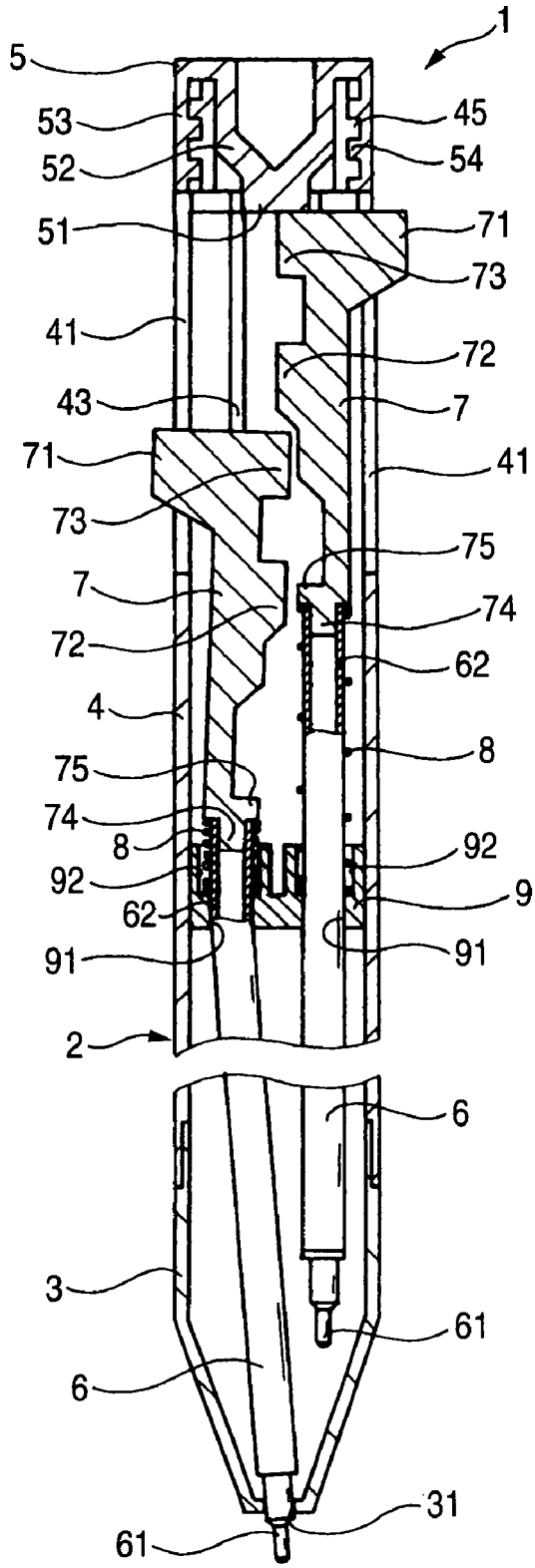
FIG. 10 is a longitudinal cross-sectional view illustrating the multi-refill writing instrument shown in FIG. 9 whose one pen tip is in a protruding state (at the time of writing).
Figure 11:
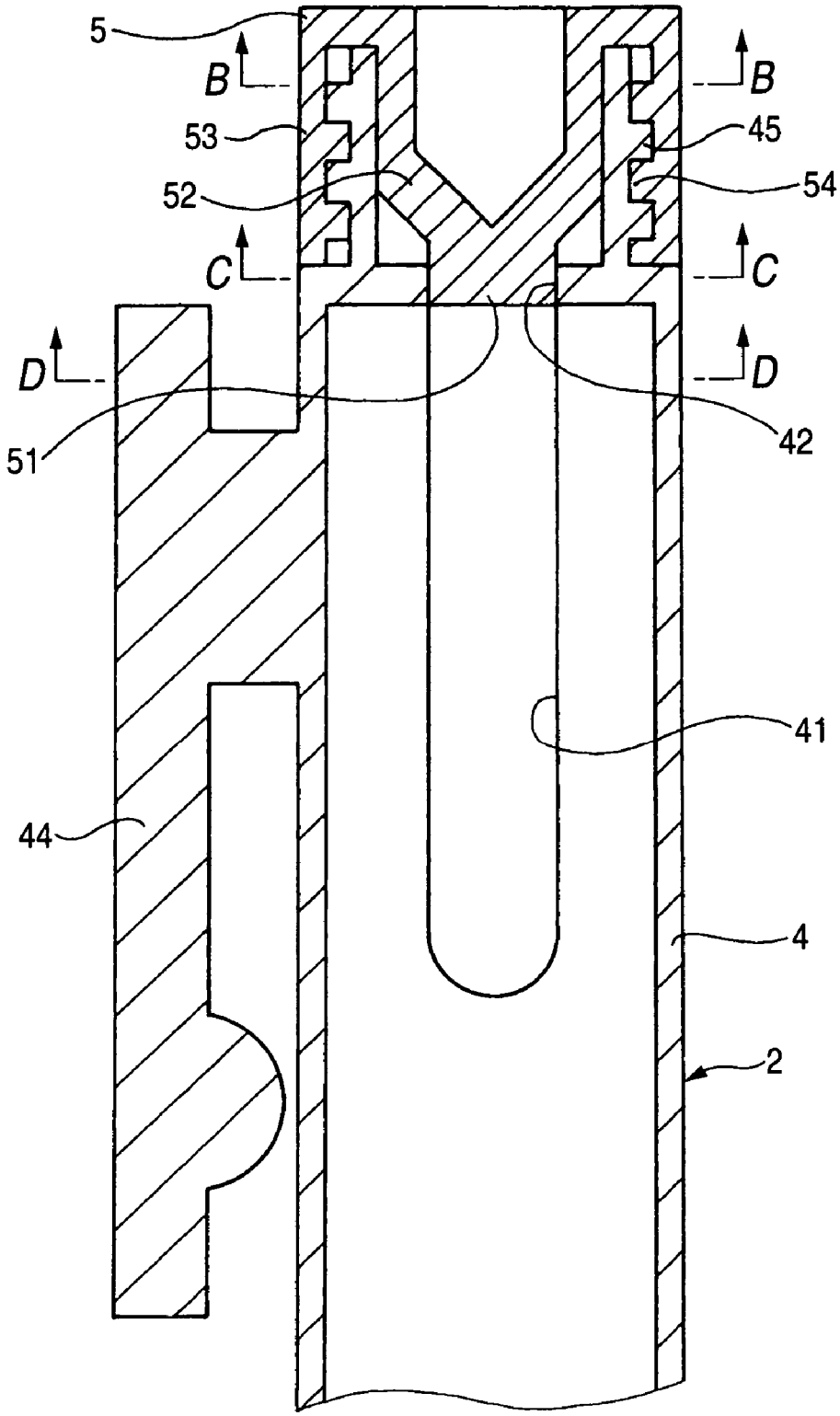
FIG. 11 is an enlarged cross-sectional view taken along the line A-A of FIG. 9, in which an operating body is omitted from the rear end of the multi-refill writing instrument.
Figure 12:
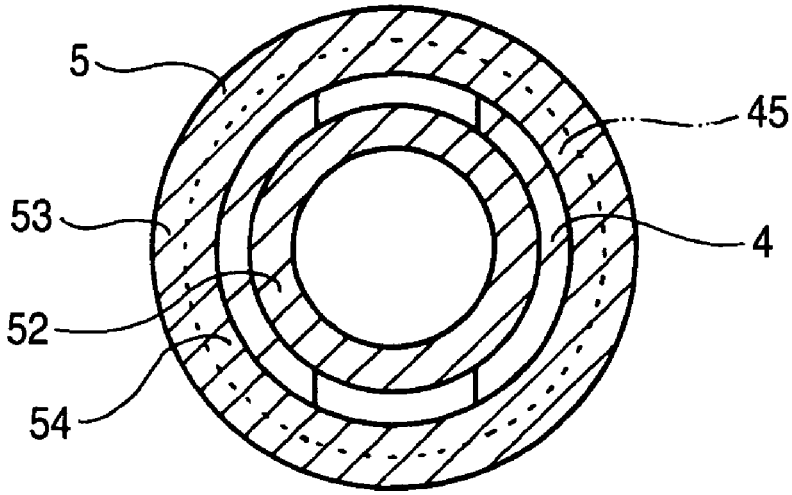
FIG. 12 is a cross-sectional view taken long the line B-B of FIG. 11.
Figure 13:
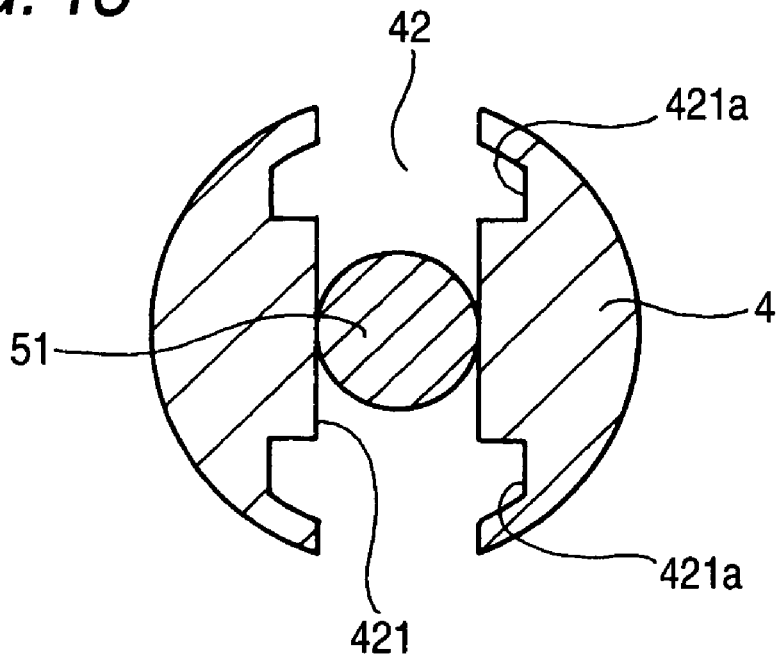
FIG. 13 is a cross-sectional view taken long the line C-C of FIG. 11.
Figure 14:
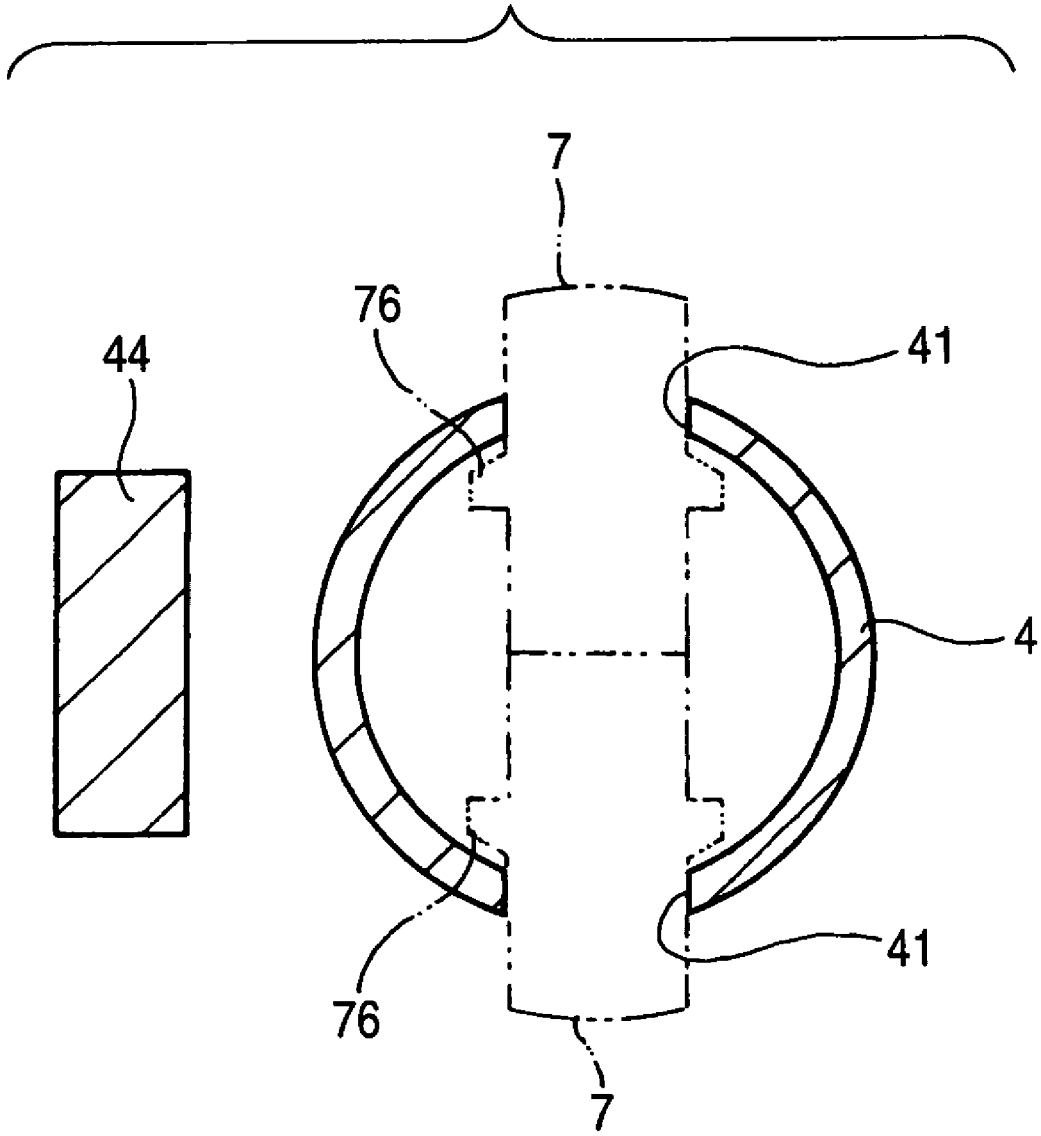
FIG. 14 is a cross-sectional view taken long the line D-D of FIG. 11.
Figure 15:
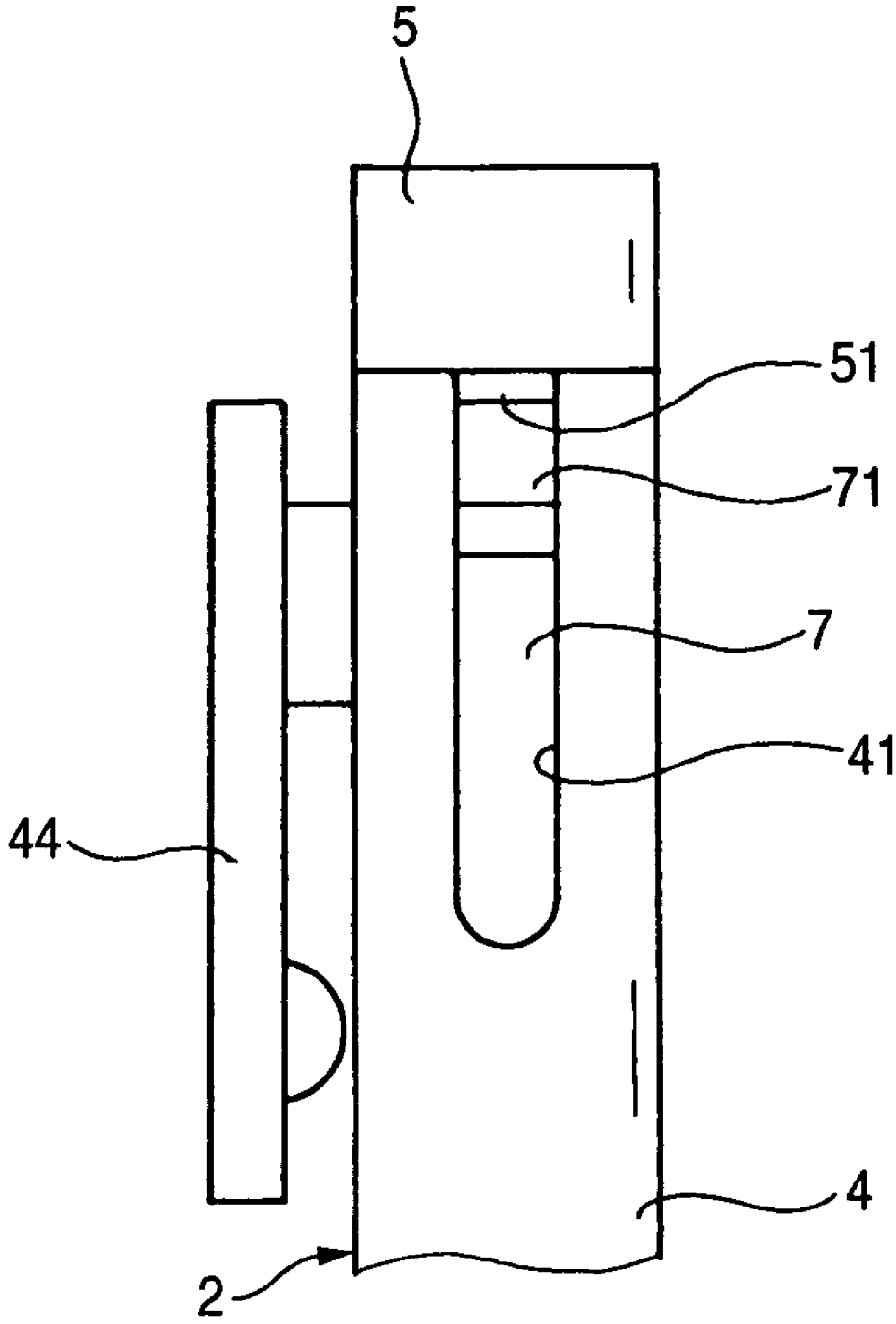
FIG. 15 is a side view illustrating a state in which a lid portion closes up a rear opening portion of the multi-refill writing instrument shown in FIG. 9.
Figure 16:
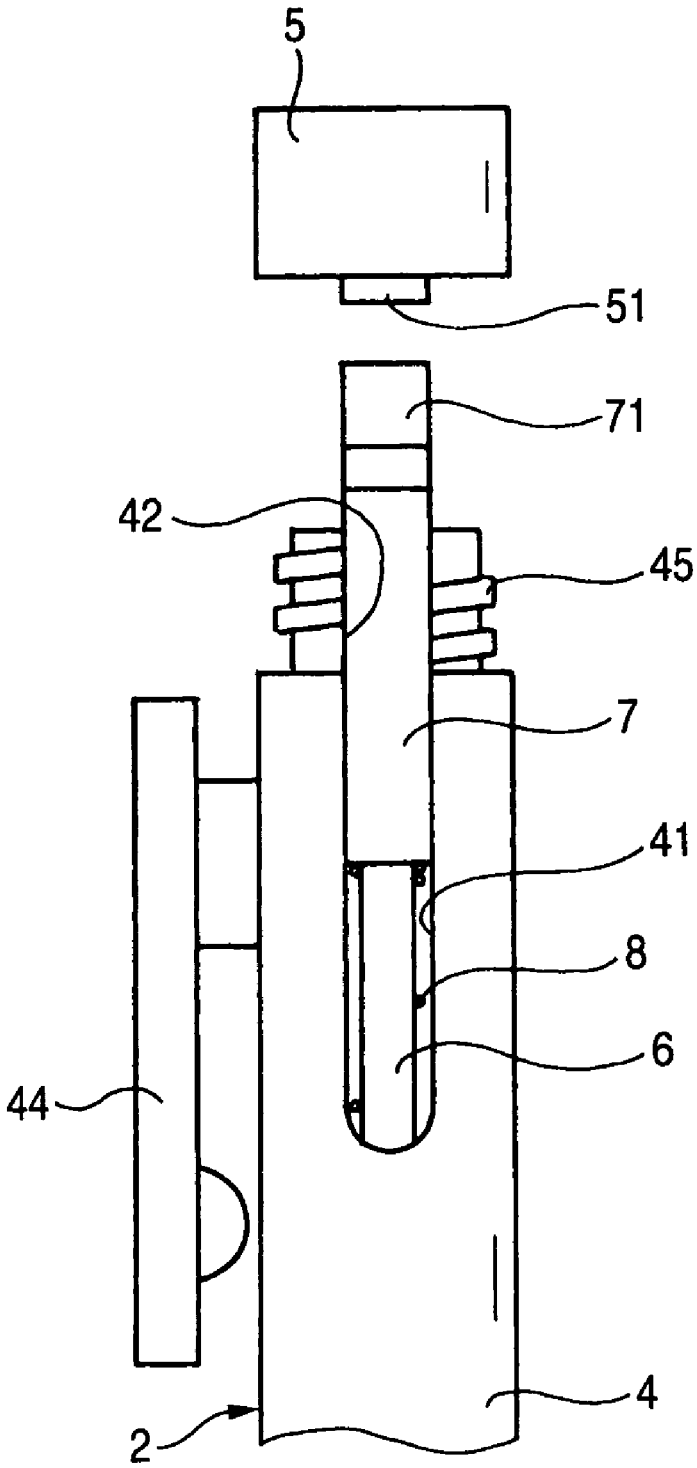
FIG. 16 is a side view illustrating a state in which the lid portion is separated from the rear opening portion of the multi-refill writing instrument shown in FIG. 9.
Figure 17:
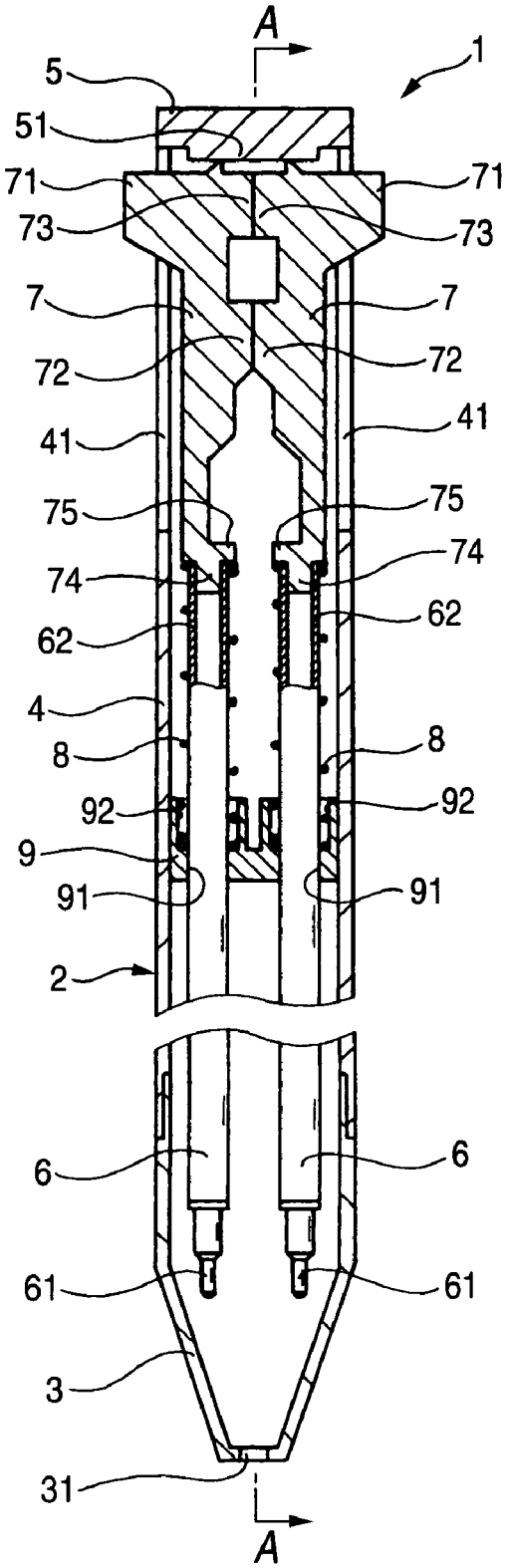
FIG. 17 is a longitudinal cross-sectional view illustrating a multi-refill writing instrument whose pen tips are in a retracted state (at the time of non-writing) according to a fourth embodiment of the invention.
Figure 18:
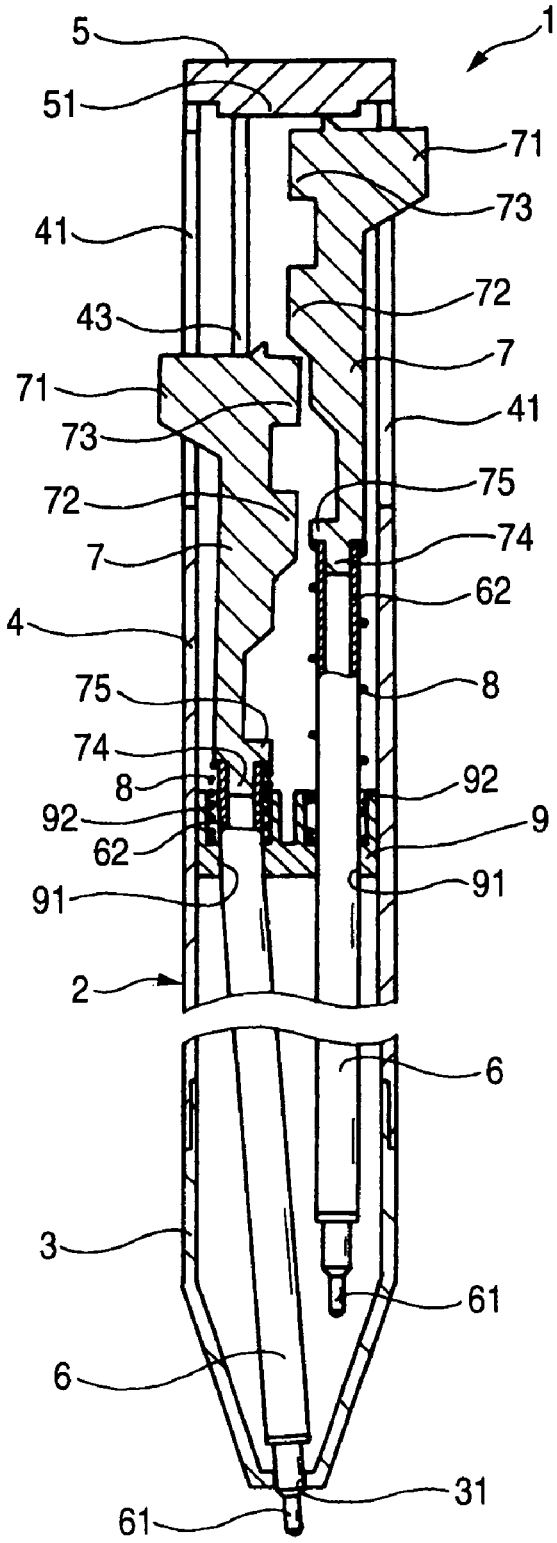
FIG. 18 is a longitudinal cross-sectional view illustrating the multi-refill writing instrument shown in FIG. 17 whose one pen tip is in a protruding state (at the time of writing)
Figure 19:
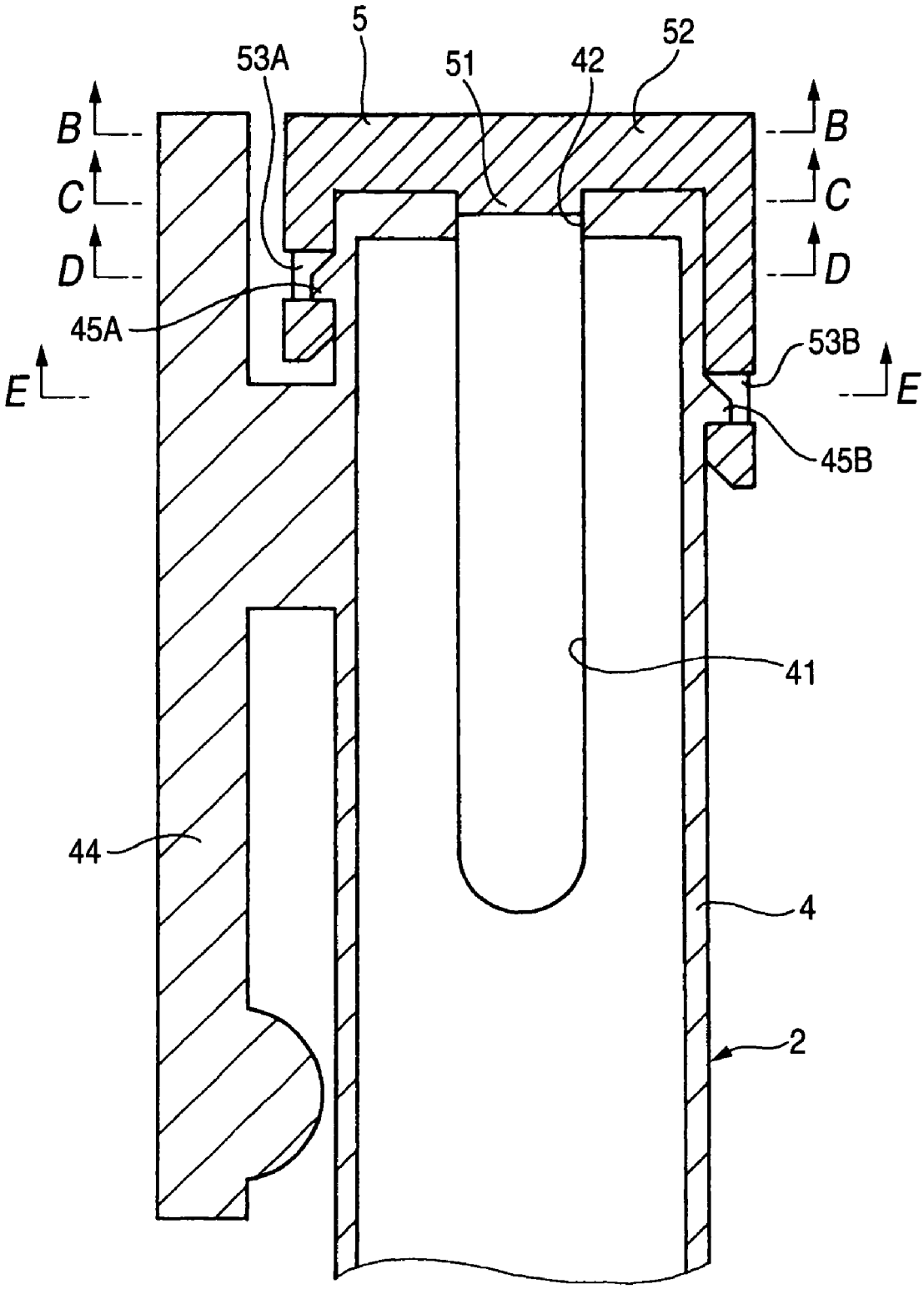
FIG. 19 is an enlarged cross-sectional view taken along the line A-A of FIG. 17, in which an operating body is omitted from the rear end of the multi-refill writing instrument.
Figure 20:
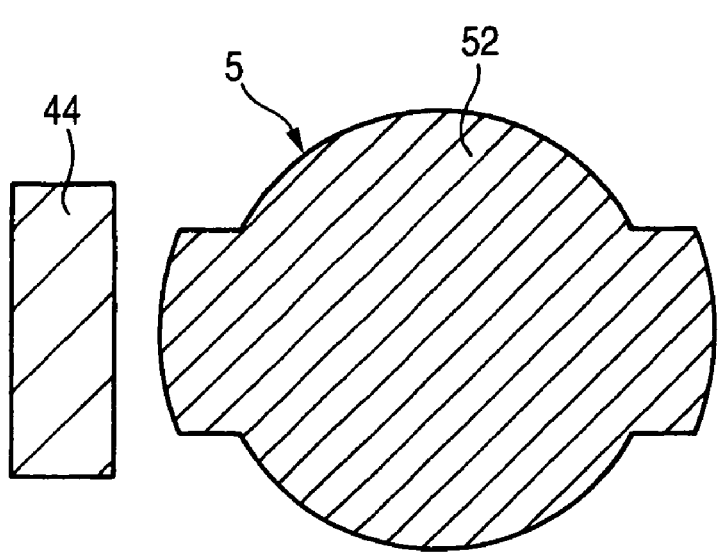
FIG. 20 is a cross-sectional view taken long the line B-B of FIG. 19.
Figure 21:
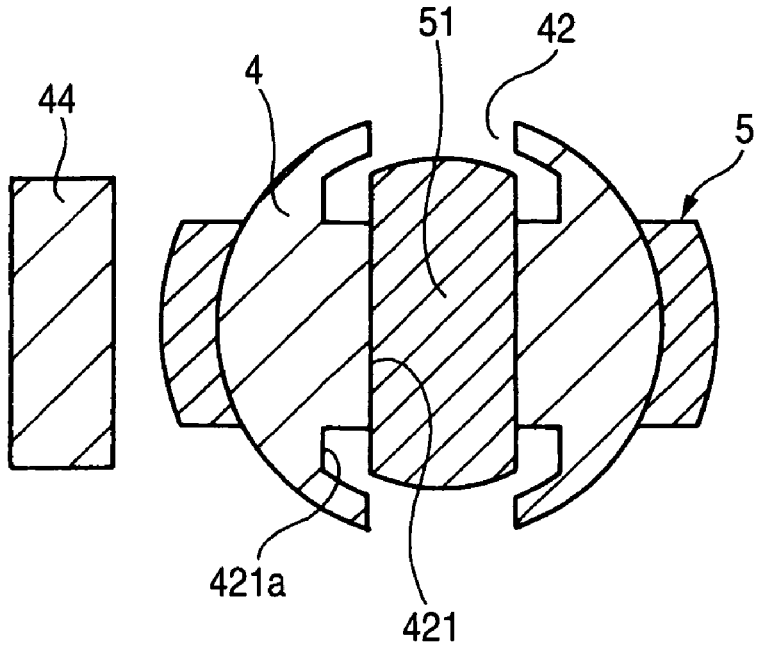
FIG. 21 is a cross-sectional view taken long the line C-C of FIG. 19.
Figure 22:
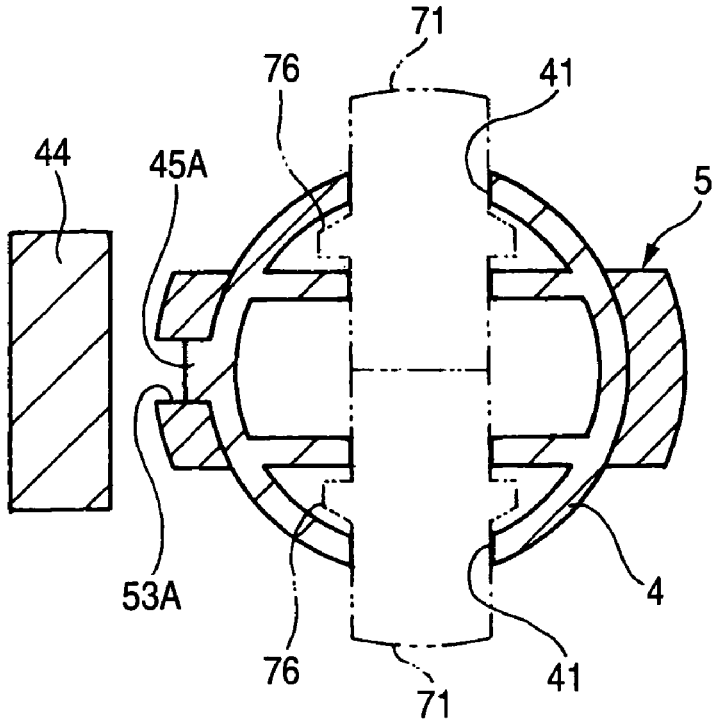
FIG. 22 is a cross-sectional view taken long the line D-D of FIG. 19.
Figure 23:
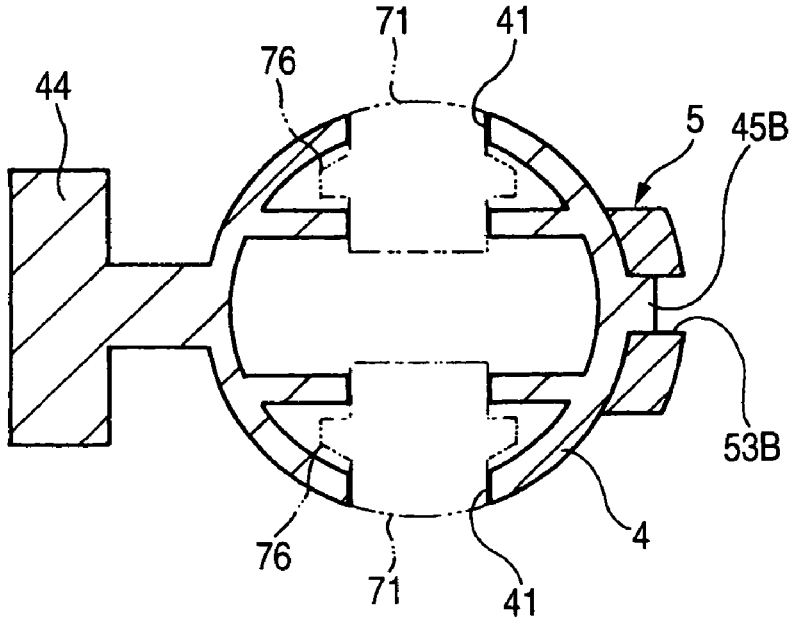
FIG. 23 is a cross-sectional-view taken long the line E-E of FIG. 19.
Figure 24:
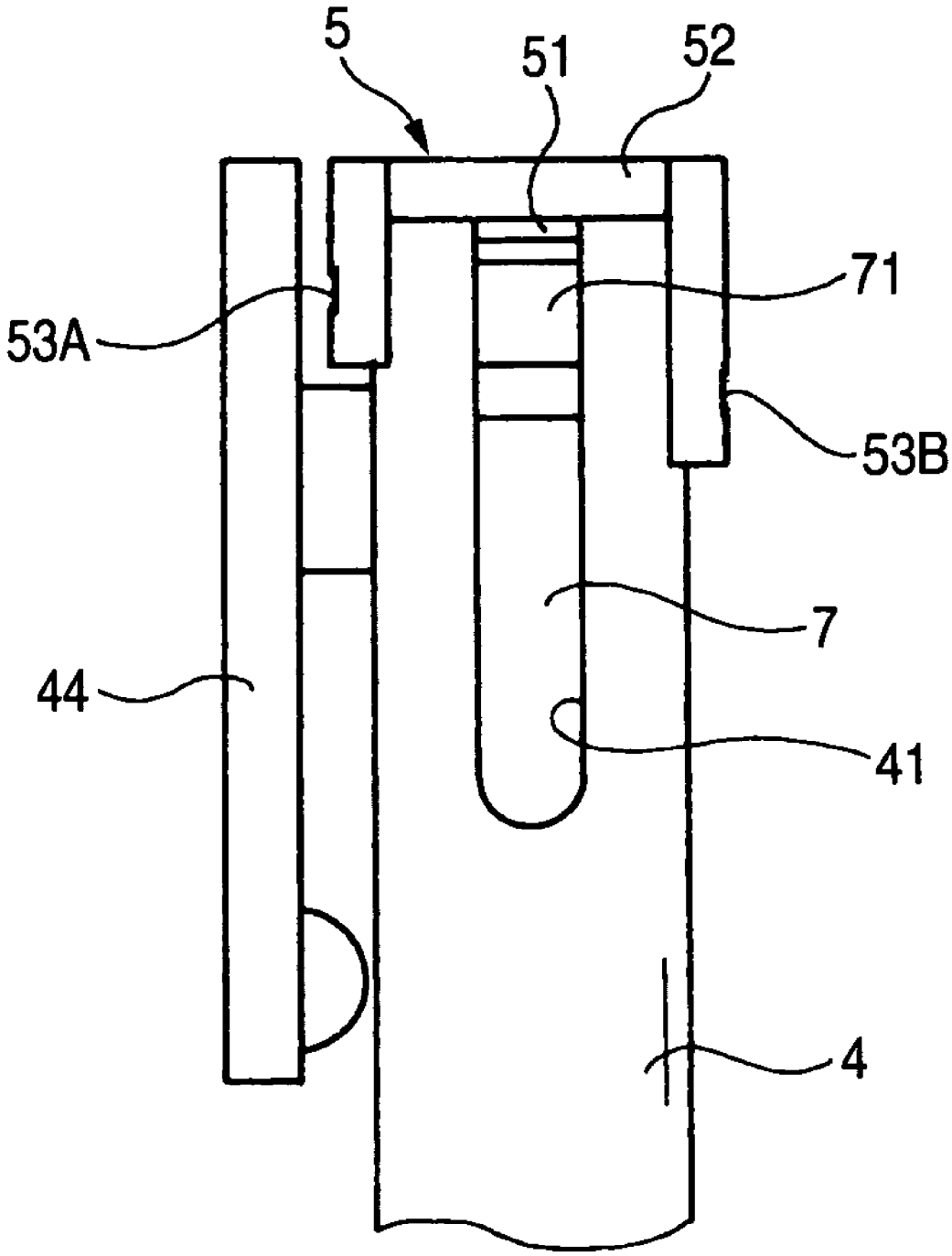
FIG. 24 is a side view illustrating a state in which a lid portion closes up a rear opening portion of the multi-refill writing instrument shown in FIG. 17.
Figure 25:
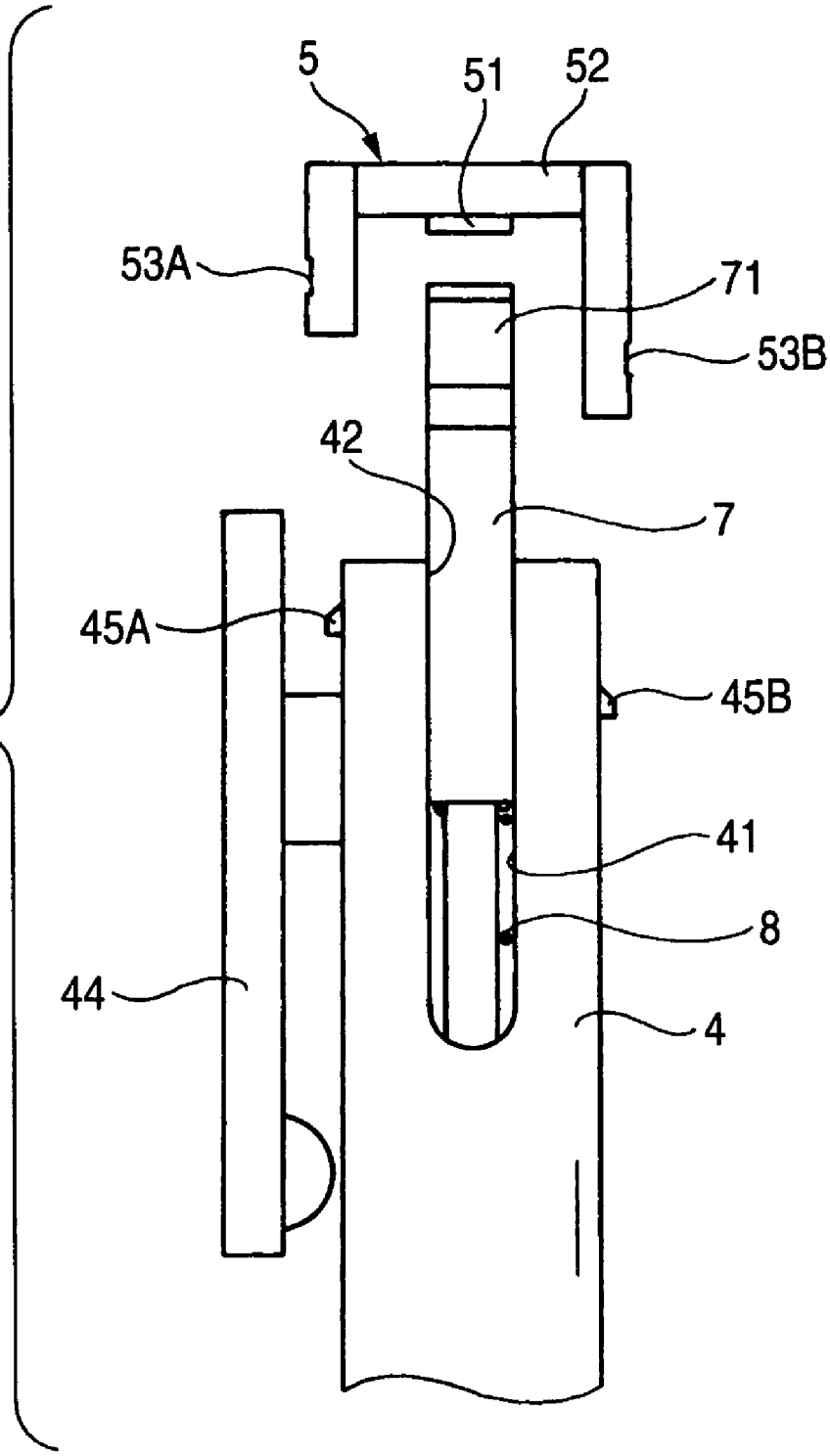
FIG. 25 is a side view illustrating a state in which the lid portion is separated from the rear opening portion of the multi-refill writing instrument shown in FIG. 17.
Figure 26:
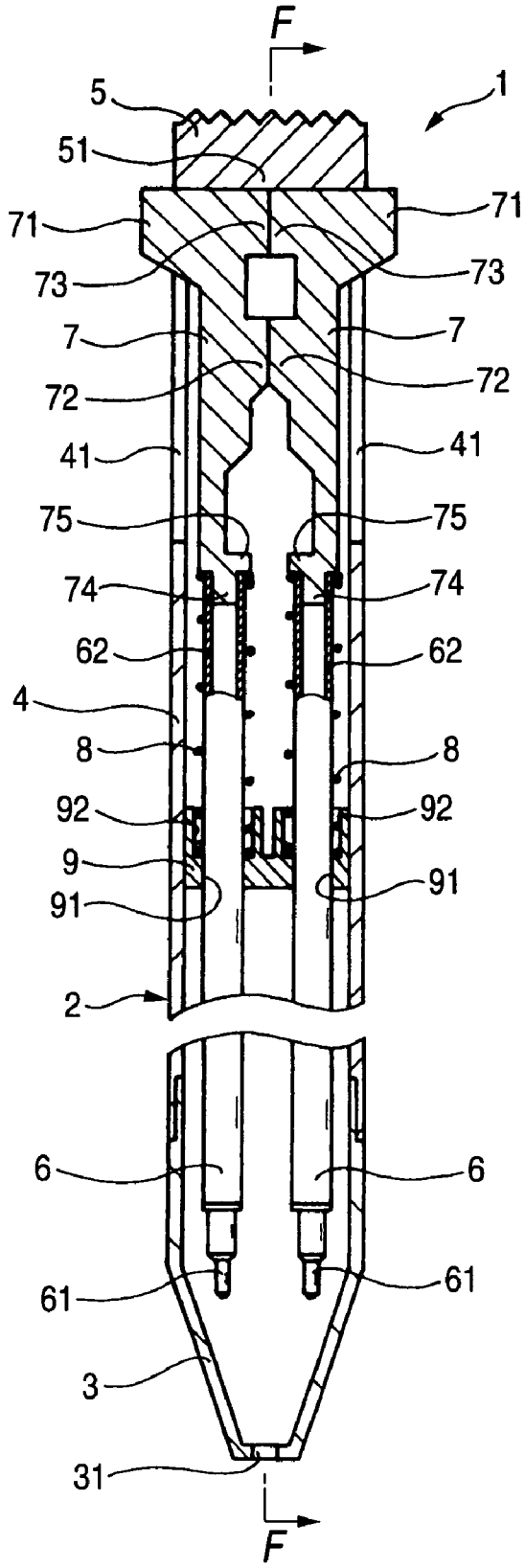
FIG. 26 is a longitudinal cross-sectional view illustrating a multi-refill writing instrument whose pen tips are in a retracted state (at the time of non-writing) according to a fifth embodiment of the invention.
Figure 27:
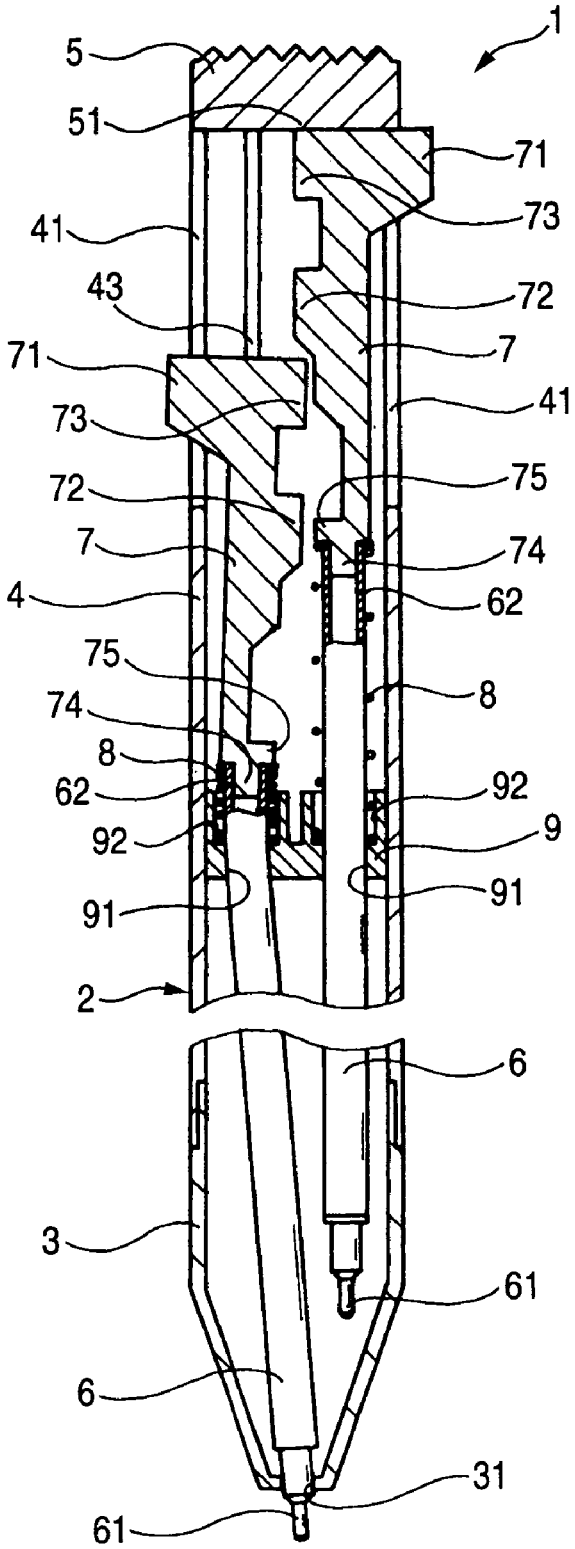
FIG. 27 is a longitudinal cross-sectional view illustrating the multi-refill writing instrument shown in FIG. 26 whose one pen tip is in a protruding state (at the time of writing)
Figure 28:
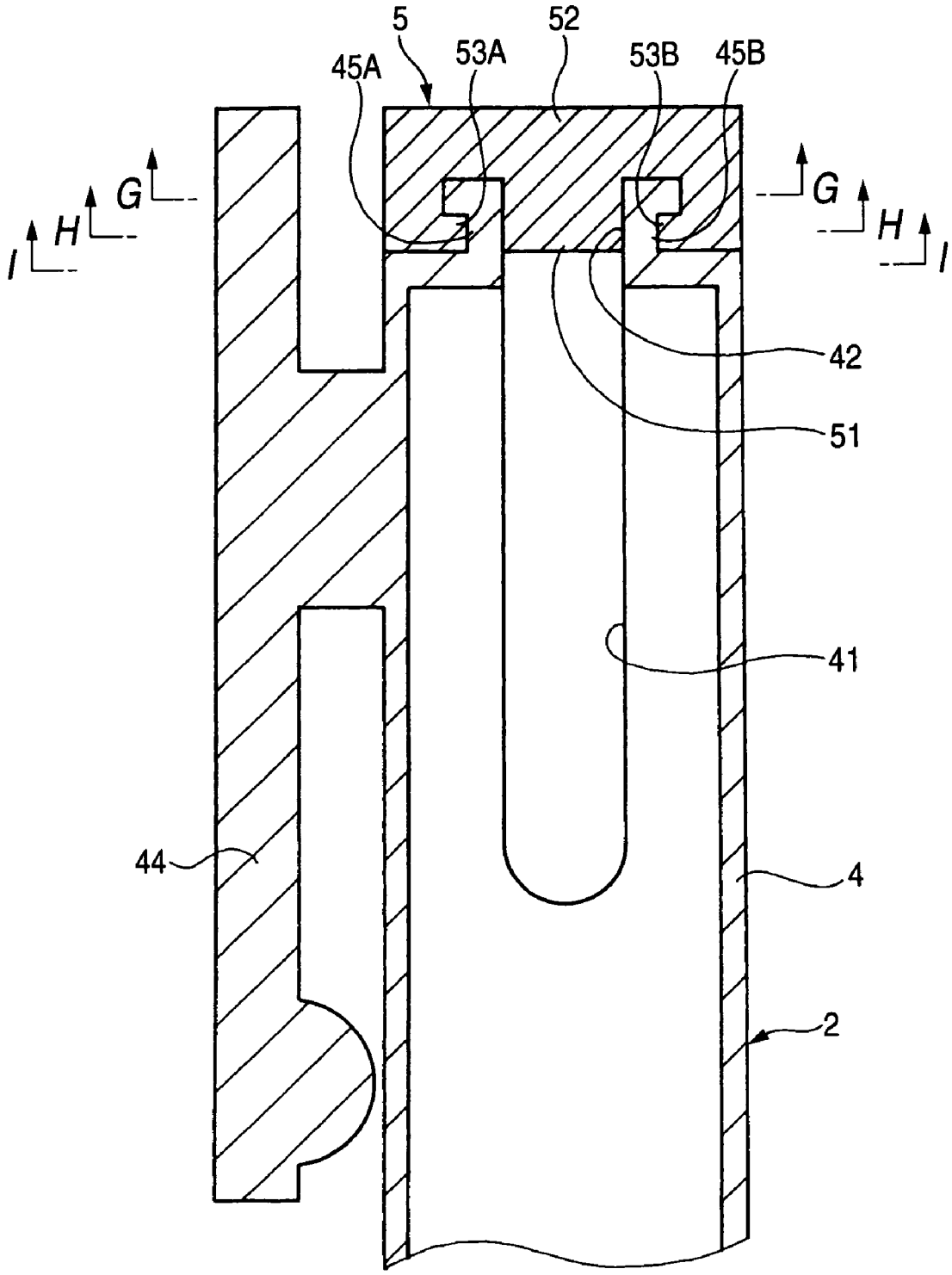
FIG. 28 is an enlarged cross-sectional view taken along the line F-F of FIG. 26, in which an operating body is omitted from the rear end of the multi-refill writing instrument.
Figure 29:
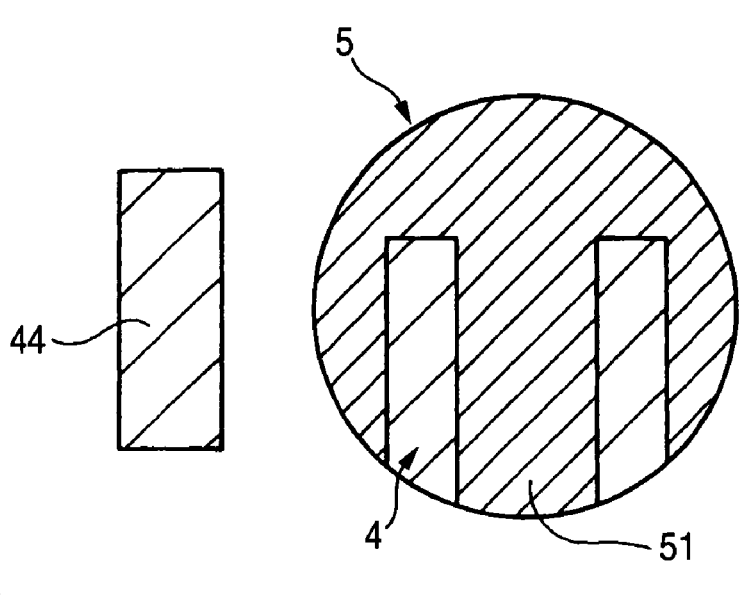
FIG. 29 is a cross-sectional view taken long the line G-G of FIG. 28.
Figure 30:
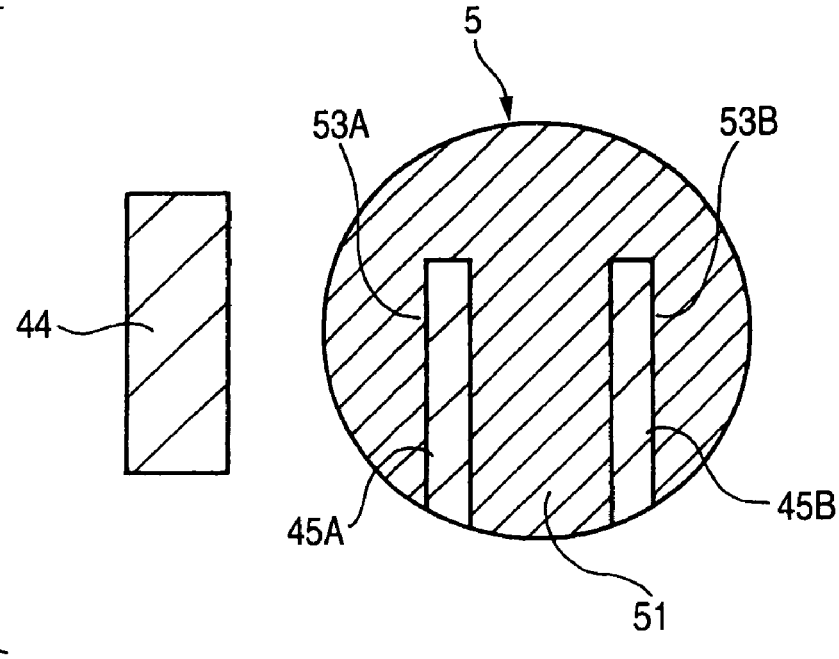
FIG. 30 is a cross-sectional view taken long the line H-H of FIG. 28.
Figure 31:
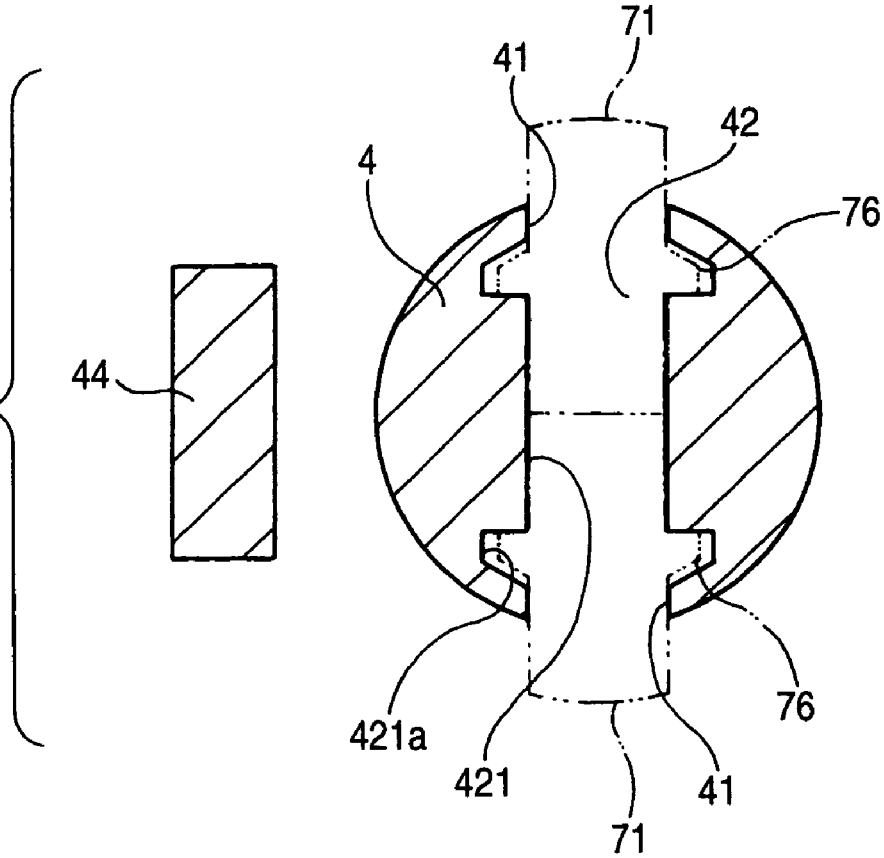
FIG. 31 is a cross-sectional view taken long the line I-I of FIG. 28.
Figure 32:
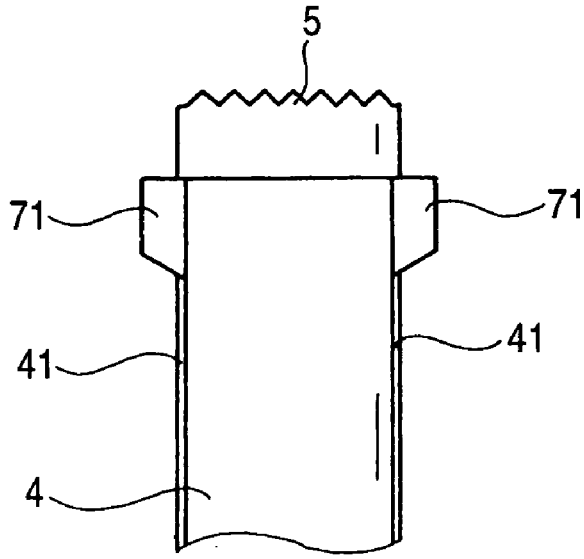
FIG. 32 is a side view illustrating a state in which a lid portion closes up a rear opening portion of the multi-refill writing instrument shown in FIG. 26.
Figure 33:
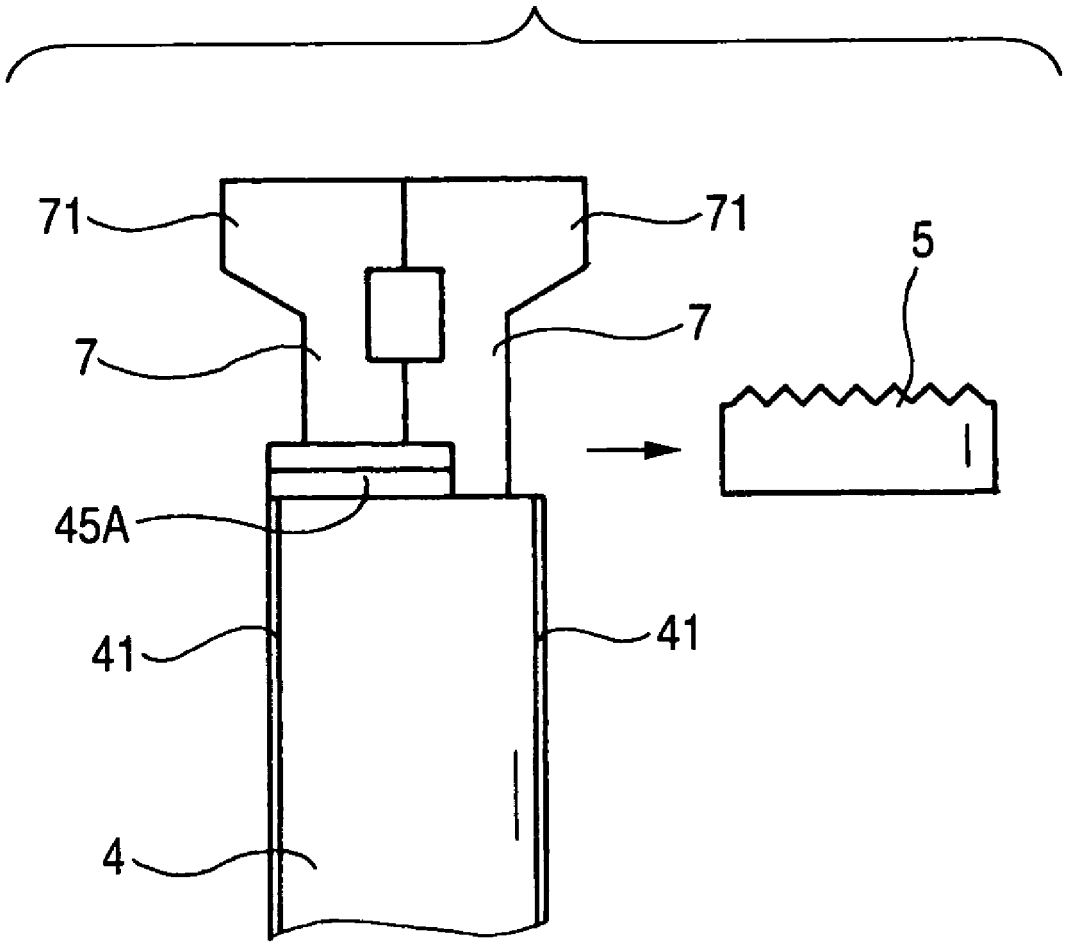
FIG. 33 is a side view illustrating a state in which the lid portion is separated from the rear opening portion of the multi-refill writing instrument shown in FIG. 26.
Figure 34:
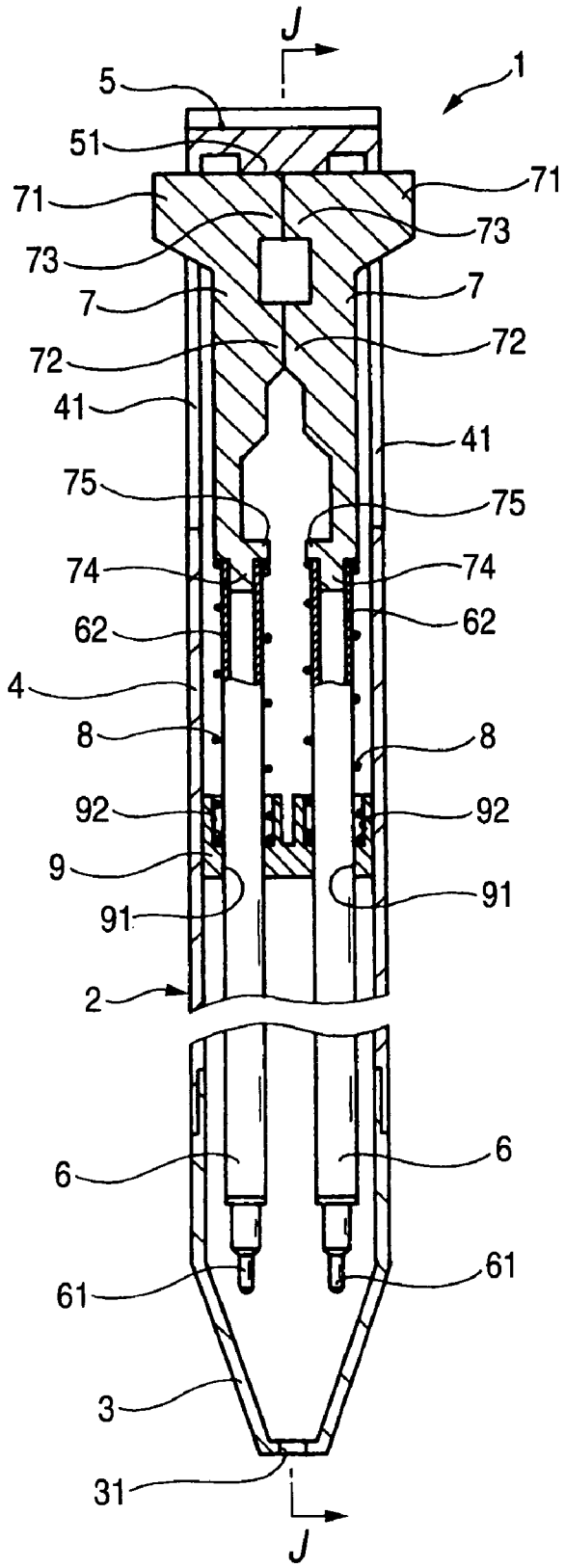
FIG. 34 is a longitudinal cross-sectional view illustrating a multi-refill writing instrument whose pen tips are in a retracted state (at the time of non-writing) according to a sixth embodiment of the invention.
Figure 35:
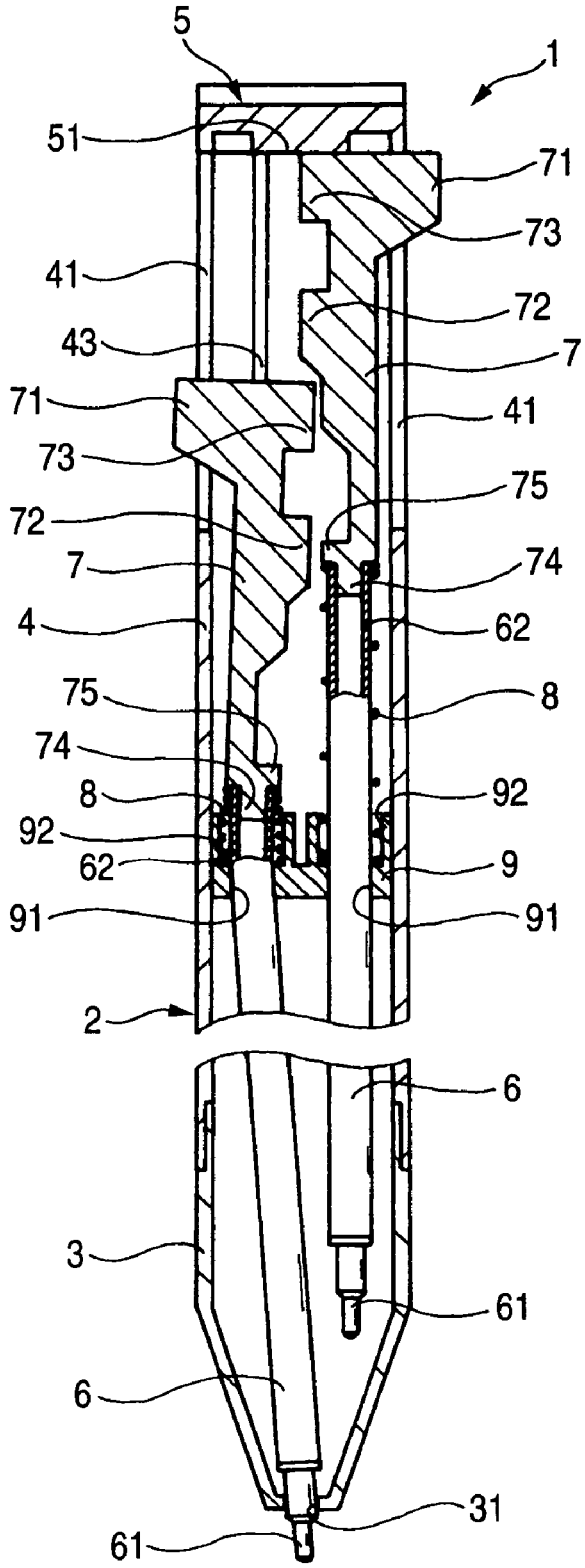
FIG. 35 is a longitudinal cross-sectional view illustrating the multi-refill writing instrument shown in FIG. 34 whose one pen tip is in a protruding state (at the time of writing)
Figure 36:
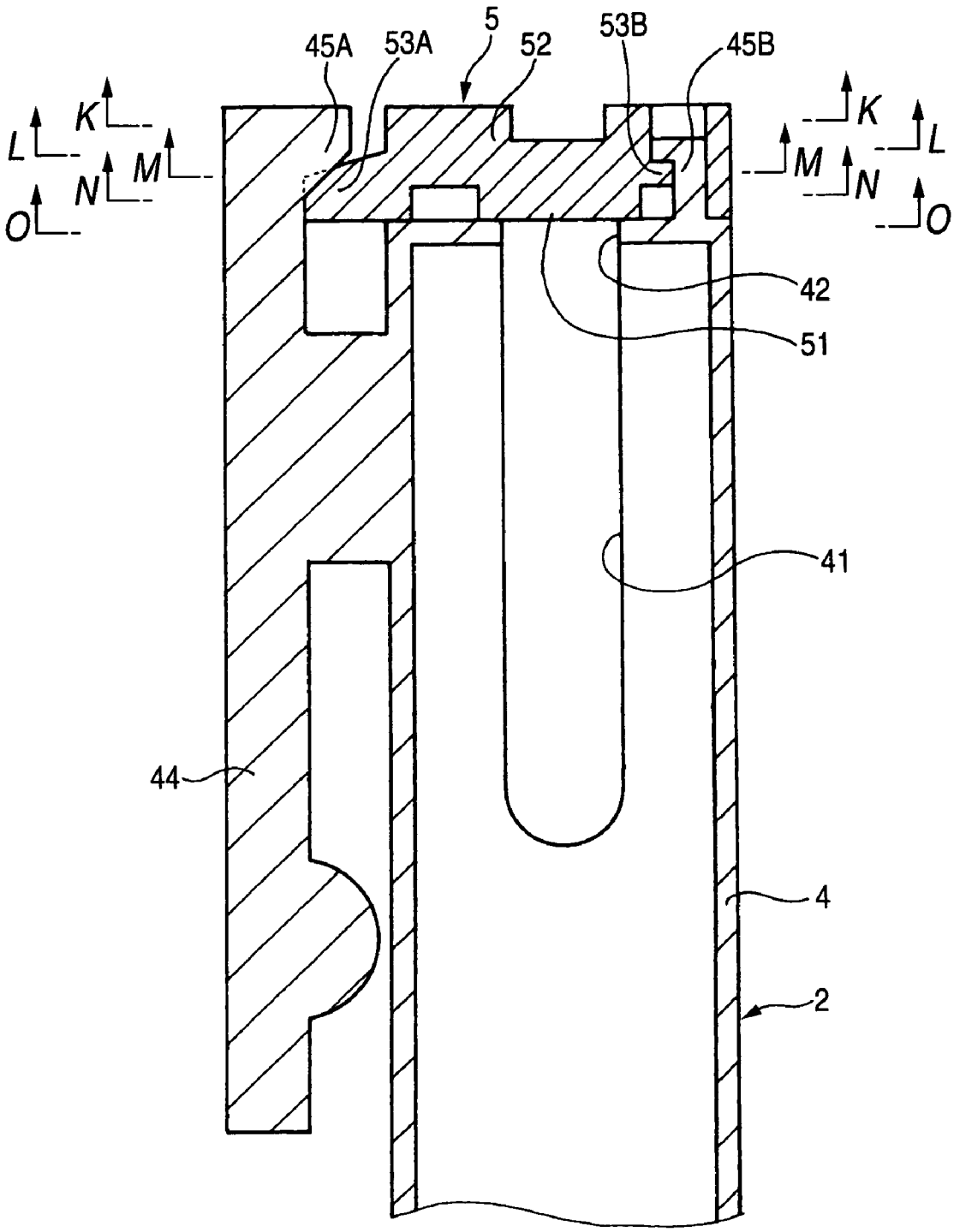
FIG. 36 is an enlarged cross-sectional view taken along the line J-J of FIG. 34, in which an operating body is omitted from the rear end of the multi-refill writing instrument.
Figure 37:
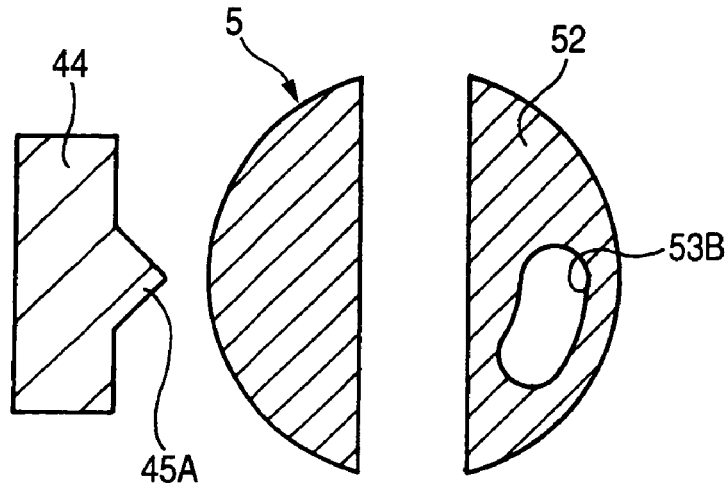
FIG. 37 is a cross-sectional view taken long the line K-K of FIG. 36.
Figure 38:
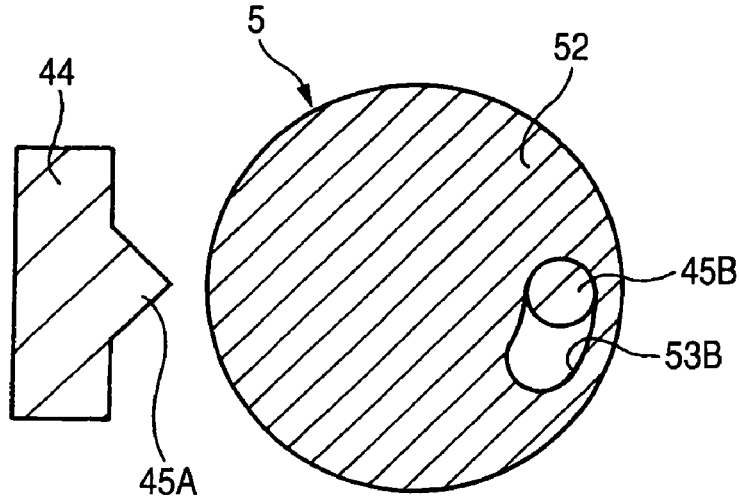
FIG. 38 is a cross-sectional view taken long the line L-L of FIG. 36.
Figure 39:
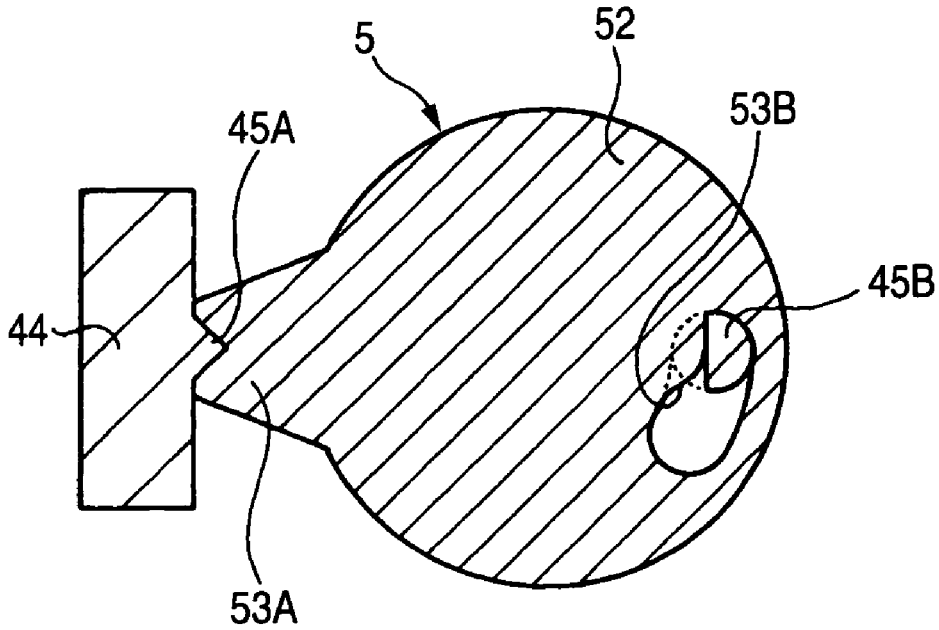
FIG. 39 is a cross-sectional view taken long the line M-M of FIG. 36.
Figure 40:
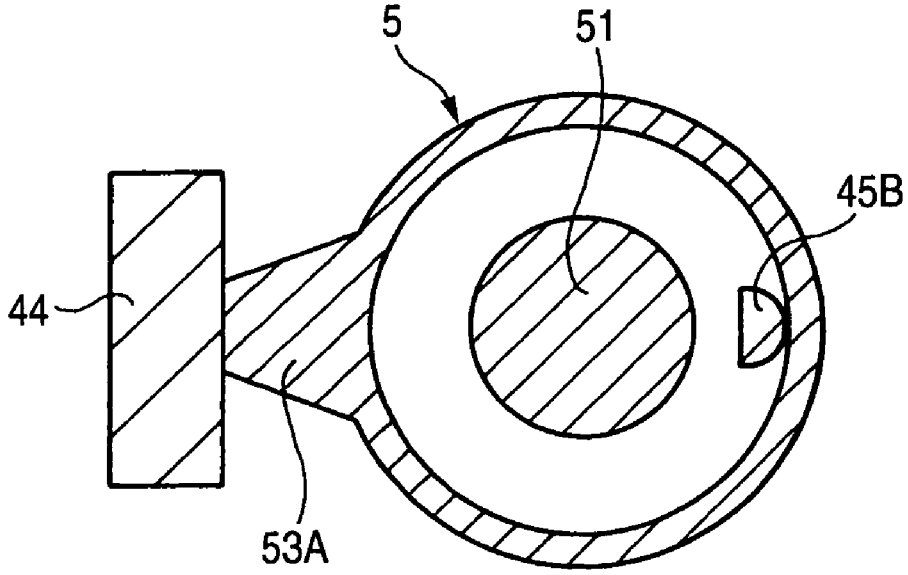
FIG. 40 is a cross-sectional view taken long the line N-N of FIG. 36.
Figure 41:
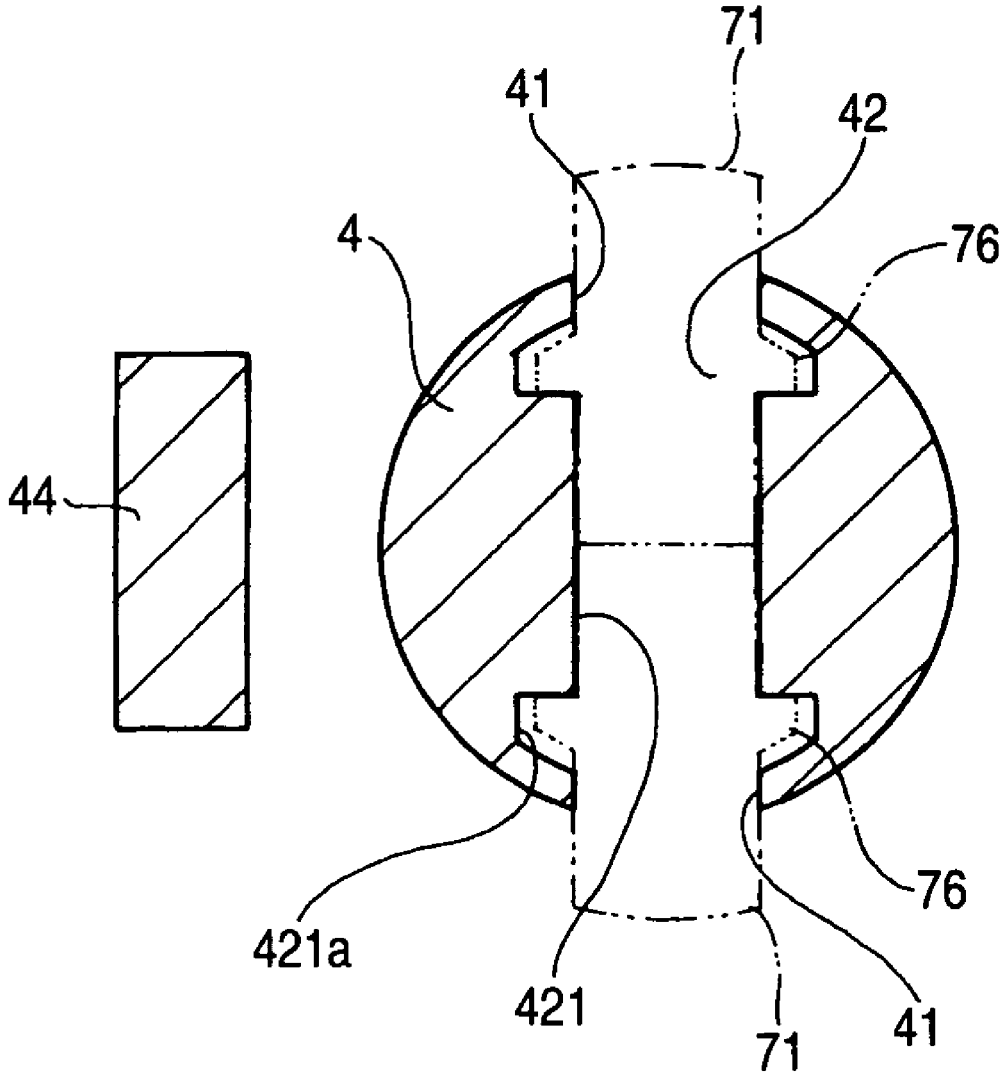
FIG. 41 is a cross-sectional view taken long the line O-O of FIG. 36.
Figure 42:
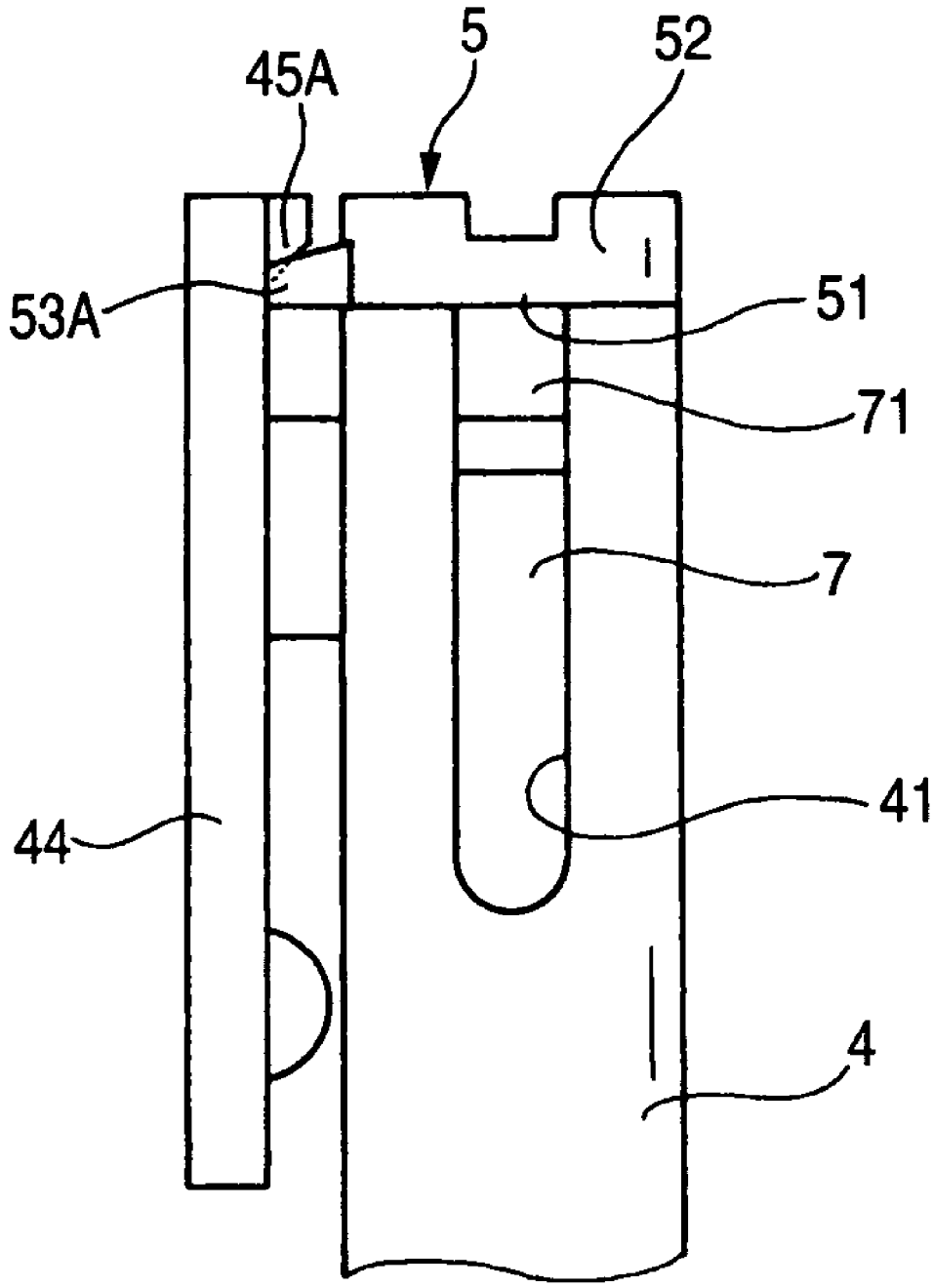
FIG. 42 is a side view illustrating a state in which a lid portion closes up a rear opening portion of the multi-refill writing instrument shown in FIG. 34.
Figure 43:
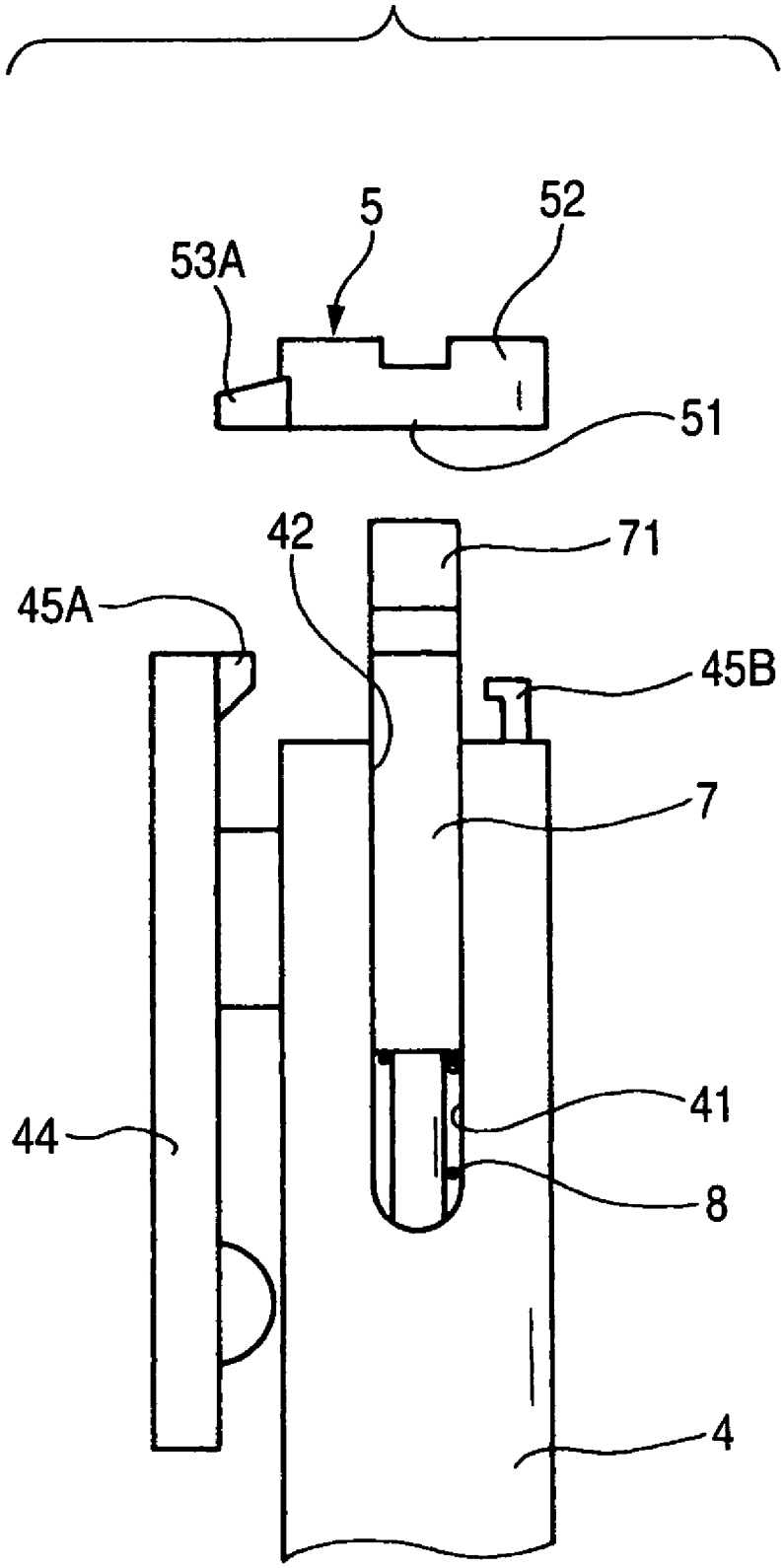
FIG. 43 is a side view illustrating a state in which the lid portion is separated from the rear opening portion of the multi-refill writing instrument shown in FIG. 34.
Figure 44:
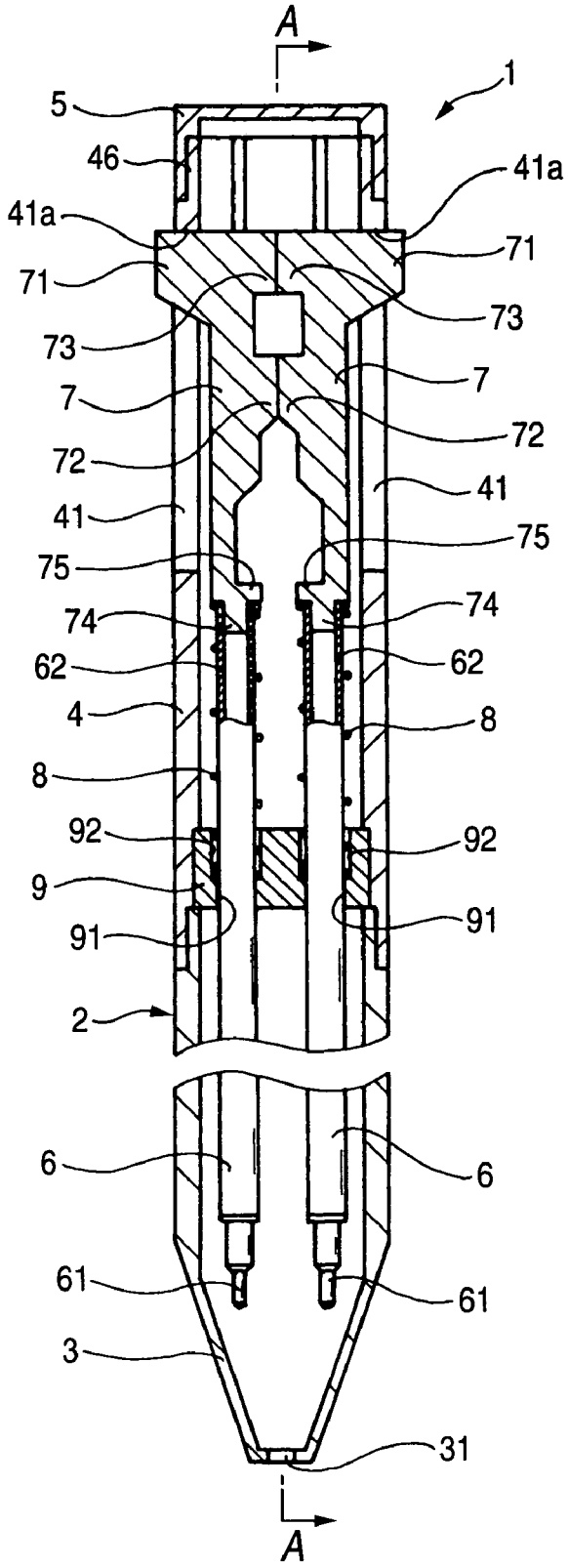
FIG. 44 is a longitudinal cross-sectional view illustrating a multi-refill writing instrument whose pen tips are in a retracted state (at the time of non-writing) according to a seventh embodiment of the invention.
Figure 45:
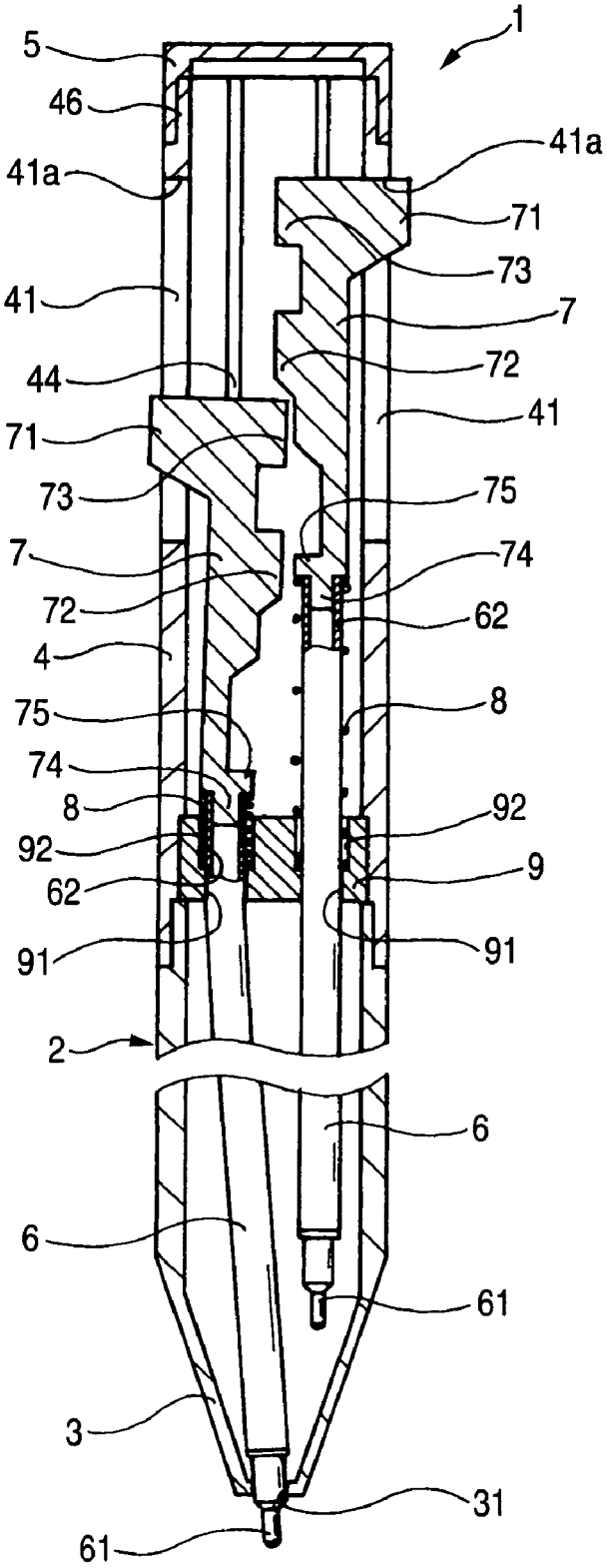
FIG. 45 is a longitudinal cross-sectional view illustrating the multi-refill writing instrument shown in FIG. 44 whose one pen tip is in a protruding state (at the time of writing)
Figure 46:
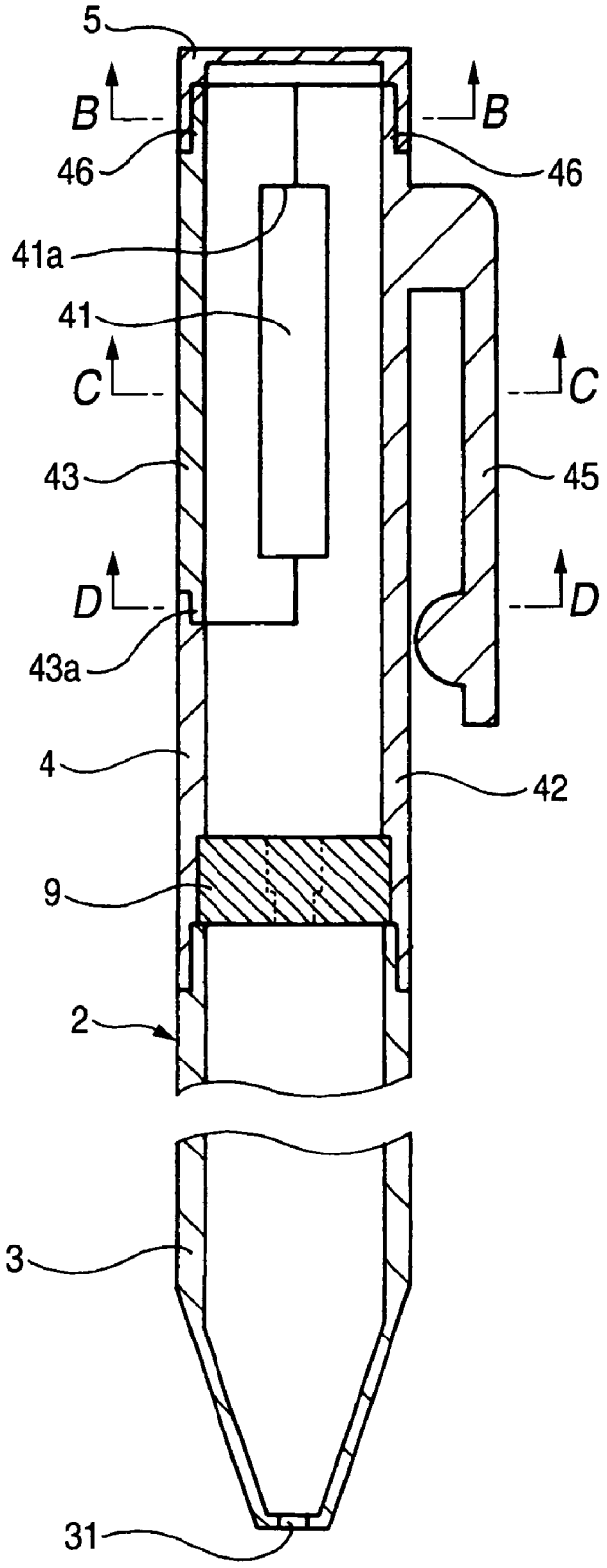
FIG. 46 is a cross-sectional view of the multi-refill writing instrument taken long the line A-A of FIG. 44 (however, writing bodies, operating bodies, elastic bodies, and locking wall portions are omitted)
Figure 47:
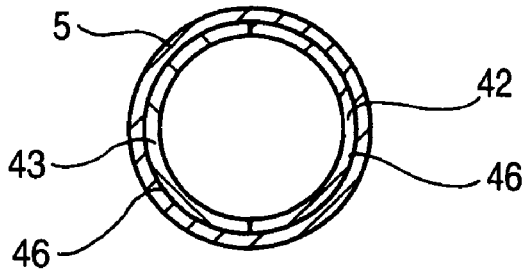
FIG. 47 is a cross-sectional view taken long the line B-B of FIG. 46.
Figure 48:
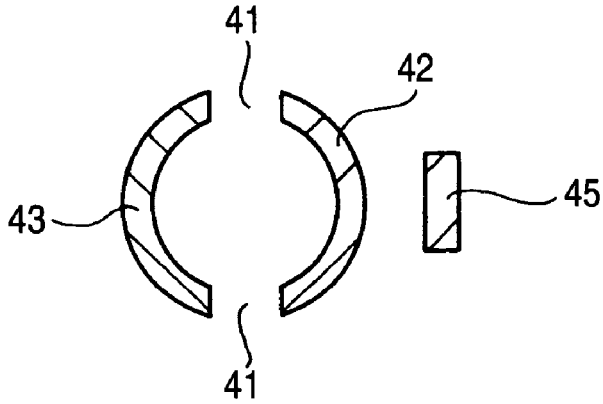
FIG. 48 is a cross-sectional view taken long the line C-C of FIG. 46.
Figure 49:
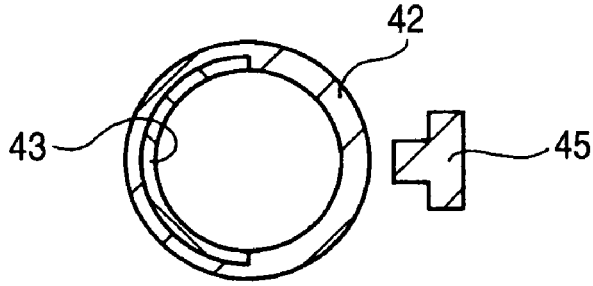
FIG. 49 is a cross-sectional view taken long the line D-D of FIG. 46.

FIG. 8 shows a second embodiment of the invention.

As shown in FIG. 8, in a multi-refill writing instrument of this embodiment, a clip is integrally formed to an end (an operating end portion) of a lid portion 5 opposite to a hinge portion 52. When the lid portion 5 is in a closed state, the tip of the clip faces forward. Therefore, the pivotal operation of the clip makes it possible to open or close the lid portion 5. The other structures of this embodiment are the same as those of the first embodiment, and thus a description thereof will be omitted.

Third Embodiment

A third embodiment of the invention is shown in FIGS. 9 to 16. A multi-refill writing instrument 1 according to this embodiment includes a barrel 2 and a plurality of writing bodies (for example, two writing bodies) 6 accommodated in the barrel 2 such that it can move back and forth. The writing bodies 6 are urged toward the rear side by elastic bodies 8 (specifically, compression coil springs).

(Barrel)

The barrel 2 includes a front barrel 3 composed of a tapered cylinder and a cylindrical rear barrel 4 that is screwed to the rear end of the front barrel 3 or is fitted thereinto by pressing. A front hole 31 is provided in the front end of the front barrel 3 in the axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two elongating window holes) 41 extending in the axial direction are provided in the radial direction in the side wall of the rear part of the rear barrel 4. The two window holes are formed so as to be symmetric with respect to an axis line. In addition, an opening portion 42 is formed in the rear end of the rear barrel 4 in the axial direction. The opening portion 42 communicates with the window holes 41 at the rear end of the rear barrel 4 (that is, the rear end of the barrel 2). In this way, the rear ends of the window holes 41 are cut out, so that the rear ends of the window holes 41 are opened.

The side wall of the rear end of the rear barrel 4 (the rear end of the barrel 2) is divided in the radial direction by the window holes 41 having opened rear ends. In addition, a male screw portion 45 is formed on the outer peripheral surface of the side wall of the rear end of the rear barrel 4.

Guide portions 421 are formed on both inner walls of the front end of the opening portion 42. When an operating body 7 is inserted, the guide portion 421 slides on the side surface of the operating body 7 to regulate the direction in which the side surface of the operating body 7 is oriented. In addition, concave portions 421*a* into which retaining projections 76 of the operating body 7 can be inserted are formed in each guide portion 421.

Locking wall portions 43 composed of ribs each extending in the axial direction are formed on the inner surfaces of the side walls between the window portions 41 of the rear barrel 4. When the nib 61 protrudes from the barrel, the rear end of the operating body 7 of the writing body 6 is locked to the locking wall portion 43.

A clip 44 is provided on the outer surface of the side wall of the rear barrel 4 between the window holes 41.

(Lid Portion)

An openable lid portion 5 that closes the opening portion 42 is detachably screwed to the rear end of the rear barrel 4. The lid portion 5 is composed of a cylinder portion 53 whose front end is opened and a core portion 52 integrally connected to the inner surface of the cylindrical portion 53 (more specifically, the inner peripheral surface of the rear end of the cylindrical portion 53). A female screw portion 54 is formed on the inner peripheral surface of the cylindrical portion 53. The female screw portion 54 of the cylindrical portion 53 engages with the male screw portion 45 of the rear end of the rear barrel 4.

The front end of the core portion 52 has a cylinder shape, and serves as an abutting wall portion 51 which is inserted into the guide portion 421 when the lid portion 5 is screwed to the rear end of the tear barrel 4 (that is, the female screw portion 54 of the cylindrical portion 53 engages with the male screw portion 45 of the rear end of the rear barrel 4) and comes in contact with the rear ends of the operating bodies 7 connected to the rear ends of the writing bodies 6 in a retracted state. In addition, when the cylindrical portion 53 of the lid portion 5 is screwed to the rear end of the rear barrel 4, the outer peripheral surface of the rear end of the core portion 52 comes into pressure contact with the inner surface of the rear end of the rear barrel 4 having the male screw portion 45 on the outer peripheral surface thereof. In this way, when the cylindrical portion 53 of the lid portion 5 is screwed to the rear end of the rear barrel 4, it is possible to prevent the rear end of the rear barrel 4 which is divided in the radial direction by the window holes 41 whose rear ends are opened from being deformed inward in the radial direction.

(Writing Body)

The writing bodies 6 are ballpoint pen refills, and each of the writing bodies 6 is composed of a ballpoint pen tip (that is, the nib 61) holding a ball rotatably in a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 62.

In the ballpoint pen tip, the ball rotatably held in the leading end thereof may be urged forward by, for example, an elastic member so as to come in close contact with an inner surface of the leading end. In addition, the ballpoint pen tip may be directly fitted to a front opening of the ink containing tube 62 by pressing. Note that, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, the rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, the retaining projections 76 are formed on both side walls of the operating body 7. The retaining projections 76 can be engaged with the inner surfaces of both side walls of the window holes 41.

When the nib 61 of the writing body 6 is in a retracted state, the rear end of the operating body 7 mounted to the writing body 6 comes in contact with the abutting wall portion 51 formed on the front surface of the lid portion 5. On the other hand, when the nib 61 of the writing body 6 protrudes from the barrel, the rear end of the operating body 7 mounted to the writing body 6 is locked to a locking wall portion 43 formed on the inner wall of the barrel 2.

When the operating portion 71 of the operating body 7 is operated to slide forward, the front protruding portion 72 of the operating body 7 connected to the rear end of the writing body 6 whose nib is in the retracted state comes in contact with the rear protruding portion 73 of the operating body 7 connected to another writing body 6 whose nib protrudes from the barrel, which causes the protruding state of the nib of another writing body 6 to be released.

(Discriminating Marks)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other-by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

In particular, when the ink containing tubes 62 are formed of an opaque material, or when the ink containing tubes 62 are formed of a transparent material and dye ink is contained in the ink containing tubes, it is difficult to discriminate the colors of the contained ink from the outside. However, in this embodiment, since the operating bodies 7 have substantially the same colors as those of the ink contained in the writing bodies, it is possible to easily discriminate the colors of ink contained in the writing bodies 6 for replacement, which exists outside the barrel 2, from the outside.

(Elastic Body Supporting Portion)

An elastic body supporting portion 9 having a cylindrical shape is provided on the inner wall of the barrel 2 (that is, the inner wall of the rear barrel 4). A plurality of holes (for example, two holes) 91 through which the writing bodies 6 pass are formed in the elastic body supporting portion 9 in the axial direction. The elastic bodies 8 are arranged between the rear surface of the elastic body supporting portion 9 and the front surface of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies 8 are locked to the front surfaces of the flange portions 75 of the operating bodies 7.

Holding portions 92, each composed of a cylindrical protruding portion that projects backward, are formed in the rear surface of the elastic body supporting portion 9 in the peripheries of the holes 91. The outer surfaces of the front end portions of the elastic bodies 8 are pressed against and are held by the inner surfaces of the holding portions 92. In this way, when the writing bodies 6 and the operating bodies 7 are replaced, it is possible to prevent the elastic bodies 8 from falling off from the barrel 2 through the opening portion 42.

The elastic bodies 8 always urge the corresponding operating bodies 7 (that is, the writing bodies 6) backward. The elastic bodies 8 are compressed when the nibs of the writing bodies are retracted and when they protrude from the barrel (that is, the writing bodies 6 are urged toward the rear side), which makes it possible to the operating bodies 7 from being rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating body 7 of another writing body 6 whose nib is in the protruding state outward in the radial direction. As a result, locking between the operating body 7 and the locking wall portion 43 of the barrel 2 is released, so that another writing body 6 is moved backward by the urging force of the elastic body 8, and the nib 61 of another writing body 6 is retracted into the barrel 2, causing the rear end of the operating body 7 of another writing body 6 to come in contact with the abutting wall portion 51 of the front surface of the lid portion 5. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 43 formed on the inner wall of the barrel 2, thereby keeping the protruding state of the nib.

(Replacement of Writing Body and Operating Body)

Next, the replacement of the writing bodies 6 and the operating bodies 7 according to this embodiment will be described below.

In order to replace the writing bodies 6, in a state in which the lid portion 5 closes up the rear opening portion 42 of the barrel 2 (see FIG. 15), the engagement between the female screw portion 54 of the lid portion 5 and the male screw portion 45 provided at the rear end of the barrel 2 is released to separate the lid portion 5 from the rear end of the barrel 2, thereby exposing the opening portion 42 provided at the rear end of the barrel 2. When the opening portion 42 is opened, the operating bodies 7 protrude backward through the opening portion 42 by the urging force of the elastic bodies 8. When the operating bodies 7 are pulled out from the rear end of the barrel 2 through the opening portion 42 (see FIG. 16), the writing bodies 6 connected to the operating bodies 7 are also pulled out from the barrel 2 through the opening portion 42. Then, new writing bodies 6 and new operating bodies 7 connected to each other are inserted into the barrel 2 through the opening portion 42. Subsequently, the lid portion 5 is screwed to the rear end of the barrel 2 so that the operating bodies 7 are pressed forward, with the rear ends of the operating bodies 7 coming in contact with the abutting wall portion 51 of the lid portion 5, thereby closing up the opening portion 42. In this way, the replacement of the writing bodies 6 and the operating bodies 7 is completed.

Fourth Embodiment

A fourth embodiment of the invention is shown in FIGS. 17 to 25. A multi-refill writing instrument 1 according to this embodiment includes a barrel 2 and a plurality of writing bodies (for example, two writing bodies) 6 accommodated in the barrel 2 such that it can move backward and forward. The writing bodies 6 are urged toward the rear side by elastic bodies 8 (specifically, compression coil springs).

(Barrel)

The barrel 2 includes a front barrel 3 composed of a tapered cylinder and a cylindrical rear barrel 4 that is screwed to the rear end of the front barrel 3 or is fitted thereinto by pressing. A front hole 31 is provided in the front end of the front barrel 3 in the axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two elongating window holes) 41 extending in the axial direction are provided in the side wall of the rear part of the rear barrel 4 in the radial direction. The two window holes 41 are formed so as to be symmetric with respect to an axis line. In addition, an opening portion 42 is formed in the rear end of the rear barrel 4 in the axial direction. The opening portion 42 communicates with the window holes 41 at the rear end of the rear barrel 4 (that is, the rear end of the barrel 2). In this way, the rear ends of the window holes 41 are opened. Meanwhile, the front ends of the window holes 41 are always closed.

The side wall of the rear end of the rear barrel 4 (the rear end of the barrel 2) is divided into two parts in the radial direction by the two window holes 41 whose rear ends are opened. In addition, engaged portions 45A and 45B, which are composed of projections, are integrally formed on the outer peripheral surfaces of two side wall portions of the rear barrel 4 divided at the rear end thereof, respectively. The two engaged portions 45A and 45B are formed so as to be symmetric with respect to-an axis line.

Guide portions 421 are formed on both inner walls of the opening portion 42 to regulate the direction in which the side surfaces of the operating bodies 7 are oriented when the operating bodies 7 are inserted. In addition, concave portions 421*a* into which retaining projections 76 of the operating body 7 can be inserted are formed in each guide portion 421.

Locking wall portions 43 composed of ribs each extending in the axial direction are formed on the inner surfaces of the side walls between the window portions 41 of the rear barrel 4. When the nib 61 protrudes from the barrel, the rear end of the operating body 7 of the writing body 6 is locked to the locking wall portion 43.

A clip 44 is provided on the outer surface of the side wall of the rear barrel 4 between the window holes 41. The engaged portion 45A is provided right behind of the rear side of the base of the clip 44 provided on the outer surface of the side wall of the rear barrel 4, and the engaged portion 45B is provided on the outer surface of the side wall of the rear barrel 4 at a position that is symmetric with the position of the engaged portion 45 with respect to an axis line (that is, the engaged portion 45B is provided on the opposite side of the clip 44 in the radial direction).

(Lid Portion)

An openable lid portion 5 that closes the opening portion 42 is detachably engaged with the rear end of the rear barrel 4 in the axial direction. The lid portion 5 includes a disk-shaped main body 52, two leg portions protruding from the main body 52 forward, and an abutting wall portion 51 composed of a convex portion that is formed in the center of the main body 52 to protrude forward. The lid portion 5 is formed by injection-molding a synthetic resin (for example, polycarbonate).

Further, engaging holes (that is, engaging portions 53A and 53B) are respectively formed in the leg portions in the radial direction. The two engaging portions 53A and 53B can be respectively engaged with the two engaged portions 45A and 45B provided on the outer surface of the side wall at the rear end of the rear barrel 4. However, in this embodiment, the two leg portions are different from each other in length in the axial direction. That is, the length of the leg portion close to the clip in the axial direction is smaller than that of the leg portion on the opposite side of the clip. However, the lengths of the two leg portions in the axial direction may be equal to each other. In addition, the engaging holes may not be formed in the radial direction. For example, instead of the engaging holes, concave portions may be formed in the inner surfaces of the leg portions in the radial direction.

When the lid portion 5 is attached to the rear end of the rear barrel 4 (that is, the engaging portions 53A and 53B are engaged with the engaged portions 45A and 45B), the abutting wall portion 51 is inserted into the guide portion 421, and comes in contact with the rear ends of the operating bodies 7 connected to the rear ends of the writing bodies 6 in a retracted state. In addition, when the lid portion 5 is attached to the rear end of the rear barrel 4, the outer peripheral surface of the abutting wall portion 51 comes in pressure contact with the inner wall of the opening portion 42 (the guide portion 421). In this way, when the engaging portions 53A and 53B of the lid portion 5 are engaged with the engaged portions 45A and 45B provided on the outer surface of the rear end of the rear barrel 4, it is possible to prevent the rear end of the rear barrel 4 which is divided into two parts in the radial direction by the window holes 41 whose rear ends are opened from being deformed inward in the radial direction.

(Writing Body)

The writing bodies 6 are ballpoint pen refills, and each of the writing bodies 6 is composed of a ballpoint pen tip (that is, the nib 61) holding a ball rotatably at a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 62.

In the ballpoint pen tip, the ball rotatably held in the leading end thereof may be urged forward by, for example, an elastic member so as to come in close contact with an inner surface of the leading end. In addition, the ballpoint pen tip may be directly fitted to a front opening of the ink containing tube 62 by pressing. However, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, the retaining projections 76 are formed on both side walls of the operating body 7. The retaining projections 76 can be engaged with the inner surfaces of both side walls of the window holes 41.

When the nib 61 of the writing body 6 is in a retracted state, the rear end of the operating body 7 mounted to the writing body 6 comes in contact with the abutting wall portion 51 formed on the front surface of the lid portion 5. On the other hand, when the nib 61 of the writing body 6 protrudes from the barrel, the rear end of the operating body 7 mounted to the writing body 6 is locked to the locking wall portion 43 formed on the inner wall of the barrel 2.

When the operating portion 71 of the operating body 7 is operated to slide forward, the front protruding portion 72 of the operating body 7 connected to the rear end of the writing body 6 whose nib is in the retracted state comes in contact with the rear protruding portion 73 of the operating body 7 connected to another writing body 6 whose nib protrudes from the barrel, which causes the protruding state of the nib of another writing body 6 to be released.

(Discriminating Mark)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

In particular, when the ink containing tubes 62 are formed of an opaque material, or when the ink containing tubes 62 are formed of a transparent material and dye ink is contained in the ink containing tubes, it is difficult to discriminate the colors of the contained ink from the outside. However, in this embodiment, since the operating bodies 7 have substantially the same colors as those of the ink contained in the writing bodies, it is possible to easily discriminate the colors of ink contained in the writing bodies 6 for replacement, which exists outside the barrel 2, from the outside.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

(Elastic Body Supporting Portion)

An elastic body supporting portion 9 having a cylindrical shape is provided on the inner wall of the barrel 2 (that is, the inner wall of the rear barrel 4). A plurality of holes (for example, two holes) 91, through which the writing bodies 6 pass, are formed in the elastic body supporting portion 9 in the axial direction. The elastic bodies 8 are arranged between the rear surface of the elastic body supporting portion 9 and the front surfaces of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies,8 are locked to the front surfaces of the flange portions 75 of the operating bodies 7.

Holding portions 92, each composed of a cylindrical protruding portion that projects backward, are formed in the rear surface of the elastic body supporting portion 9 in the peripheries of the holes 91. The inner surfaces of the holding portions 92 hold the outer surfaces of the front end portions of the elastic bodies 8. In this way, when the writing bodies 6 and the operating bodies 7 are replaced, it is possible to prevent the elastic bodies 8 from falling off from the barrel 2 through the opening portion 42.

The elastic bodies 8 always urge the corresponding operating bodies 7 (that is, the writing bodies 6) backward. The elastic bodies 8 are compressed when the nibs of the writing bodies are retracted and when they protrude from the barrel (that is, the writing bodies 6 are urged toward the rear side), which makes it possible to the operating bodies 7 from being rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating body 7 of another writing body 6 whose nib is in the protruding state outward in the radial direction. Then, locking between the operating body 7 and the locking wall portion 43 of the barrel 2 is released, so that another writing body 6 is moved backward by the urging force of the elastic body 8, and the nib 61 of another writing body 6 is retracted into the barrel 2, causing the rear end of the operating body 7 of another writing body 6 to come in contact with the abutting wall portion 51 provided on the front surface of the lid portion 5. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 43 formed on the inner wall of the barrel 2, thereby keeping the protruding state of the nib.

(Replacement of Writing Body and Operating Body)

Next, the replacement of the writing bodies 6 and the operating bodies 7 according to this embodiment will be described below.

In order to replace the writing bodies 6, in a state in which the lid portion 5 closes up the rear opening portion 42 of the barrel 2 (see FIG. 24), the engagement between the engaging portions 53A and 53B of the lid portion 5 and the engaged portions 45A and 45B provided at the rear end of the barrel 2 is released to separate the lid portion 5 from the rear end of the barrel 2, thereby exposing the rear opening portion 42 of the barrel 2. When the opening portion 42 is opened, the operating bodies 7 protrude backward through the opening portion 42 by the urging force of the elastic bodies 8. When the operating bodies 7 are pulled out from the rear end of the barrel 2 through the opening portion 42 (see FIG. 25), the writing bodies 6 connected to the operating bodies 7 are also pulled out from the barrel 2 through the opening portion 42. Then, new writing bodies 6 and new operating bodies 7 connected to each other are inserted into the barrel 2 through the opening portion 42. Subsequently, the two engaging portions 53A and 53B of the lid portion 5 are engaged with the two engaged portions 45A and 45B of the barrel 2 in the axial direction so that the abutting wall portion 51 of the lid portion 5 come in contact with the operating bodes 7 while pressing the operating bodies 7, thereby closing the opening portion 42 at the rear end of the barrel 2 with the lid portion 5. In this way, the replacement of the writing bodies 6 and the operating bodies 7 is completed.

Fifth Embodiment

A fifth embodiment of the invention is shown in FIGS. 26 to 33. A multi-refill writing instrument 1 according to this embodiment includes a barrel 2 and a plurality of writing bodies (for example, two writing bodies) 6 accommodated in the barrel 2 such that it can move back and forth. The writing bodies 6 are urged toward the rear side by elastic bodies 8 (specifically, compression coil springs).

(Barrel)

The barrel 2 includes a front barrel 3 composed of a tapered cylinder and a cylindrical rear barrel 4 that is screwed to the rear end of the front barrel 3 or is fitted thereinto by pressing. A front hole 31 is provided in the front end of the front barrel 3 in the axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two elongating window holes) 41 extending in the axial direction are provided in the side wall of the rear part of the rear barrel 4 in the radial direction. The two window holes 41 are formed so as to be symmetric with respect to an axis line. In addition, an opening portion 42 is formed in the rear end of the rear barrel 4 in the axial direction. The opening portion 42 communicates with the window holes 41 at the rear end of the rear barrel 4 (that is, the rear end of the barrel 2). In this way, the rear ends of the window holes 41 are cut out, so that the rear ends of the window holes 41 are opened. Meanwhile, the front ends of the window holes 41 are always closed.

The side wall of the rear end of the rear barrel 4 (the rear end of the barrel 2) is divided in the radial direction by the two window holes 41 whose rear ends are opened. In addition, two ridge portions extending in the radial direction in parallel to each other are integrally formed with the divided rear end parts of the rear barrel 4 at both sides of the opening portion 42. Engaging grooves (that is, engaged portions 45A and 45B) are formed in the outer surfaces of the two ridge portions in the same direction as the extending direction of the ridge portions extend.

Guide portions 421 are formed on both inner walls of the opening portion 42 to regulate the direction in which the side surfaces of the operating bodies 7 are oriented when the operating bodies 7 are inserted. In addition, concave portions 421*a* into which retaining projections 76 of the operating body 7 can be inserted are formed in each guide portion 421.

Locking wall portions 43 composed of ribs each extending in the axial direction are formed on the inner surfaces of the side walls between the window portions 41 of the rear barrel 4. When the nib 61 protrudes from the barrel, the rear end of the operating body 7 of the writing body 6 is locked to the locking wall portion 43.

A clip 44 is provided on the outer surface of the side wall of the rear barrel 4 between the window holes 41. The engaged portion 45A is provided right behind of the rear side of the base of the clip 44 provided on the outer surface of the side wall of the rear barrel 4, and the engaged portion 45B is provided on the outer surface of the side wall of the rear barrel 4 at a position that is symmetric with the position of the engaged portion 45A with respect to an axis line (that is, the engaged portion 45B is provided on the opposite side of the clip 44 in the radial direction).

(Lid Portion)

An openable lid portion 5 that closes the opening portion 42 is detachably engaged with the rear end of the rear barrel 4 in the radial direction in a sliding manner. The lid portion 5 includes a disk-shaped main body 52, two leg portions protruding from the main body 52 forward, and an abutting wall portion 51 composed of a convex portion that is formed in the center of the main body 52 to protrude forward. The lid portion 5 is formed by injection-molding a synthetic resin (for example, polycarbonate).

Further, ridge portions (that is, engaging portions 53A and 53B) extending in the radial direction are respectively formed in the inner surfaces of the leg portions. The two engaging portions 53A and 53B composed of the ridge portions are slidably engaged with the two engaged portions 45A and 45B provided on the rear end surface of the rear barrel 4, which are composed of the engaging grooves, in a direction perpendicular to the axis line (that is, in the radial direction).

When the lid portion 5 is attached to the rear end of the rear barrel 4 (that is, the engaging portions 53A and 53B are engaged with the engaged portions 45A and 45B), the abutting wall portion 51 is inserted into the guide portion 421, and comes in contact with the rear ends of the operating bodies 7 connected to the rear ends of the writing bodies 6 in a retracted state. In addition, when the lid portion 5 is attached to the rear end of the rear barrel 4, the outer peripheral surface of the abutting wall portion 51 comes in pressure contact with the inner wall of the opening portion 42 (the guide portion 421). In this way, when the engaging portions 53A and 53B of the lid portion 5 are engaged with the engaged portions 45A and 45B provided on the outer surface of the rear end of the rear barrel 4 in the sliding manner, it is possible to prevent the rear end of the rear barrel 4 which is divided into two parts in the radial direction by the window holes 41 whose rear ends are opened from being deformed inward in the radial direction.

(Writing Body)

The writing bodies 6 are ballpoint pen refills, and each of the writing bodies 6 is composed of a ballpoint pen tip (that is, the nib 61) holding a ball rotatably at a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 62.

In the ballpoint pen tip, the ball rotatably held in the leading end thereof may be urged forward by, for example, an elastic member so as to come in close contact with an inner peripheral surface of the leading end. In addition, the ballpoint pen tip may be directly fitted to a front opening of the ink containing tube 62 by pressing. Note that, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, the retaining projections 76 are formed on both side walls of the operating body 7. The retaining projections 76 can be engaged with the inner surfaces of both side walls of the window holes 41.

When the nib 61 of the writing body 6 is in a retracted state, the rear end of the operating body 7 mounted to the writing body 6 comes in contact with the abutting wall portion 51 formed on the front surface of the lid portion 5. On the other hand, when the nib 61 of the writing body 6 protrudes from the barrel, the rear end of the operating body 7 mounted to the writing body 6 is locked to the locking wall portion 43 formed on the inner wall of the barrel 2.

When the operating portion 71 of the operating body 7 is operated to slide forward, the front protruding portion 72 of the operating body 7 connected to the rear end of the writing body 6 whose nib is in the retracted state comes in contact with the rear protruding portion 73 of the operating body 7 connected to another writing body 6 whose nib protrudes from the barrel, which causes the protruding state of the nib of another writing body 6 to be released.

(Discriminating Mark)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

(Elastic Body Supporting Portion)

An elastic body supporting portion 9 having a cylindrical shape is provided on the inner wall of the barrel 2 (that is, the inner wall of the rear barrel 4). A plurality of holes (for example, two holes) 91, through which the writing bodies 6 pass, are formed in the elastic body supporting portion 9 in the axial direction. The elastic bodies 8 are arranged between the rear surface of the elastic body supporting portion 9 and the front surfaces of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies.8 are locked to the front surfaces of the flange portions 75 of the operating bodies 7.

Holding portions 92, each composed of a cylindrical protruding portion that projects backward, are formed in the rear surface of the elastic body supporting portion 9 in the peripheries of the holes 91. The inner surfaces of the holding portions 92 hold the outer surfaces of the front end portions of the elastic bodies 8. Thereby, when the writing bodies 6 and the operating bodies 7 are replaced, it is possible to prevent the elastic bodies 8 from falling off from the barrel 2 through the opening portion 42.

The elastic bodies 8 always urge the corresponding operating bodies 7 (that is, the writing bodies 6) backward. The elastic bodies 8 are compressed when the nibs of the writing bodies are retracted and when they protrude from the barrel (that is, the writing bodies 6 are urged toward the rear side), which makes it possible to the operating bodies 7 from being rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating body 7 of another writing body 6 whose nib is in the protruding state outward in the radial direction. Then, locking between the operating body 7 and the locking wall portion 43 of the barrel 2 is released, so that another writing body 6 is moved backward by the urging force of the elastic body 8, and the nib 61 of another writing body 6 is retracted into the barrel 2, causing the rear end of the operating body 7 of another writing body 6 to come in contact with the abutting wall portion 51 provided on the front surface of the lid portion 5. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 43 formed on the inner wall of the barrel 2, thereby keeping the protruding state of the nib.

(Replacement of Writing Body and Operating Body)

Next, the replacement of the writing bodies 6 and the operating bodies 7 according to this embodiment will be described below.

In order to replace the writing bodies 6, in a state in which the lid portion 5 closes up the rear opening portion 42 of the barrel 2 (see FIG. 32), the engagement between the engaging portions 53A and 53B of the lid portion 5 and the engaged portions 45A and 45B is released, so that the lid portion 5 slides from the rear end of the barrel 2 in the radial direction to be separated from the barrel, thereby exposing the rear opening portion 42 of the barrel 2. When the opening portion 42 is opened, the operating bodies 7 protrude backward through the opening portion 42 by the urging force of the elastic bodies 8. When the operating bodies 7 are pulled out from the rear end of the barrel 2 through the opening portion 42 (see FIG. 33), the writing bodies 6 connected to the operating bodies 7 are also pulled out from the barrel 2 through the opening portion 42. Then, new writing bodies 6 and new operating bodies 7 connected to each other are inserted into the barrel 2 through the opening portion 42. Subsequently, the two engaging portions 53A and 53B of the lid portion 5 are engaged with the two engaged portions 45A and 45B of the barrel 2 in the radial direction in the sliding manner, thereby closing the opening portion 42 at the rear end of the barrel 2 with the lid portion 5. In this way, the replacement of the writing bodies 6 and the operating bodies 7 is completed.

Sixth Embodiment

A sixth embodiment of the invention is shown in FIGS. 34 to 43. A multi-refill writing instrument 1 according to this embodiment includes a barrel 2 and a plurality of writing bodies (for example, two writing bodies) 6 accommodated in the barrel 2 such that it can move back and forth. The writing bodies 6 are urged toward the rear side by elastic bodies 8 (specifically, compression coil springs).

(Barrel)

The barrel 2 includes a front barrel 3 composed of a tapered cylinder and a cylindrical rear barrel 4 that is screwed to the rear end of the front barrel 3 or is fitted thereinto by pressing. A front hole 31 is provided in the front end of the front barrel 3 in the axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two elongating window holes) 41 extending in the axial direction are provided in the side wall of the rear part of the rear barrel 4 in the radial direction. The two window holes 41 are formed so as to be symmetric with respect to an axis line. In addition, an opening portion 42 is formed in the rear end of the rear barrel 4 in the axial direction. The opening portion 42 communicates with the window holes 41 at the rear end of the rear barrel 4 (that is, the rear end of the barrel 2). In this way, the rear ends of the window holes 41 are cut out, so that the rear ends of the window holes 41 are opened. Meanwhile, the front ends of the window holes 41 are always closed.

A clip 44 is provided on the outer surface of the side wall of the rear barrel 4 between the window holes 41. The clip 44 has a rear projecting portion formed on the rear side of the base thereof. The rear projecting portion projects from the rear end of the rear barrel 4 backward. An engaged portion 45A, composed of an inward projection, is formed in the inner surface of the rear protruding portion in the radial direction.

The side wall of the rear end of the rear barrel 4 (the rear end of the barrel 2) is divided into two parts in the radial direction by the two window holes 41 whose rear ends are opened. In addition, a rod-shaped portion (an engaged portion 45B) protrudes backward from one of the rear end parts of the rear barrel 4 divided in the radial direction, which is opposite to the clip 44. An engaging groove is formed in the inner surface of the rod-shaped portion in the radial direction.

Guide portions 421 are formed on both inner walls of the opening portion 42 to regulate the direction in which the side surfaces of the operating bodies 7 are oriented when the operating bodies 7 are inserted. In addition, concave portions 421*a* into which retaining projections 76 of the operating body 7 can be inserted are formed in each guide portion 421.

Locking wall portions 43 composed of ribs each extending in the axial direction are formed on the inner surfaces of the side walls of the window portions 41 of the rear barrel 4. When the nib 61 protrudes from the barrel, the rear end of the operating body 7 of the writing body 6 is locked to the locking wall portion 43.

(Lid Portion)

An openable lid portion 5 that closes the opening portion 42 rotates in the circumferential direction to be engaged with the rear end of the rear barrel 4. The lid portion 5 includes a disk-shaped main body 52, an outward projection (an engaging portion 53A) protruding from the main body 52 to the outside in the radial direction, a hole (an engaging portion 53B) which is formed in the main body 52 at a position opposite to the outward projection (the engaging portion 53A) in the radial direction, and an abutting wall portion 51 formed in the center of the main body 52. The hole (the engaging portion 53B) is formed in the axial direction and extends in an arc shape. The abutting wall portion 51 is composed of a cylindrical convex portion protruding forward. The lid portion 5 is integrally formed by injection-molding a synthetic resin (for example, polycarbonate).

Further, an engaging concave portion is formed on the rear surface of the outward projection (the engaging portion 53A) such that it can engage with the inward projection (the engaged portion 45A). Meanwhile, an inward projection is formed at one end of the inner surface of the hole (the engaging portion 53B) in the circumferential direction. The inward projection on the inner surface of the hole (the engaging portion 53B) can engage with an engaging groove of the rod-shaped portion (the engaged portion 45B) formed on the rear end surface of the barrel 2. The rod-shaped portion (the engaged portion 45B) can be inserted from the other end of the inner surface of the hole (the engaging portion 53B) in the circumferential direction. When the main body 52 of the lid portion 5 is slightly rotated (that is, turned) in the circumferential direction, the engaging groove of the rod-shaped portion (the engaged portion 45B) is engaged with the inward projection formed at one end of the inner surface of the hole (the engaging portion 53B) in the circumferential direction.

When the lid portion 5 is mounted to the rear end of the rear barrel 4 (that is, the engaging portions 53A and 53B are engaged with the engaged portions 45A and 45B, respectively), the abutting wall portion 51 is arranged at a position covering the center of the opening portion 42 to come in contact with the rear end surface of the barrel 2.

(Writing Body)

The writing bodies 6 are ballpoint pen refills, and each of the writing bodies 6 is composed of a ballpoint pen tip (that is, the nib 61) holding a ball rotatably at a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the-aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 62.

In the ballpoint pen tip, the ball rotatably held in the leading end thereof may be urged forward by, for example, an elastic member so as to come in close contact with an inner surface of the leading end. In addition, the ballpoint pen tip may be directly fitted to a front opening of the ink containing tube 62 by pressing. Note that, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, the retaining projections 76 are formed on both side walls of the operating body 7. The retaining projections 76 can be engaged with the inner surfaces of both side walls of the window holes 41.

When the nib 61 of the writing body 6 is in a retracted state, the rear end of the operating body 7 mounted to the writing body 6 comes in contact with the abutting wall portion 51 formed on the front surface of the lid portion 5. On the other hand, when the nib 61 of the writing body 6 protrudes from the barrel, the rear end of the operating body 7 mounted to the writing body 6 is locked to the locking wall portion 43 formed on the inner wall of the barrel 2.

When the operating portion 71 of the operating body 7 is operated to slide forward, the front protruding portion 72 of the operating body 7, which is connected to the rear end of the writing body 6 whose nib is in the retracted state, comes in contact with the rear protruding portion 73 of the operating body 7 connected to another writing body 6 whose nib protrudes from the barrel, which causes the protruding state of the nib of another writing body 6 to be released.

(Discriminating Mark)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

(Elastic Body Supporting Portion)

An elastic body supporting portion 9 having a cylindrical shape is provided on the inner wall of the barrel 2 (that is, the inner wall of the rear barrel 4). A plurality of holes (for example, two holes) 91, through which the writing bodies 6 pass, are formed in the elastic body supporting portion 9 in the axial direction. The elastic bodies 8 are arranged between the rear surface of the elastic body supporting portion 9 and the front surfaces of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies 8 are locked to the front surfaces of the flange portions 75 of the operating bodies 7.

Holding portions 92, each composed of a cylindrical protruding portion that projects backward, are formed in the rear surface of the elastic body supporting portion 9 in the peripheries of the holes 91. The inner surfaces of the holding portions 92 hold the outer surfaces of the front end portions of the elastic bodies 8. Thereby, when the writing bodies 6 and the operating bodies 7 are replaced, it is possible to prevent the elastic bodies 8 from falling off from the barrel 2 through the opening portion 42.

The elastic bodies 8 always urge the corresponding operating bodies 7 (that is, the writing bodies 6) backward. The elastic bodies 8 are compressed when the nibs of the writing bodies are retracted and when the nibs protrude from the barrel (that is, the writing bodies 6 are urged toward the rear side), which makes it possible to the operating bodies 7 from being rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating body 7 of another writing body 6 whose nib is in the protruding state outward in the radial direction. Then, locking between the operating body 7 and the locking wall portion 43 of the barrel 2 is released, so that another writing body 6 is moved backward by the urging force of the elastic body 8, and the nib 61 of another writing body 6 is retracted into the barrel 2, causing the rear end of the operating body 7 of another writing body 6 to come in contact with the abutting wall portion 51 provided on the front surface of the lid portion 5. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 43 formed on the inner wall of the barrel 2, thereby keeping the protruding state of the nib.

(Replacement of Writing Body and Operating Body)

Next, the replacement of the writing bodies 6 and the operating bodies 7 according to this embodiment will be described below.

In order to replace the writing bodies 6, in a state in which the lid portion 5 closes up the rear opening portion 42 of the barrel 2 (see FIG. 42), the engagement between the engaging portions 53A and 53B of the lid portion 5 and the engaged portions 45A and 45B is released, so that the lid portion 5 is rotated from the rear end of the barrel 2 in the circumferential direction to be separated from the barrel, thereby exposing the rear opening portion 42 of the barrel 2. When the lid portion 5 is separated from the opening portion 42, the operating bodies 7 protrude backward through the opening portion 42 by the urging force of the elastic bodies 8. When the operating bodies 7 are pulled out from the rear end of the barrel 2 through the opening portion 42 (see FIG. 43), the writing bodies 6 connected to the operating bodies 7 are also pulled out from the barrel 2 through the opening portion 42. Then, new writing bodies 6 and new operating bodies 7 connected to each other are inserted into the barrel 2 through the opening portion 42. Subsequently, the lid portion 5 is rotated in the circumferential direction, with its one surface coming in contact with the rear end of the barrel 2, to cause the two engaging portions 53A and 53B of the lid portion 5 to be engaged with the two engaged portions 45A and 45B provided on the rear end of the barrel 2, thereby mounting the lid portion 5 to the rear end of the barrel 2 to close up the opening portion 42. In this way, the replacement of the writing bodies 6 and the operating bodies 7 is completed.

Seventh Embodiment

A seventh embodiment of the invention is shown in FIGS. 44 to 50. A multi-refill writing instrument 1 according to this embodiment includes a barrel 2 and a plurality of writing bodies (for example, two writing bodies) 6 accommodated in the barrel 2 such that it can move backward and forward. The writing bodies 6 are urged toward the rear side by elastic bodies 8 (specifically, compression coil springs).

(Barrel)

The barrel 2 includes a front barrel 3 composed of a tapered cylinder and a cylindrical rear barrel 4 that is screwed to the rear end of the front barrel 3 or is fitted thereinto by pressing. A front hole 31 is provided in the front end of the front barrel 3 in the axial direction such that nibs 61 of the writing bodies 6 can protrude through the hole. The front barrel 3 and the rear barrel 4 are obtained by injection-molding a synthetic resin (for example, polycarbonate).

A plurality of elongating window holes (for example, two elongating window holes) 41 extending in the axial direction are provided in the side wall of the rear part of the rear barrel 4 in the radial direction. The two window holes 41 are formed so as to be symmetric with respect to an axis line. The rear ends of the inner walls of the window holes 41 are composed of abutting wall portions 41*a* which operating bodies 7 connected to writing bodies 6 whose nibs are in a retracted state can come in contact with.

The side wall of the rear barrel 4 having the window holes 41 formed therein includes a separable wall portion 43 that is separated in the radial direction. That is, the rear barrel 4 includes a rear barrel main body 42 and the separable wall portion 43 that is separable from the rear barrel main body 42. The separable wall portion 43 is composed of a member having a semicylindrical shape. The rear barrel main body 42 and the separable wall portion 43 are formed such that the front and rear ends of peripheral walls of the window holes 41 can be separated from each other in the radial direction. When the separable wall portion 43 is completely separated in the radial direction (that is, when the front ends of the peripheral walls of the window holes 41 are separated in the radial direction and then the rear ends of the peripheral walls of the window holes 41 are separated in the radial direction), half the peripheral wall of each of the window hole 41 is removed, and thus each window hole 41 is widened largely. The widened window holes 41 make it possible to easily pull out the operating bodies 7 for replacement.

An engaging portion 43*a* having a small diameter is formed in the outer peripheral surface of the front end of the separable wall portion 43, so that it can engage with the inner surface of the rear barrel main body 42.

An opening portion whose rear end is opened is formed at the rear end of the rear barrel 4. A lid portion 5 is detachably mounted to the outer peripheral surface of the opening portion (for example, by screwing, pressing, or engagement by getting over). The outer peripheral surface of the rear end of the separable portion 43 and the outer peripheral surface of the rear end of the rear barrel main body 42 are reduced in diameter to form an engaging portion 46, and the lid portion 5 is detachably mounted to the engaging portion 46.

Locking wall portions 44 composed of ribs each extending in the axial direction are formed on the inner surfaces of the side walls of the window portions 41 of the rear barrel 4. When the nib 61 protrudes from the barrel, the rear end of the operating body 7 of the writing body 6 is locked to the locking wall portion 44. However, the locking wall portions 44 are not shown in FIGS. 46 to 51.

A clip 45 is provided on the outer surface of the side wall of the rear barrel 4 (the rear barrel main body 42) between the window holes 41. Alternatively, the clip 45 may be provided on the separable wall portion 43.

(Writing Body)

The writing bodies 6 are ballpoint pen refills, and each of the writing bodies 6 is composed of a ballpoint pen tip (that is, the nib 61) holding a ball rotatably at a leading end thereof and an ink containing tube 62 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 62. When the aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 62.

In the ballpoint pen tip, the ball rotatably held in the leading end thereof may be urged forward by, for example, an elastic member so as to come in close contact with an inner peripheral surface of the leading end. In addition, the ballpoint pen tip may be directly fitted to a front opening of the ink containing tube 62 by pressing. Note that, in this embodiment, the ballpoint pen tip is fixed to the front opening of the ink containing tube 62 with a pen tip holder interposed therebetween.

(Operating Body)

The operating bodies 7 are mounted to the rear ends of the writing bodies 6 (that is, rear openings of the ink containing tubes 62). Each of the operating bodies 7 includes an operating portion 71 that is provided at the rear end thereof and protrudes from the barrel 2 to the outside through the window hole 41, a front protruding portion 72 that is provided on the opposite side of the operating portion 71, a rear protruding portion 73 that is provided on the rear side of the front protruding portion 72 disposed on the opposite side of the operating portion 71, a fitting portion 74 that is formed at the front end thereof and is fitted into the rear opening of the ink containing tube 62, and a flange portion 75 formed on the rear side of the fitting portion 74. When the fitting portion 74 is fitted into the rear opening of the ink containing tube 62, it does not cover the entire rear opening of the ink containing tube 62 such that air can pass between the inner side and the outer side of the ink containing tube 62. In addition, the rear end of the elastic body 8 is locked to the front surface of the flange portion 75. Further, retaining projections are formed on both side walls of the operating body 7. The retaining projections can be engaged with the inner surfaces of both side walls of the window holes 41.

When the nib 61 of the writing body 6 is in a retracted state, the rear end of the operating body 7 mounted to the writing body 6 comes in contact with the abutting wall portion 41*a* formed on the rear end of the inner wall of the window hole 41. On the other hand, when the nib 61 of the writing body 6 protrudes from the barrel, the rear end of the operating body 7 mounted to the writing body 6 is locked to the locking wall portion 44 formed on the inner wall of the barrel 2.

When the operating portion 71 of the operating body 7 is operated to slide forward, the front protruding portion 72 of the operating body 7 connected to the rear end of the writing body 6 whose nib is in the retracted state comes in contact with the rear protruding portion 73 of the operating body 7 connected to another writing body 6 whose nib protrudes from the barrel, which causes the protruding state of the nib of another writing body 6 to be released.

(Discriminating Mark)

The operating body 7 has substantially the same color as that of the ink contained in the writing body 6 (that is, the ink containing tube 62) connected thereto. More specifically, the operating body 7 is formed of a synthetic resin having substantially the same color as that of the ink contained in the writing body 6 connected thereto. In this way, the operating bodies 7 can be discriminated from each other by means of their colors corresponding to ink colors. For example, the operating body 7 connected to the writing body 6 containing a black ink therein is colored black, and the operating body 7 connected to the writing body 6 containing a blue ink therein is colored blue. In addition, the operating body 7 connected to the writing body 6 containing a red ink therein is colored red, and the operating body 7 connected to the writing body 6 containing a green ink therein is colored green. In this embodiment, two writing bodies 6 having different ink colors are accommodated in the barrel 2.

In particular, when the ink containing tubes 62 are formed of an opaque material, or when the ink containing tubes 62 are formed of a transparent material and dye ink is contained in the ink containing tubes, it is difficult to discriminate the colors of the contained ink from the outside. However, in this embodiment, since the operating bodies 7 have substantially the same colors as those of the ink contained in the writing bodies, it is possible to easily discriminate the colors of ink contained in the writing bodies 6 for replacement, which exists outside the barrel 2, from the outside.

When a ballpoint pen in which the sizes of balls held in the nibs 61 of the writing bodies 6 are different from each other is used, it is preferable that a discriminating mark composed of numbers indicating the external diameter of the ball of the nib 61 be provided on the operating portion 71 of each operating body 7. When a writing instrument in which the shapes of the nibs 61 of the writing bodies 6 differ from each other is used, it is preferable that discriminating marks corresponding to the shapes of the nibs 61 be provided on the operating portions 71 of the operating bodies 7. In addition, the discriminating marks each composed of numbers indicating the external diameter of the ball of the nib 61 and the discriminating marks corresponding to the shapes of the nibs 61 may be provided on the operating portions 71 of the operating bodies 7 having the same colors as those of ink. The discriminating marks are provided on the operating bodies 7 by, for example, printing or seal attachment or in the form of a concave portion or a convex portion.

(Elastic Body Supporting Portion)

An elastic body supporting portion 9 having a disk shape is provided on the inner wall of the barrel 2 (that is, the inner wall of the rear barrel main body 42). A plurality of holes (for example, two holes) 91 through which the writing bodies 6 pass are formed in the elastic body supporting portion 9 in the axial direction. The elastic bodies 8 are arranged between the rear surface of the elastic body supporting portion 9 and the front surfaces of the flange portions 75 of the operating bodies 7. The writing bodies 6 pass through the elastic bodies 8, and the front ends of the elastic bodies 8 are locked by the rear surface of the elastic body supporting portion 9. In addition, the rear ends of the elastic bodies 8 are locked to the front surfaces of the flange portions 75 of the operating bodies 7.

Holding portions 92 which communicate with the holes 91 and have internal diameters slightly larger than those of the holes 91 are formed in the rear surface of the elastic body supporting portion 9 on the rear sides of the holes 91. The inner surfaces of the holding portions 92 hold the outer surfaces of the front end portions of the elastic bodies 8. Thereby, when the rear barrel main body 42 and the separable wall portion 43 are separated from each other to replace the writing bodies 6 and the operating bodies 7, it is possible to prevent the elastic bodies 8 from falling off from the barrel 2. A step portion is formed between the hole 91 and the holding portion 92 so as to contact and lock the front end of the elastic body 8.

The elastic bodies 8 always urge the corresponding operating bodies 7 (that is, the writing bodies 6) backward. The elastic bodies 8 are compressed when the nibs of the writing bodies are retracted and when the nibs protrude from the barrel (that is, the writing bodies 6 are urged toward the rear side), which makes it possible to the operating bodies 7 from being rattled in the axial direction.

(Projection and Retraction of Nib)

A projecting/retracting operation of the nib 61 according to this embodiment will be described below.

When the operating portion 71 of one operating body 7 is operated to slide toward the front side along the window hole 41 against the urging force of the elastic body 8, the front protruding portion 72 of the slid operating body 7 lifts up the rear protruding portion 73 of the operating body 7 of another writing body 6 whose nib is in the protruding state outward in the radial direction. Then, locking between the operating body 7 and the locking wall portion 44 of the barrel 2 is released, so that another writing body 6 is moved backward by the urging force of the elastic body 8, and the nib 61 of another writing body 6 is retracted into the barrel 2, causing the rear end of the operating body 7 of another writing body 6 to come in contact with the abutting wall portion 41*a* provided on the rear end of the inner wall of the window hole 41. At the same time when the nib 61 of another writing body 6 is retracted, the nib 61 of the writing body 6 connected to the operating body 7 which has slid forward protrudes from the barrel 2 through the front hole 31, and the rear end of the operating body 7 which has slid forward is locked to the locking wall portion 44 formed on the inner wall of the barrel 2, thereby keeping the protruding state of the nib 61.

(Replacement of Writing Body and Operating Body)

Next, the replacement of the writing bodies 6 and the operating bodies 7 according to this embodiment will be described below.

Figure 50:
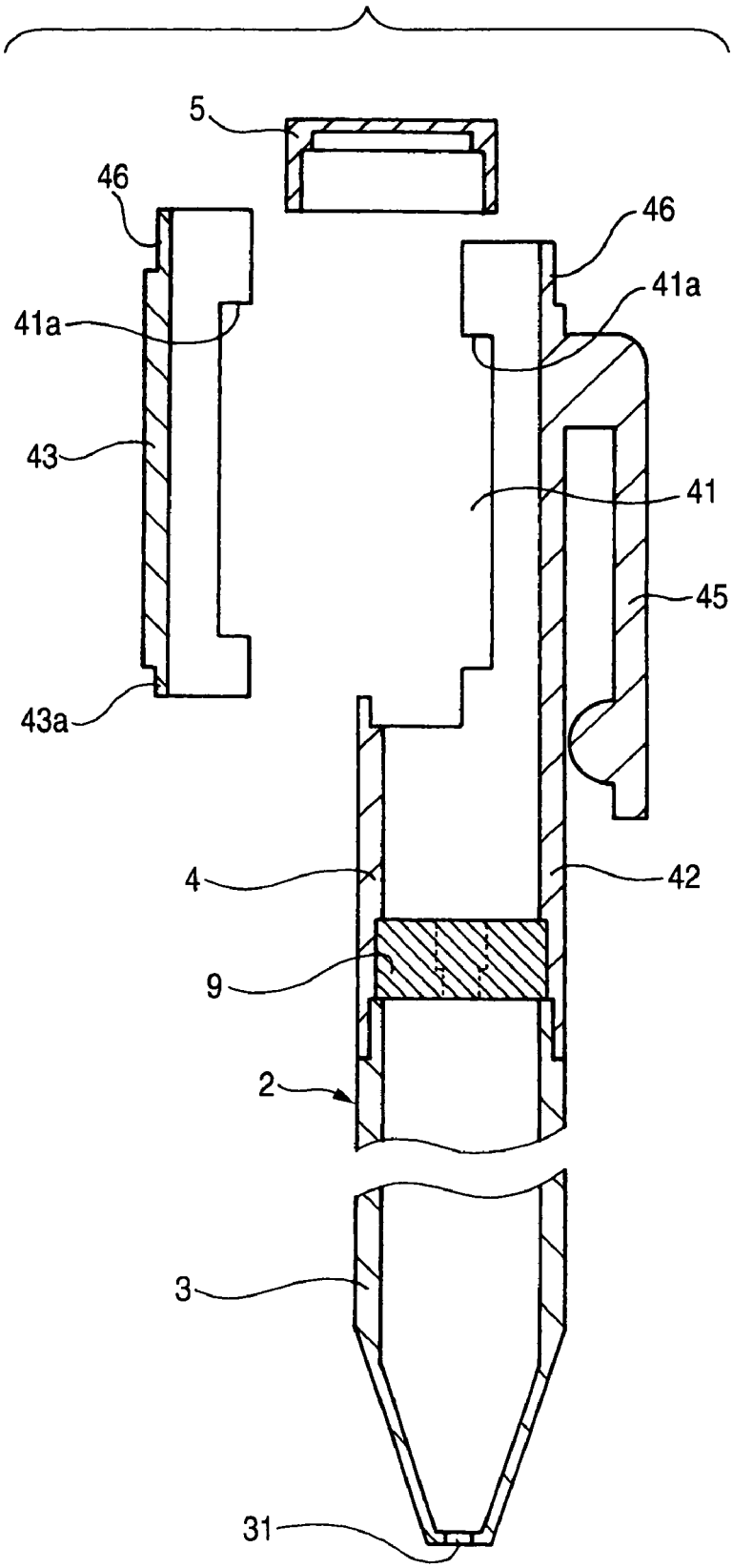
FIG. 50 is a longitudinal cross-sectional view illustrating a state in which peripheral walls of window holes are separated from the multi-refill writing instrument shown in FIG. 46.

In order to replace the writing bodies 6, in the combination between the rear barrel main body 42 and the separable wall portion 43 (see FIG. 46), the lid portion 5 is detached from the rear end of the rear barrel 4, and the separable wall portion 43 is separated from the rear barrel main body 42 in the radial direction, thereby enlarging the window holes 41 (see FIG. 50). Then, the operating bodies 7 are pulled out through the window holes 41, and the writing bodies 6 connected to the operating bodies 7 are also pulled out from the barrel 2 through the separated window holes 41. Subsequently, new writing bodies 6 and new operating bodies 7 connected to each other are inserted into the barrel 2 through the separated window holes 41. Then, the separable wall portion 43 is combined with the rear barrel main body 42, and the lid portion 5 is mounted to the rear end of the barrel 2. In this way, the replacement of the writing bodies 6 and the operating bodies 7 is completed.

Eighth Embodiment

Figure 51:
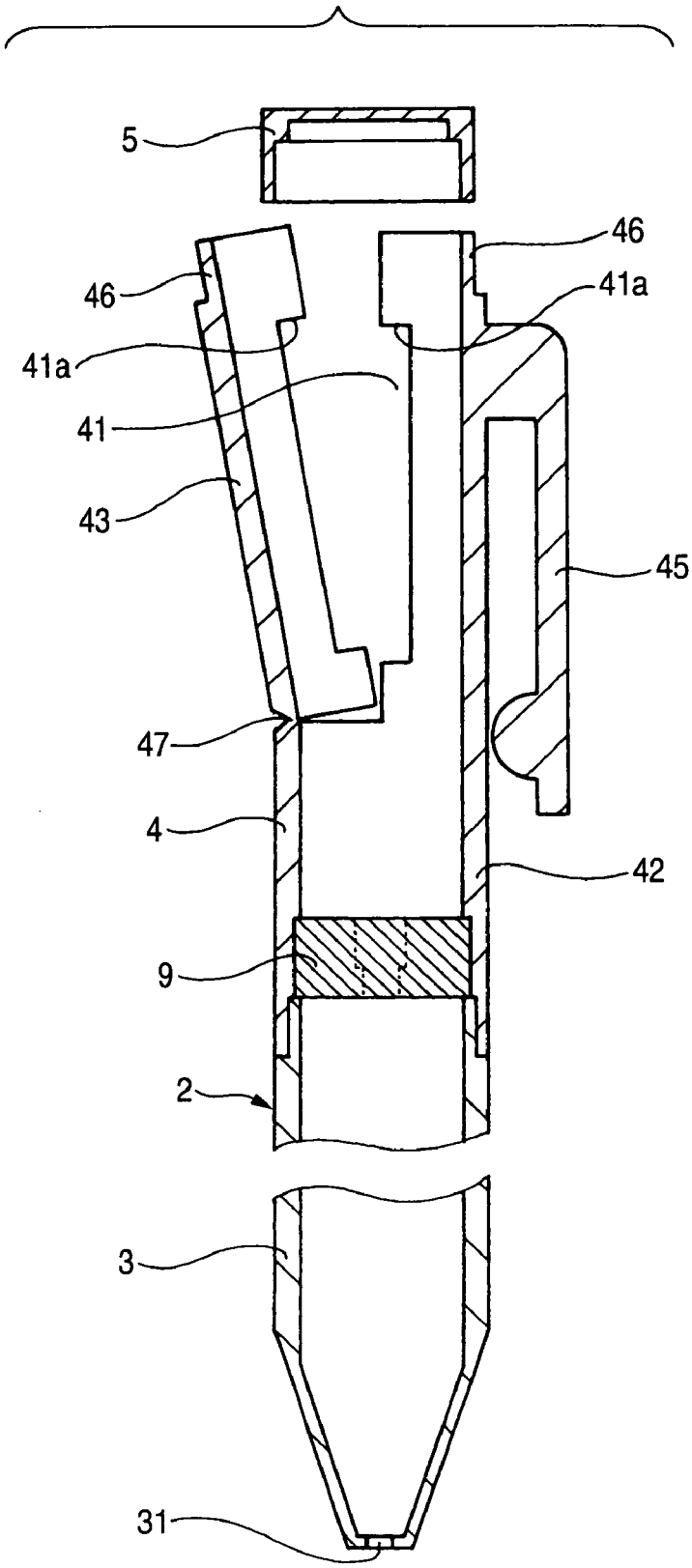
FIG. 51 is a longitudinal cross-sectional view illustrating a state in which peripheral walls of window holes are separated from a multi-refill writing instrument according to an eighth embodiment of the invention (however, writing bodies, operating bodies, elastic bodies, and locking wall portions are omitted)
Figure 52:
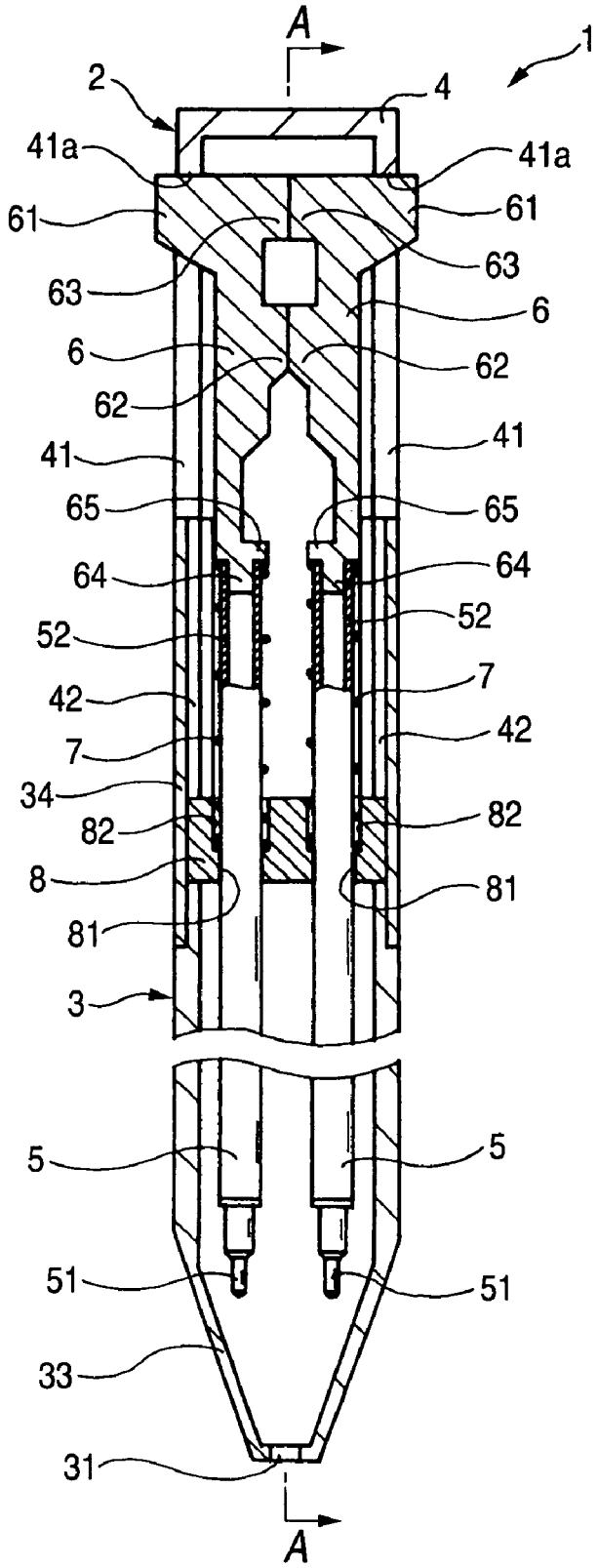
FIG. 52 is a longitudinal cross-sectional view illustrating a multi-refill writing instrument whose pen tips are in a retracted state (at the time of non-writing) according to a ninth embodiment of the invention.
Figure 53:
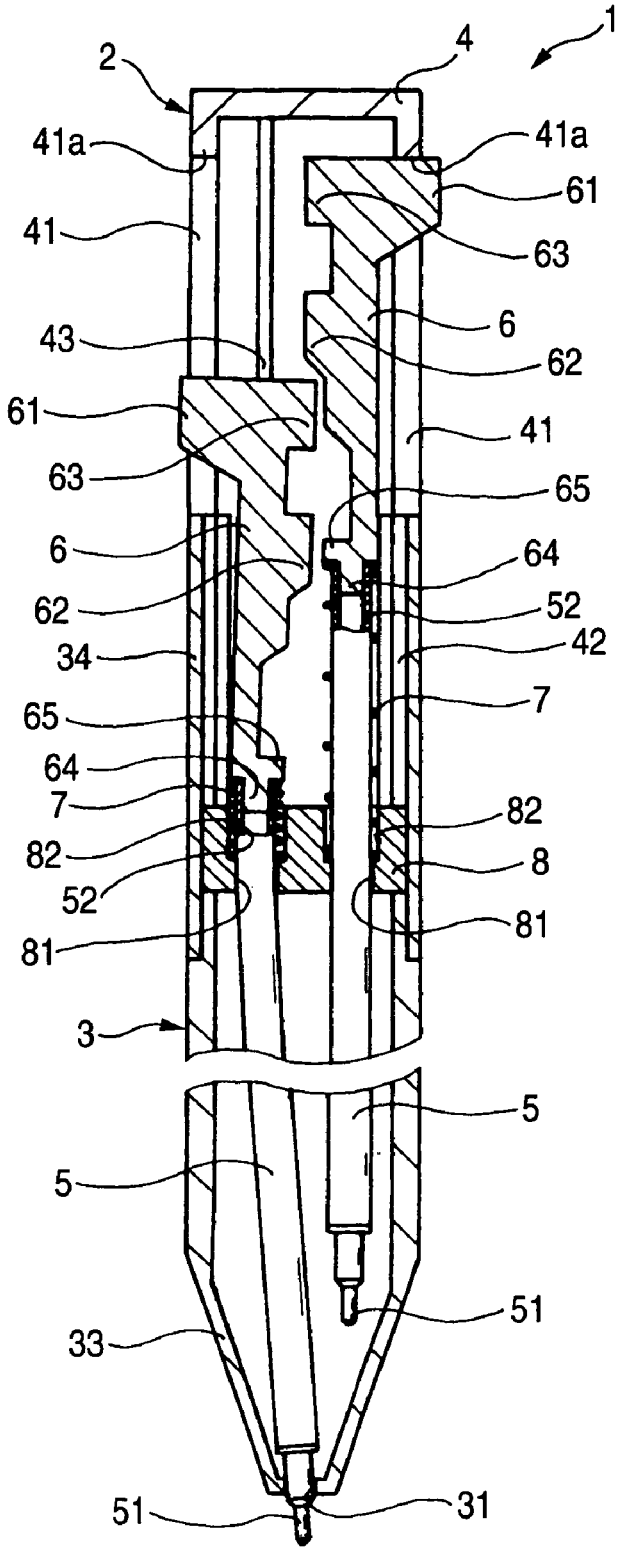
FIG. 53 is a longitudinal cross-sectional view illustrating the multi-refill writing instrument shown in FIG. 52 whose one pen tip is in a protruding state (at the time of writing)
Figure 54:
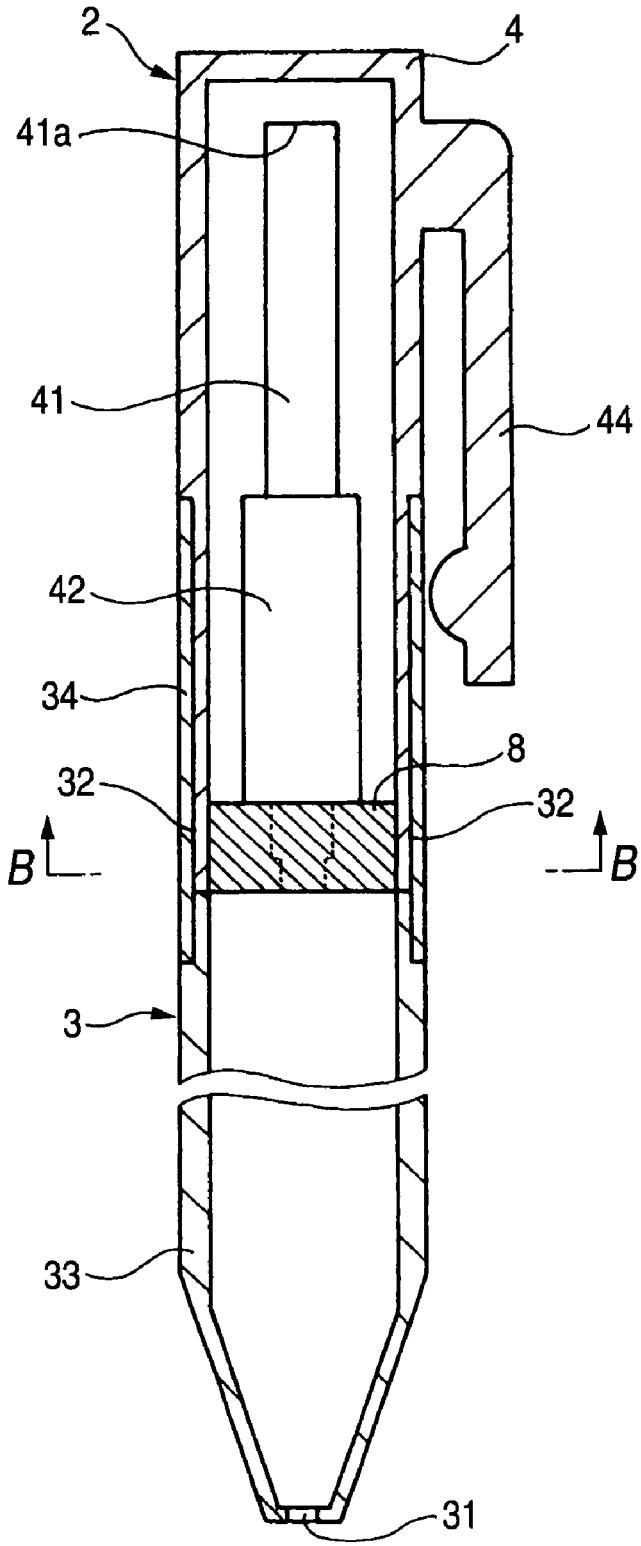
FIG. 54 is a cross-sectional view of the multi-refill writing instrument taken long the line A-A of FIG. 52 (however, writing bodies, operating bodies, elastic bodies, and locking wall portions are omitted).
Figure 55:
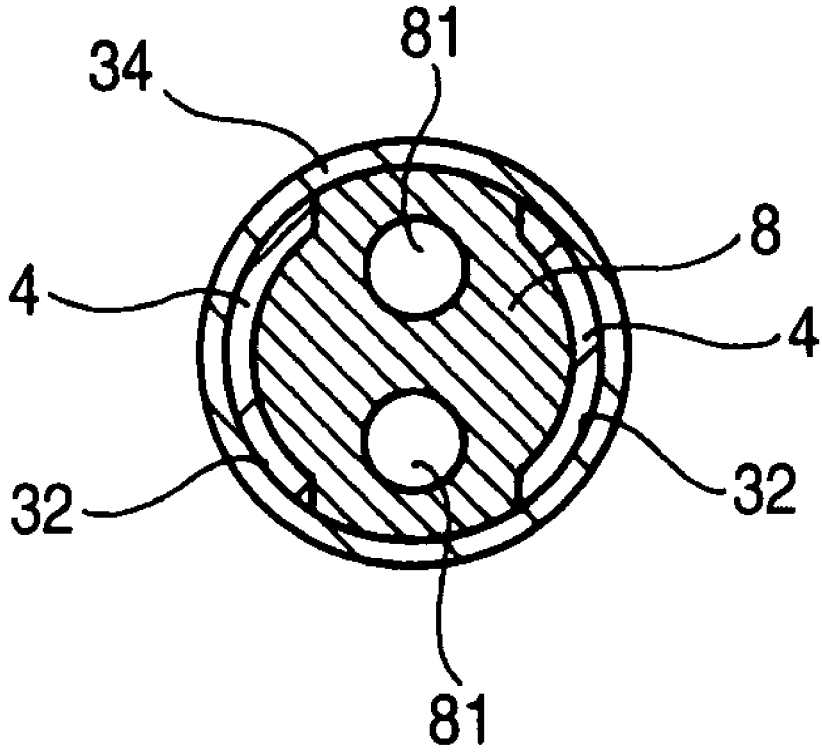
FIG. 55 is a cross-sectional view taken long the line B-B of FIG. 54.

FIG. 51 shows an eighth embodiment of the invention.

In this embodiment, the rear end of a peripheral wall of a separable wall portion 43 is formed so as to be separable in the radial direction, and the front end of the peripheral wall of the separable wall portion 43 is connected to a rear barrel main body 42 through a hinge portion 47. However, in the embodiment the other structures are the same as those in the seventh embodiment, and thus a description thereof will be omitted.

Ninth Embodiment

A ninth embodiment of the invention is shown in FIGS. 52 to 56. A multi-refill writing instrument 1 according to this embodiment includes a barrel 2 and a plurality of writing bodies (for example, two writing bodies) 5 accommodated in the barrel 2 such that it can move back and forth. The writing bodies 5 are urged toward the rear side by elastic bodies 7 (specifically, compression coil springs).

(Barrel)

The barrel 2 includes a front barrel 3 composed of a tapered cylinder and a cylindrical rear barrel 4 that is detachably connected to the rear end of the front barrel 3.

(Front Barrel)

The front barrel 3 includes a front barrel portion 33 having a tapered cylindrical shape and a rear barrel portion 34 that has a cylindrical shape and is connected to the rear end of the front barrel portion 33. A front hole 31 is provided in the front end of the front barrel portion 33 in the axial direction such that nibs 51 of the writing bodies 5 can protrude through the hole. The front barrel 3 (that is, the front barrel portion 33 and the rear barrel portion 34) and the rear barrel 4 are obtained by injection-molding a synthetic resin (for example, polycarbonate).

(Engaging Hole)

An elastic body supporting portion 8 having a disk shape is fixed to the inner wall of the front barrel 3 (more specifically, the inner wall of the rear barrel portion 34). Two engaging holes 32 are formed by a gap between the elastic body supporting portion 8 and the front barrel 3 so as to be symmetric with respect to an axis line. Two front end portions of the rear barrel 4 divided by cut-out portions 42 are inserted into the engaging holes 32. When the front end portions of the rear barrel 4 are inserted into the front barrel 3, the two engaging holes 32 define the positions of the front barrel 3 and the rear barrel 4 in the circumferential direction. In this way, when the front barrel 3 and the rear barrel 4 are connected to each other, it is possible to accurately define the positions of holes 81 of the elastic body supporting portion 8 in the front barrel 3 and window holes 41 formed in the side wall of the rear barrel 4. The inner walls of the engaging holes 32 are detachably fitted to the outer surfaces of the front end portions of the rear barrel 4 by pressing or engagement.

(Rear Barrel)

A plurality of elongating window holes (for example, two elongating window holes) 41 extending in the axial direction and the cut-out portions 42 formed in front of the window holes 41 are formed in the side wall of the rear part of the rear barrel 4 in the radial direction. The two window holes 41 and the two cut-out portions 42 are formed so as to be symmetric with respect to an axis line. The rear ends of the inner walls of the window holes 41 serve as abutting wall portions 41*a* which comes in contact with operating bodies 6 connected to the rear ends of the writing bodies 5 whose nib is in a retracted state. In addition, the front end portion of the rear barrel 4 is divided into two parts by the cut-out portions 42.

When the rear barrel 4 is detached from the rear end of the front barrel 3, the window holes 41 are exposed forward through the cut-out portions 42. Therefore, in order for replacement, it is possible to easily pull out the operating bodies 6 through the window holes 41 exposed forward.

The front end portions of the rear barrel 4 having the cut-out portions 42 formed therein are inserted into the rear opening portions of the front barrel 3, and the two divided front end portions of the rear barrel 4 are inserted into and engaged with the engaging holes 32 of the front barrel 3.

Locking wall portions 43 composed of ribs each extending in the axial direction are formed on the inner surfaces of the side walls between the window portions 41 of the rear barrel 4. When the nib 51 protrudes from the barrel, the rear end of the operating body 6 of the writing body 5 is locked to the locking wall portion 43. However, the locking wall portions 43 are not shown in FIGS. 54 to 56.

A clip 44 is provided on the outer surface of the side wall between the window holes 41 of the rear barrel 4.

(Writing Body)

The writing bodies 5 are ballpoint pen refills, and each of the writing bodies 5 is composed of a ballpoint pen tip (that is, the nib 51) holding a ball rotatably at a leading end thereof and an ink containing tube 52 which has the ballpoint pen tip at a front end thereof and whose rear end is opened. Ink, such as an aqueous gel ink having shear thinning viscosity, an aqueous ink having low viscosity, an oil ink having low viscosity, or an oil ink having high viscosity, is contained in the ink containing tube 52. When the aqueous gel ink having shear thinning viscosity, the aqueous ink having low viscosity, or the oil ink having low viscosity is used, a follower which is made of a high-viscosity liquid and is advanced with the consumption of ink is filled into the rear side of the ink of the ink containing tube 52.

In the ballpoint pen tip, the ball rotatably held in the leading end thereof may be urged forward by, for example, an elastic member so as to come in close contact with an inner peripheral surface of the leading end. In addition, the ballpoint pen tip may be directly fitted to a front opening of the ink containing tube 52 by pressing. However, in this embodiment, the ballpoint pen tip is fixed to the front opening of the ink containing tube 52 with a pen tip holder interposed therebetween.

(Operating Body)

The operating bodies 6 are mounted to the rear ends of the writing bodies 5 (that is, rear openings of the ink containing tubes 52). Each of the operating bodies 6 includes an operating portion 61 that is provided at the rear end thereof and protrudes from the barrel 2 to the outside through the window hole 41, a front protruding portion 62 that is provided on the opposite side of the operating portion 61, a rear protruding portion 63 that is provided on the rear side of the front protruding portion 62 disposed on the opposite side of the operating portion 61, a fitting portion 64 that is formed at the front end thereof and is fitted into the rear opening of the ink containing tube 52, and a flange portion 65 formed on the rear side of the fitting portion 64. When the fitting portion 64 is fitted into the rear opening of the ink containing tube 52, it does not cover the entire rear opening of the ink containing tube 52 such that air can pass between the inner side and the outer side of the ink containing tube 52. In addition, the rear end of the elastic body 7 is locked to the front surface of the flange portion 65. Further, retaining projections are formed on both side walls of the operating body 6. The retaining projections can be engaged with the inner surfaces of both side walls of the window holes 41.

When the nib 51 of the writing body 5 is in a retracted state, the rear end of the operating body 6 mounted to the writing body 5 comes in contact with the abutting wall portion 41*a* formed on the rear end of the inner wall of the window hole 41. On the other hand, when the nib 51 of the writing body 5 protrudes from the barrel, the rear end of the operating body mounted to the writing body 5 is locked to the locking wall portion 43 formed on the inner wall of the barrel 2.

When the operating portion 61 of the operating body 6 is operated to slide forward, the front protruding portion 62 of the operating body 6 connected to the rear end of the writing body 5 whose nib is in the retracted state comes in contact with the rear protruding portion 63 of the operating body 6 connected to another writing body 5 whose nib protrudes from the barrel, which causes the protruding state of the nib of another writing body 5 to be released.

(Discriminating Mark)

The operating body 6 has substantially the same color as that of the ink contained in the writing body 5 (that is, the ink containing tube 52) connected thereto. More specifically, the operating body 6 is formed of a synthetic resin having substantially the same color as that of the ink contained in the writing body 5 connected thereto. In this way, the operating bodies 6 can be discriminated from each other by means of their colors corresponding to ink colors. For example, the operating body 6 connected to the writing body.5 containing a black ink therein is colored black, and the operating body 6 connected to the writing body 5 containing a blue ink therein is colored blue. In addition, the operating body 6 connected to the writing body 5 containing a red ink therein is colored red, and the operating body 6 connected to the writing body 5 containing a green ink therein is colored green. In this embodiment, two writing bodies 5 having different ink colors are accommodated in the barrel 2.

In particular, when the ink containing tubes 52 are formed of an opaque material, or when the ink containing tubes 52 are formed of a transparent material and dye ink is contained in the ink containing tubes, it is difficult to discriminate the colors of the contained ink from the outside. However, in this embodiment, since the operating bodies 6 have substantially the same colors as those of the ink contained in the writing bodies, it is possible to easily discriminate the colors of ink contained in the writing bodies 5 for replacement, which exists outside the barrel 2, from the outside.

When a ballpoint pen in which the sizes of balls held in the nibs 51 of the writing bodies 5 are different from each other is used, it is preferable that a discriminating mark composed of numbers indicating the external diameter of the ball of the nib 51 be provided on the operating portion 61 of each operating body 6. When a writing instrument in which the shapes of the nibs 51 of the writing bodies 5 differ from each other is used, it is preferable that discriminating marks corresponding to the shapes of the nibs 51 be provided on the operating portions 61 of the operating bodies 6. In addition, the discriminating marks each composed of numbers indicating the external diameter of the ball of the nib 51 and the discriminating marks corresponding to the shapes of the nibs 51 may be provided on the operating portions 61 of the operating bodies 6 having the same colors as those of ink. The discriminating marks are provided on the operating bodies 6 by, for example, printing or seal attachment or in the form of a concave portion or a convex portion.

(Elastic Body Supporting Portion)

A plurality of holes (for example, two holes) 81 through which the writing bodies 5 pass are formed in the elastic body supporting portion 8 in the axial direction. The elastic bodies 7 are arranged between the rear surface of the elastic body supporting portion 8 and the front surfaces of the flange portions 65 of the operating bodies 6. The writing bodies 5 pass through the elastic bodies 7, and the front ends of the elastic bodies 7 are locked by the rear surface of the elastic body supporting portion 8. In addition, the rear ends of the elastic bodies 7 are locked to the front surfaces of the flange portions 65 of the operating bodies 6.

Holding portions 82 which communicate with the holes 81 and have internal diameters slightly larger than those of the holes 81 are formed in the rear surface of the elastic body supporting portion 8 on the rear sides of the holes 81. The inner surfaces of the holding portions 82 hold the outer surfaces of the front end portions of the elastic bodies 7. In this way, when the rear barrel 4 and the front barrel 3 are separated from each other to replace the writing bodies 5 and the operating bodies 6, it is possible to prevent the elastic bodies 7 from falling off from the barrel 2. A step portion is formed between the hole 81 and the holding portion 82 so as to contact and lock the front end of the elastic body 7.

The elastic bodies 7 always urge the corresponding operating bodies 6 (that is, the writing bodies 5) backward. The elastic bodies 7 are compressed when the nibs of the writing bodies are retracted and when the nibs protrude from the barrel (that is, the writing bodies 5 are urged toward the rear side), which makes it possible to the operating bodies 6 from being rattled in the axial direction.

(Projection and Retraction of Nib)

A projecting/retracting operation of the nib 51 according to this embodiment will be described below.

When the operating portion 61 of one operating body 6 is operated to slide toward the front side along the window hole 41 against the urging force of the elastic body 7, the front protruding portion 62 of the slid operating body 6 lifts up the rear protruding portion 63 of the operating body 6 of another writing body 5 whose nib is in the protruding state outward in the radial direction. Then, locking between the operating body 6 and the locking wall portion 43 of the inner surface of the barrel 2 is released, so that another writing body 5 is moved backward by the urging force of the elastic body 6, and the nib 51 of another writing body 5 is retracted into the barrel 2, causing the rear end of the operating body 6 of another writing body 5 to come in contact with the abutting wall portion 41*a* provided on the rear end of the inner wall of the window hole 41. At the same time when the nib 51 of another writing body 5 is retracted, the nib 51 of the writing body 5 connected to the operating body 6 which has slid forward protrudes from the barrel 2 through the front hole 31, and the rear end of the operating body 6 which has slid forward is locked to the locking wall portion 43 formed on the inner wall of the barrel 2, thereby keeping the protruding state of the nib 51.

(Replacement of Writing Body and Operating Body)

Next, the replacement of the writing bodies 5 and the operating bodies 6 according to this embodiment will be described below.

Figure 56:
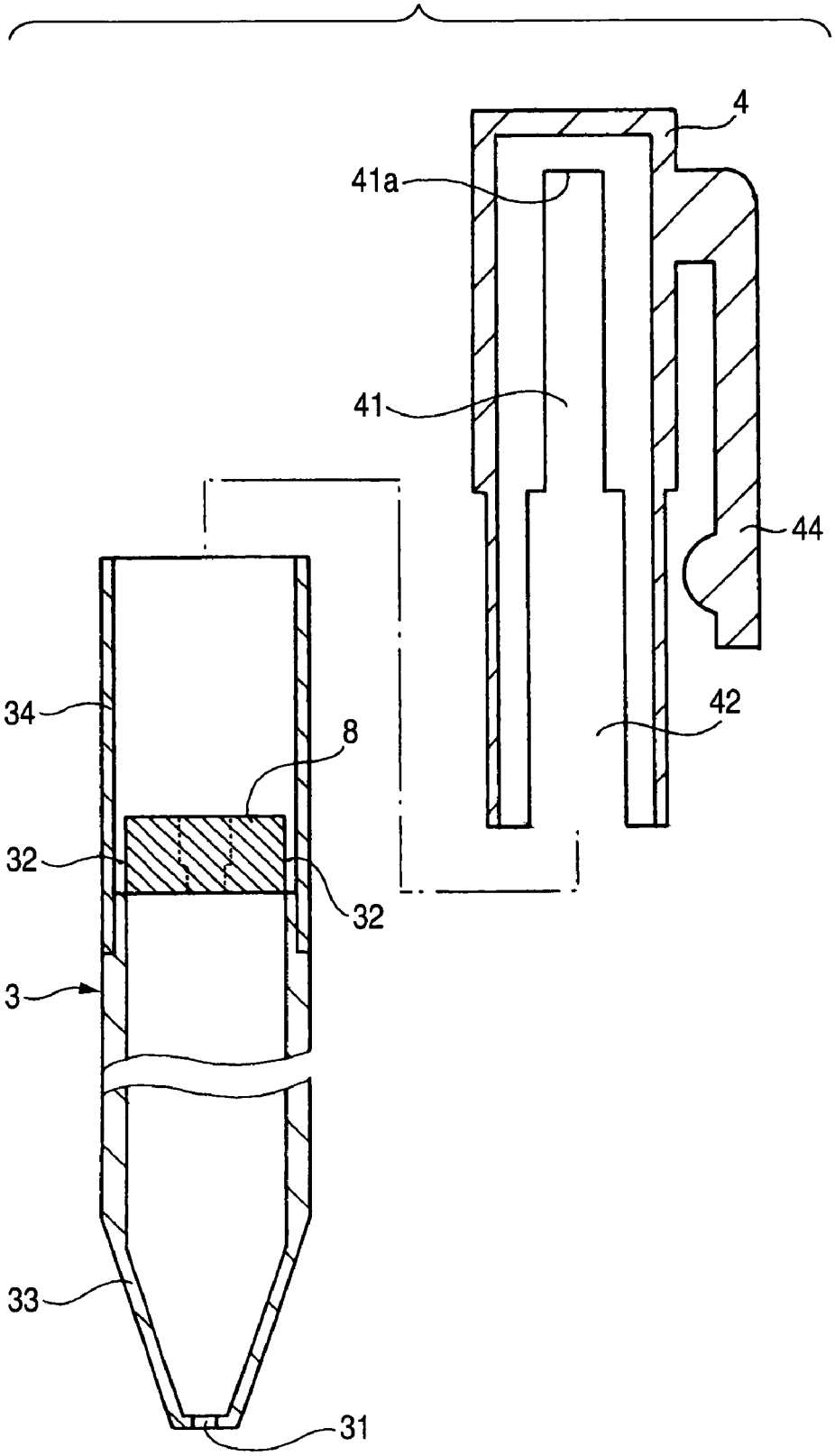
FIG. 56 is a longitudinal cross-sectional view illustrating the multi-refill writing instrument shown in FIG. 54 having a front barrel and a rear barrel separated from each other (however, writing bodies, operating bodies, elastic bodies, and locking wall portions are omitted)

In order to replace the writing bodies 5, the front barrel 3 and the rear barrel 4 connected to each other (see FIG. 54) are separated from each other (see FIG. 56). Then, the operating bodies 6 are pulled out through cut-out portions 42 in front of the window holes 41, and the writing bodies 5 connected to the operating bodies 6 are also pulled out from the front barrel 3 through the rear hole thereof. Subsequently, new writing bodies 5 and new operating bodies 6 connected to each other are inserted into the window holes 41 of the rear barrel 4 through the cut-out portions 42. Then, the new writing bodies 5 connected to the new operating bodies 6 are inserted into the holes 81 of the elastic body supporting portion 8 in the front barrel 3 through the rear opening thereof, while the front end portions of the rear barrel 4 having the cut-out portions 42 formed therein are inserted into and engaged with the engaging holes 32 of the front barrel 3, thereby connecting the front barrel 3 and the rear barrel 4 again (see FIG. 54). In this way, the replacement of the writing bodies 5 and the operating bodies 6 is completed.

Tenth Embodiment

Figure 63:
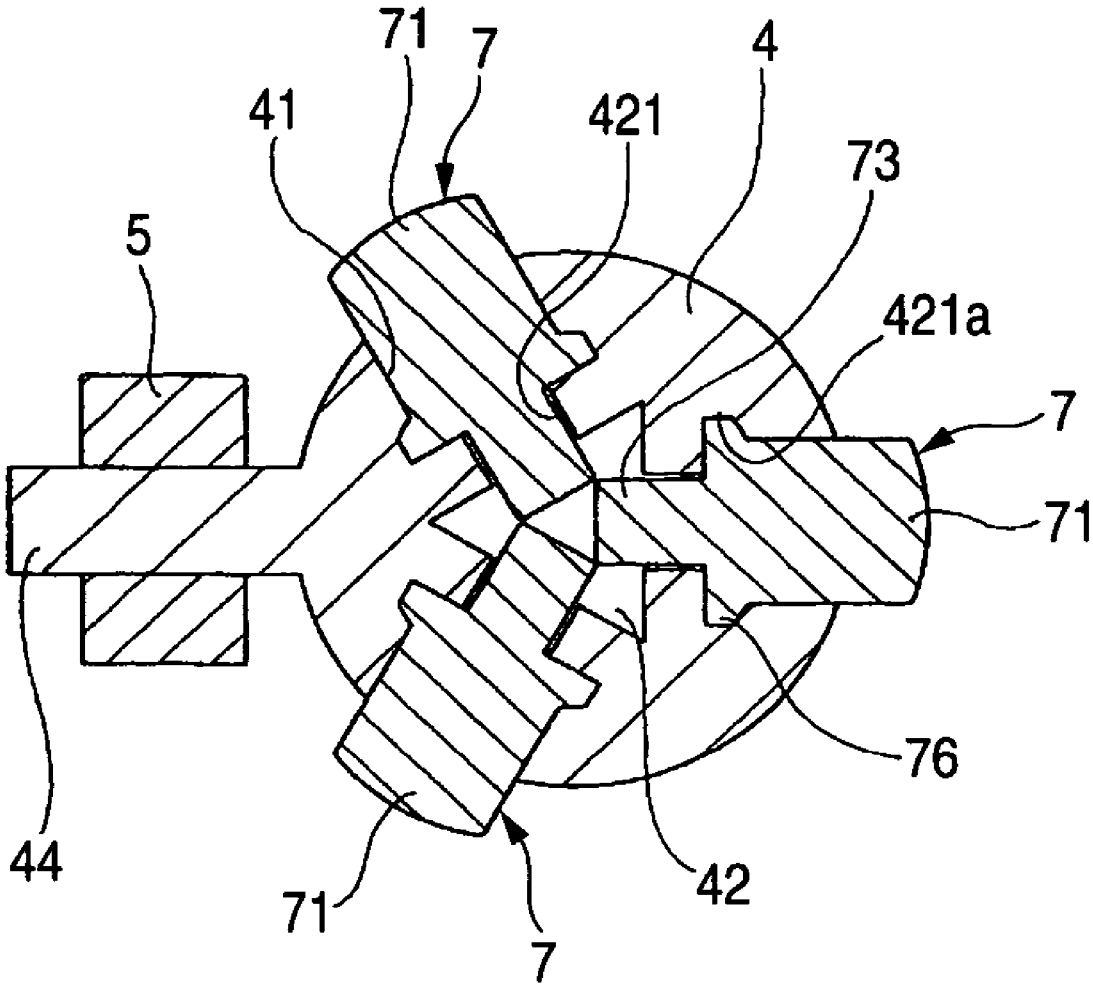
FIG. 63 is a substantial part of enlarged cross-sectional view showing a rear end portion of a barrel according to a multi-refill writing instrument of the tenth embodiment of the invention.
Figure 64:
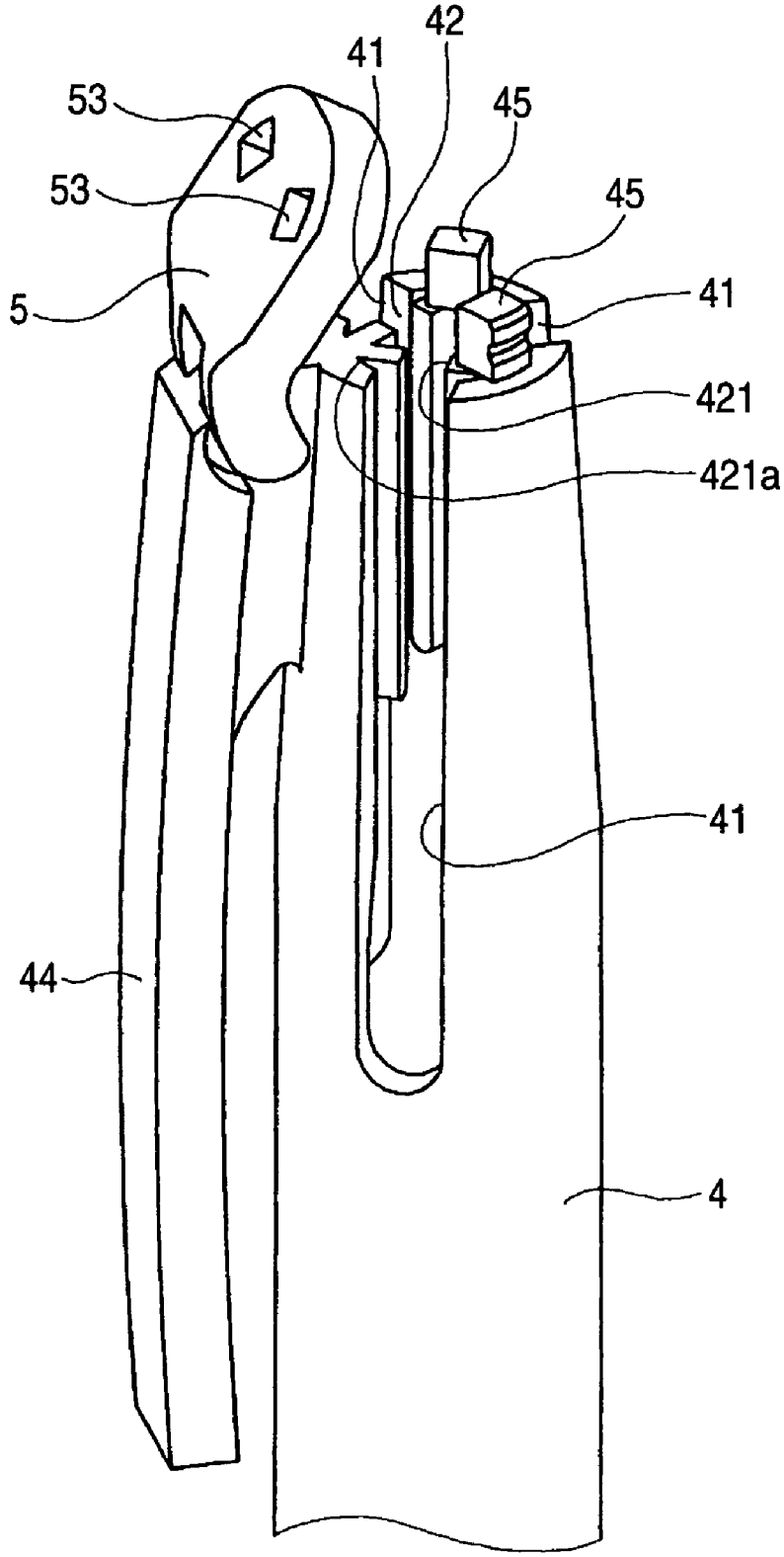
FIG. 64 is a substantial part of perspective view showing a state that an opening portion of a rear end of the multi-refill writing instrument of FIG. 63 is opened.

A tenth embodiment of the invention is shown in FIGS. 63 and 64.

A multi-refill writing instrument 1 according to this embodiment includes three writing bodies 6 accommodated in a barrel 2, which is composed of a front barrel 3 and a rear barrel 4, such that it can move back and forth. Operating bodies 7 are attached to rear ends of the each writing bodies 6. On a rear side wall of the rear barrel 4, three window holes 41 are provided with same intervals (that is, they are separated each other by 120 degree in circumferential direction). Operating portions 71 of the operating bodies 7 protrude from the each window holes 41 to radially outward.

On a rear end wall of the rear barrel 4, an opening portion 42 which communicates with the each window holes 41 are formed. The window holes 41 opens rearward through the opening portion 42. Through the opening portion 42, the writing bodies 6 which is connected with the operating bodies 7 are adapted to be removed from the barrel 2 and also to be inserted into the barrel 2.

The rear end portion of the rear barrel 4 is divided into three in the radial direction by the window holes 41 which opens rearward. On one of divided piece of the rear end portion of the rear barrel which is divided into three, a clip 44 is provided. A lid portion 5 is pivotably attached to a base portion of the clip 44 via a hinge portion 52. On a front surface of the lid portion 5, two engaging portions 53 (more specifically, engaging concave portions or engaging hole portions). Then, on each of the other two divided pieces of the rear end portion of the rear barrel 4 which is divided into three, engaged portions 45 (more specifically, engaged convex portion) which are adapted to engage with the two engaging portion 53 is provided. On each of inner surface of the engaging portions 53, inward projections are formed. On the other hands, each outer surface of the engaged portions 45, outward projections, which are adapted to engage by getting over the inward projection, are formed. Since the other components of this embodiment are the same as that of the first embodiment, detailed explanation is omitted.

Eleventh Embodiment

Figure 65:
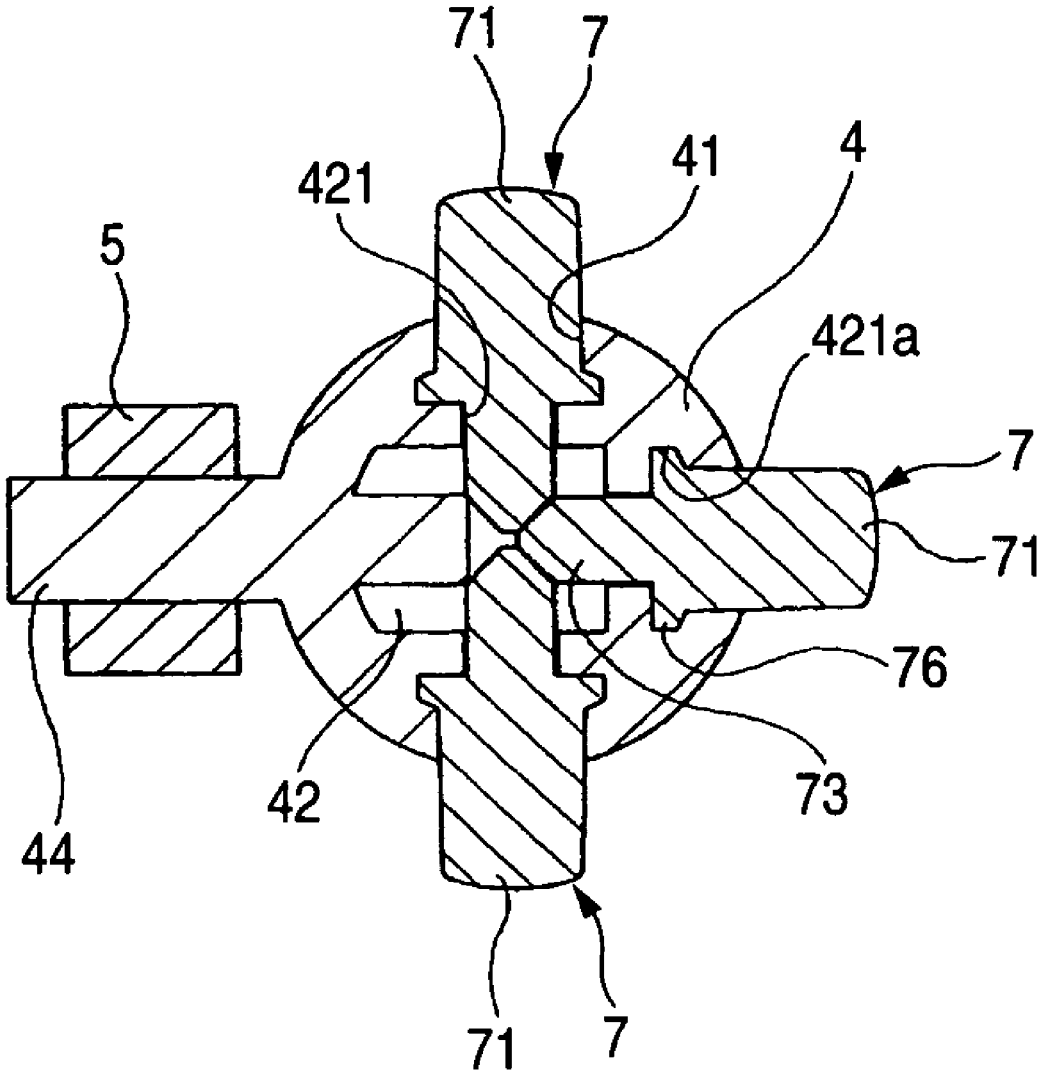
FIG. 65 is a substantial part of enlarged cross-sectional view showing a rear end portion of a barrel according to a multi-refill writing instrument of the eleventh embodiment of the invention.
Figure 66:
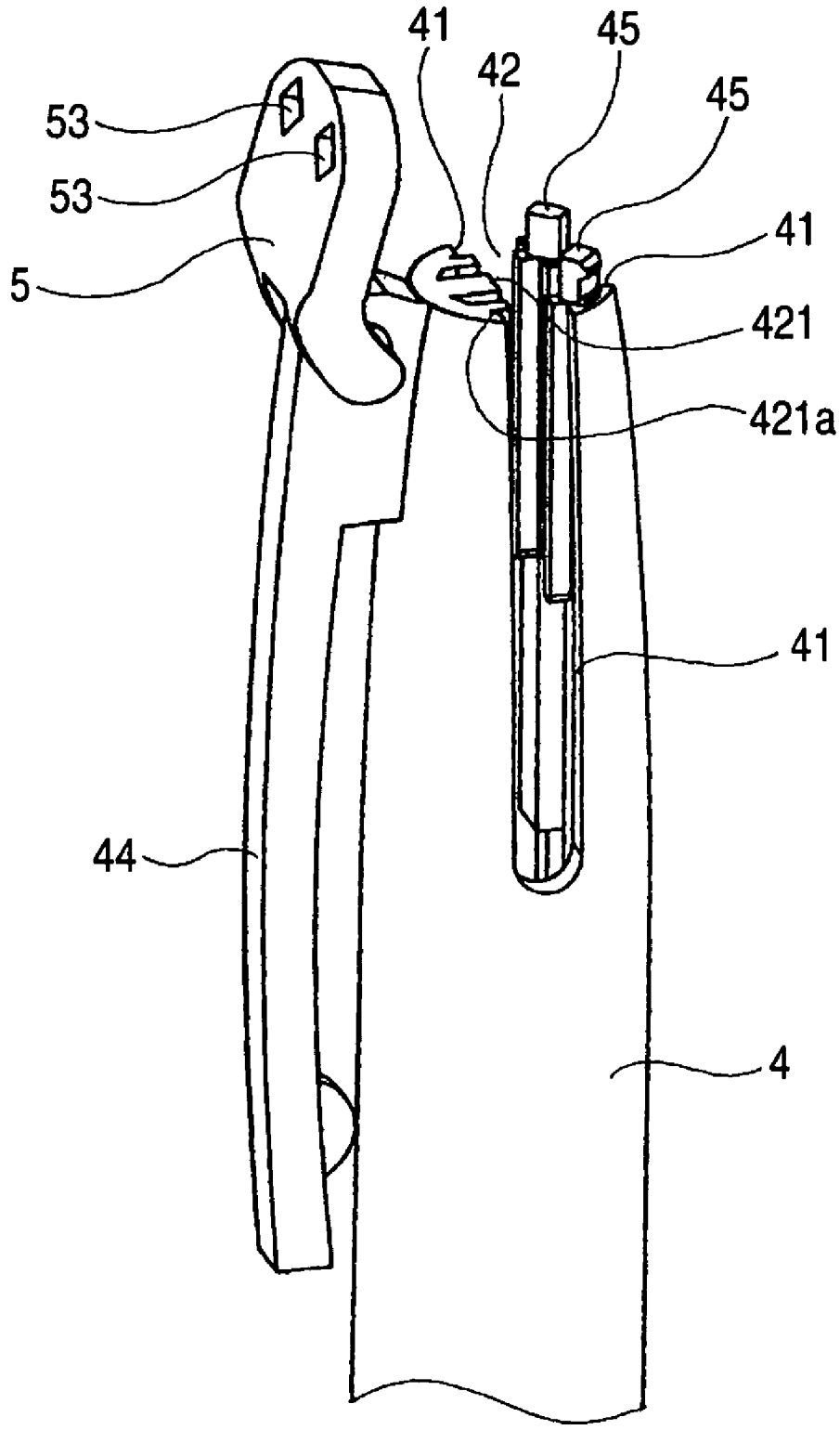
FIG. 66 is a substantial part of perspective view showing a state that an opening portion of a rear end of the multi-refill writing instrument of FIG. 65 is opened.

An eleventh embodiment of the invention is shown in FIGS. 65 and 66.

A multi-refill writing instrument 1 of this embodiment is a modification of the tenth embodiment. The different aspects from the tenth embodiment are that, three window holes 41 and one clip is arranged with same intervals (that is, they are separated each other by 90 degree in circumferential direction), and cross sectional shapes of front projection portions 72 and rear projection portions 73 of the each operating bodies 7 become thinner towards radial inner side in order to avoid interference each other. Since the other components of this embodiment are the same as that of the first and tenth embodiments, detailed explanation is omitted.

Twelfth Embodiment

Figure 67:
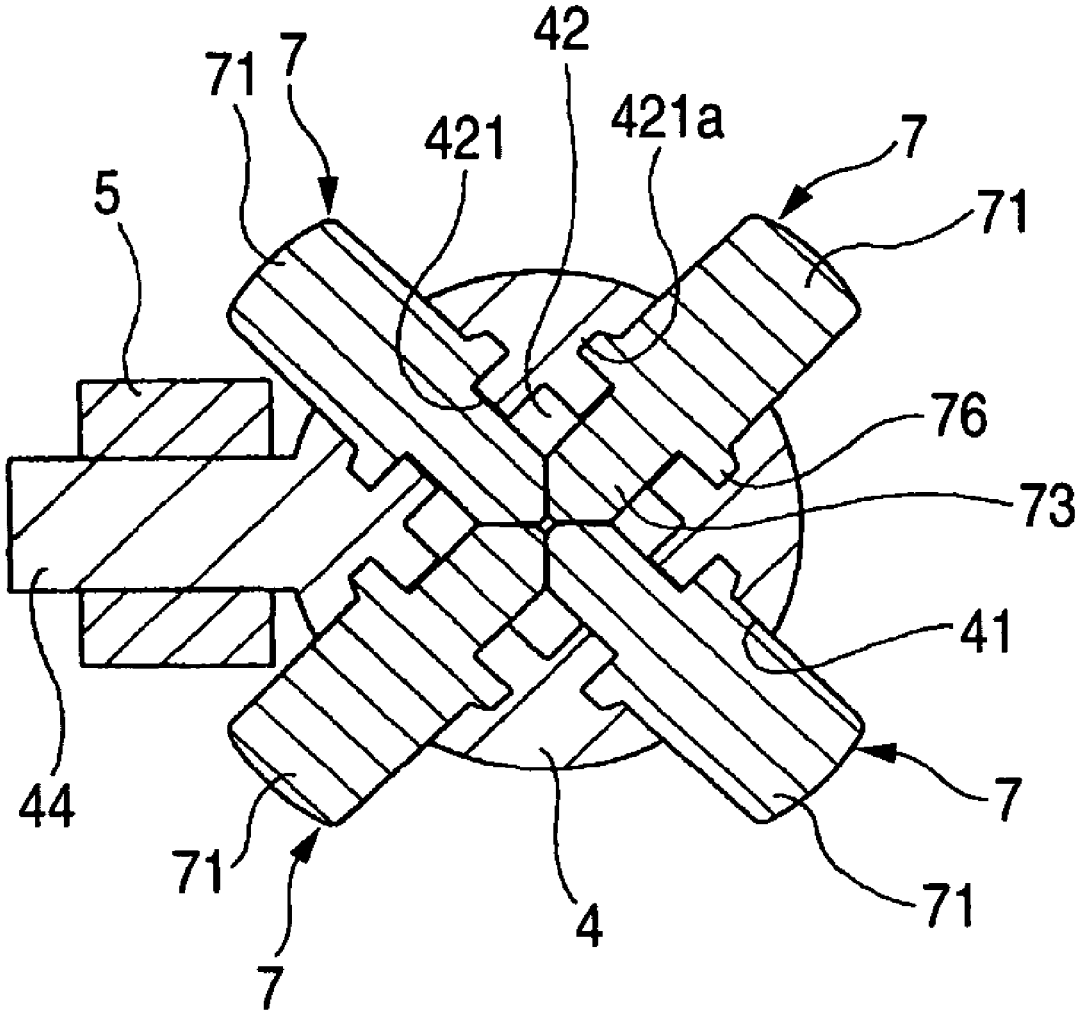
FIG. 67 is a substantial part of enlarged cross-sectional view showing a rear end portion of a barrel according to a multi-refill writing instrument of the twelfth embodiment of the invention.
Figure 68:
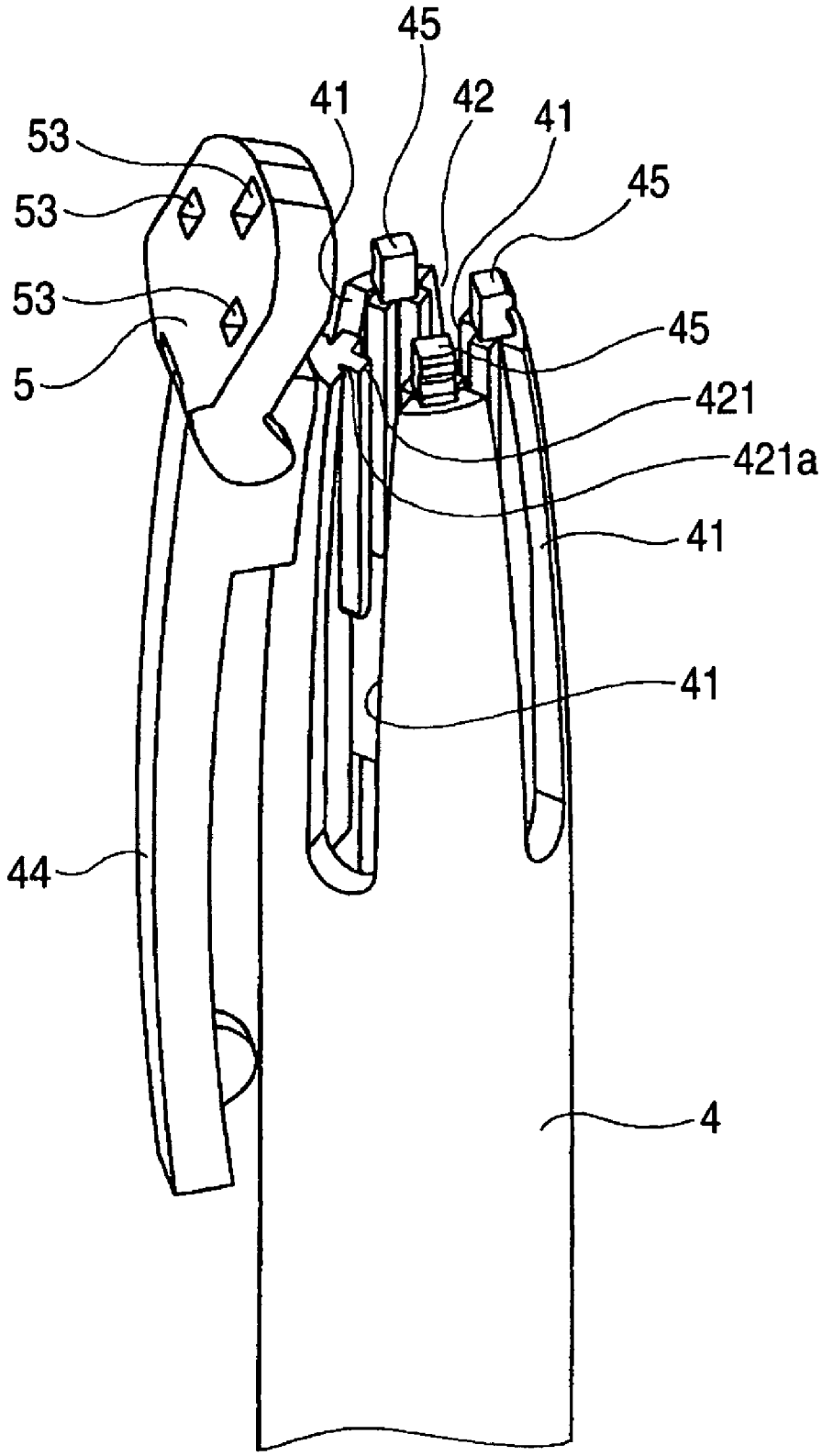
FIG. 68 is a substantial part of perspective view showing a state that an opening portion of a rear end of the multi-refill writing instrument of FIG. 67 is opened.

A twelfth embodiment of the invention is shown in FIGS. 67 and 68.

A multi-refill writing instrument 1 according to this embodiment includes four writing bodies 6 accommodated in a barrel 2, which is composed of a front barrel 3 and a rear barrel 4, such that it can move back and forth. Operating bodies 7 are attached to rear ends of the each writing bodies 6. On a rear side wall of the rear barrel 4, four window holes 41 are provided with same intervals (that is, they are separated each other by 90 degree in circumferential direction). Operating portions 71 of the operating bodies 7 protrude from the each window holes 41 to radially outward.

On a rear end wall of the rear barrel 4, an opening portion 42 which communicates with the each window holes 41 are formed. The window holes 41 opens rearward through the opening portion 42. Through the opening portion 42, the writing bodies 6 which is connected with the operating bodies 7 are adapted to be removed from the barrel 2 and also to be inserted into the barrel 2.

The rear end portion of the rear barrel 4 is divided into four in the radial direction by the window holes 41 which opens rearward. On one of divided piece of the rear end portion of the rear barrel which is divided into four, a clip 44 is provided. A lid portion 5 is pivotably attached to a base portion of the clip 44 via a hinge portion 52. On a front surface of the lid portion 5, three engaging portions 53 (more specifically, engaging concave portions or engaging hole portions). Then, on each of the other three divided pieces of the rear end portion of the rear barrel 4 which is divided into four, engaged portions 45 (more specifically, engaged convex portion) which are adapted to engage with the three engaging portion 53 is provided. On each of inner surface of the engaging portions 53, inward projections are formed. On the other hands, each outer surface of the engaged portions 45, outward projections, which are adapted to engage by getting over the inward projection, are formed.

Further, as well as the eleventh embodiment, cross sectional shapes of front projection portions 72 and rear projection portions 73 of the each operating bodies 7 become thinner towards radial inner side in order to avoid interference each other. Since the other components of this embodiment are the same as that of the first embodiment, detailed explanation is omitted.

[Refill for Multi-Refill Writing Instrument]

FIGS. 57 to 62 show a refill for a multi-refill writing instrument according to an embodiment of the invention.

Figure 57:
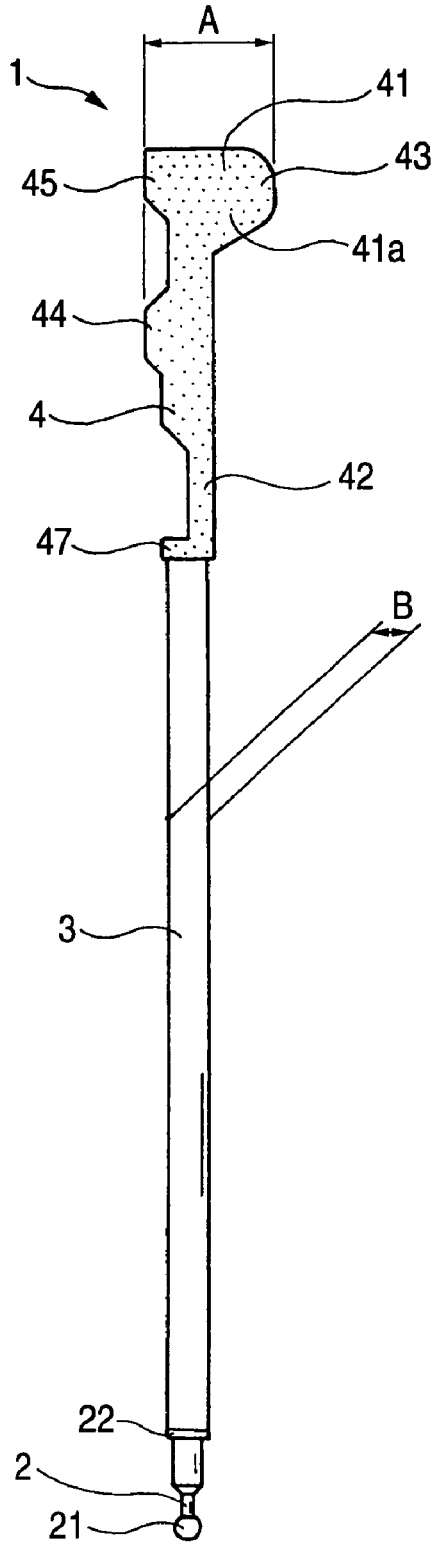
FIG. 57 is a front view illustrating a refill for a multi-refill writing instrument according to the invention.
Figure 58:
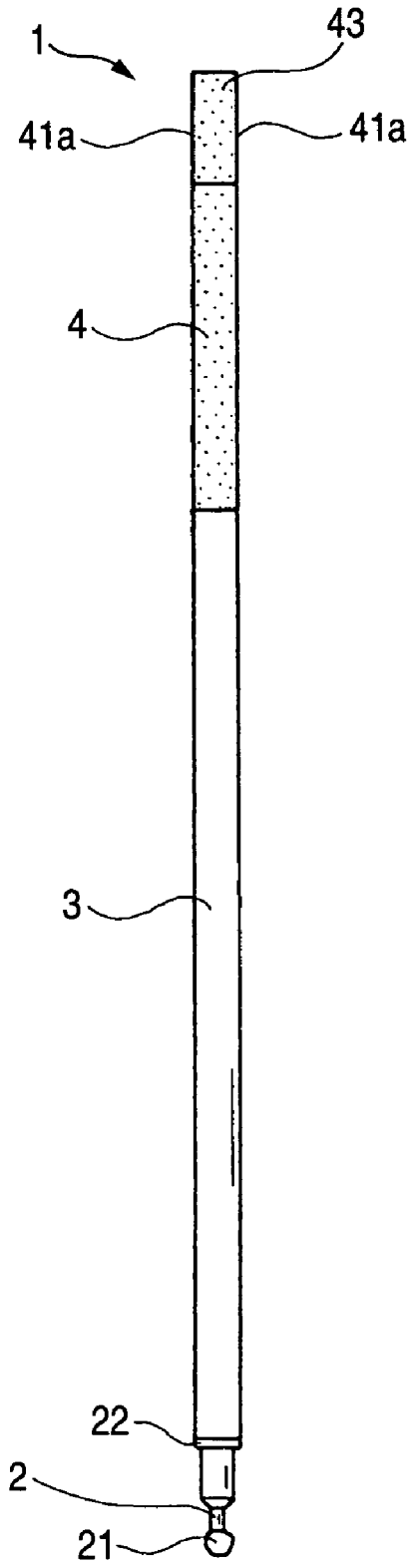
FIG. 58 is a right side view of FIG. 57.

As shown in FIGS. 57 and 58, a refill 1 for a multi-refill writing instrument according to this embodiment has a ballpoint pen tip 2, an ink containing tube 3, and an operating body 4 as main components.

(Ballpoint Pen Tip)

The ballpoint pen tip 2 has a ball rotatably held at a front end thereof. The ballpoint pen tip 2 may be formed by a method of forming a ball holding portion at the leading end of a metallic tubule by pressing the leading end inward, or a method of forming a ball holding portion in the inner surface of the leading end of a metallic tubule by cutting.

A resin film for preventing the dry of the pen tip is fixed to the front end of the ballpoint pen tip 2. The resin film is removed by a user when the writing instrument is used.

In the ballpoint pen tip 2, the ball rotatably held in the leading end thereof may be urged forward by, for example, an elastic member so as to come in close contact with an inner surface of the leading end. In addition, the ballpoint pen tip 2 may be directly fitted to a front opening of the ink containing tube 3 by pressing. However, in this embodiment, the ballpoint pen tip 2 is fixed to the front opening of the ink containing tube 3 with a pen tip holding member 22 made of a synthetic resin interposed therebetween. The pen tip holding member 22 is formed of a synthetic resin having the same color as that of ink contained in the corresponding ink containing tube.

(Operating Body)

The operating body 4 is fitted into a rear opening of the ink containing tube 3. The operating body 4 includes an operating portion 43, a front protruding portion 44, a rear protruding portion 45, a fitting portion 46, and a flange portion 46. The operating portion 43 is provided at the rear end of the operating body 4 so as to protrude from a barrel 6 to the outside through a window hole 81. The rear protruding portion 45 is provided on the opposite side of the operating portion 43. The front protruding portion 44 is provided in front of the rear protruding portion 45 disposed on the opposite side of the operating portion 43. The fitting portion 46 is formed at the front end of the operating body 4 and is fitted into the rear opening of the ink containing tube 3. The flange portion 47 is formed on the rear side of the fitting portion 46.

When the fitting portion 46 is fitted into the rear opening of the ink containing tube 3, it does not cover the entire rear opening of the ink containing tube 3 such that air can pass between the inner side and the outer side of the ink containing tube 3. In addition, the rear end of an elastic body 10 is locked to the front surface of the flange portion 47.

(Large-diameter Portion)

In this embodiment, the operating portion 43, the front protruding portion 44, and the rear protruding portion 45 form a large-diameter portion 41. A diameter A of the large-diameter portion 41 is set to be larger than a diameter B of the ink containing tube 3. More specifically, it is preferable that the diameter A of the large-diameter portion 41 is set to be two or more times larger than the diameter B of the ink containing tube 3. The large-diameter portion 41 is formed of a plate member having flat portions 41*a* on both surfaces thereof (that is, front and rear surfaces). The plate-shaped large-diameter portion 41 has a thickness substantially equal to the external diameter of the ink containing tube 3. In addition, retaining projections (not shown) are formed on both side walls of the operating body 4 (the flat portions 41*a* of the large-diameter portion 41). The retaining projections can engage with the inner surfaces of both side walls of the window hole 81.

A small-diameter portion 42 having a smaller diameter than that of the large-diameter portion 41 is formed between the flange portion 47 and the large-diameter portion 41 (that is, on the rear side of the flange portion 47 and on the front side of the large-diameter portion 41). In addition, the small-diameter portion 42 has a diameter smaller than the diameter B of the ink containing tube 3. In this way, when viewing the operating body 4, it is possible to make the large-diameter portion 41 more conspicuous. The large-diameter portion 41 and the small-diameter portion 42 appear to be a flag and a flagpole, which makes it possible to improve the appearance of the operating body 4 serving as an ink color display portion.

The operating body 4 has substantially the same color as that of the ink contained in the ink containing tube 3 connected thereto. More specifically, the operating body 4 is formed of a synthetic resin having substantially the same color as that of the ink contained in the ink containing tube 3 connected thereto. In this way, the operating bodies 4 serve as ink color display portions. For example, the operating body 4 connected to the ink containing tube 3 containing a black ink therein is colored black, and the operating body 4 connected to the ink containing tube 3 containing a blue ink therein is colored blue. In addition, the operating body 4 connected to the ink containing tube 3 containing a red ink therein is colored red, and the operating body 4 connected to the ink containing tube 3 containing a green ink therein is colored green.

(Ink Containing Tube)

The ink containing tube 3 is obtained by performing extrusion molding on a transparent or semi-transparent synthetic resin, and is composed of a cylindrical member whose both ends are opened. An aqueous dye ink having shear thinning viscosity is contained in the ink containing tube 3, and a follower which is advanced with the consumption of ink is filled into the rear end of the ink.

(Visible Area)

In this embodiment, the flat portion 41*a* of the large-diameter portion 41 has the maximum area in the operating body 4 (see FIG. 57). In FIG. 57, the visible area of the operating body 4 is set to 38% of the visible area of the ink containing tube 3.

(Packing Bag)

Figure 59:
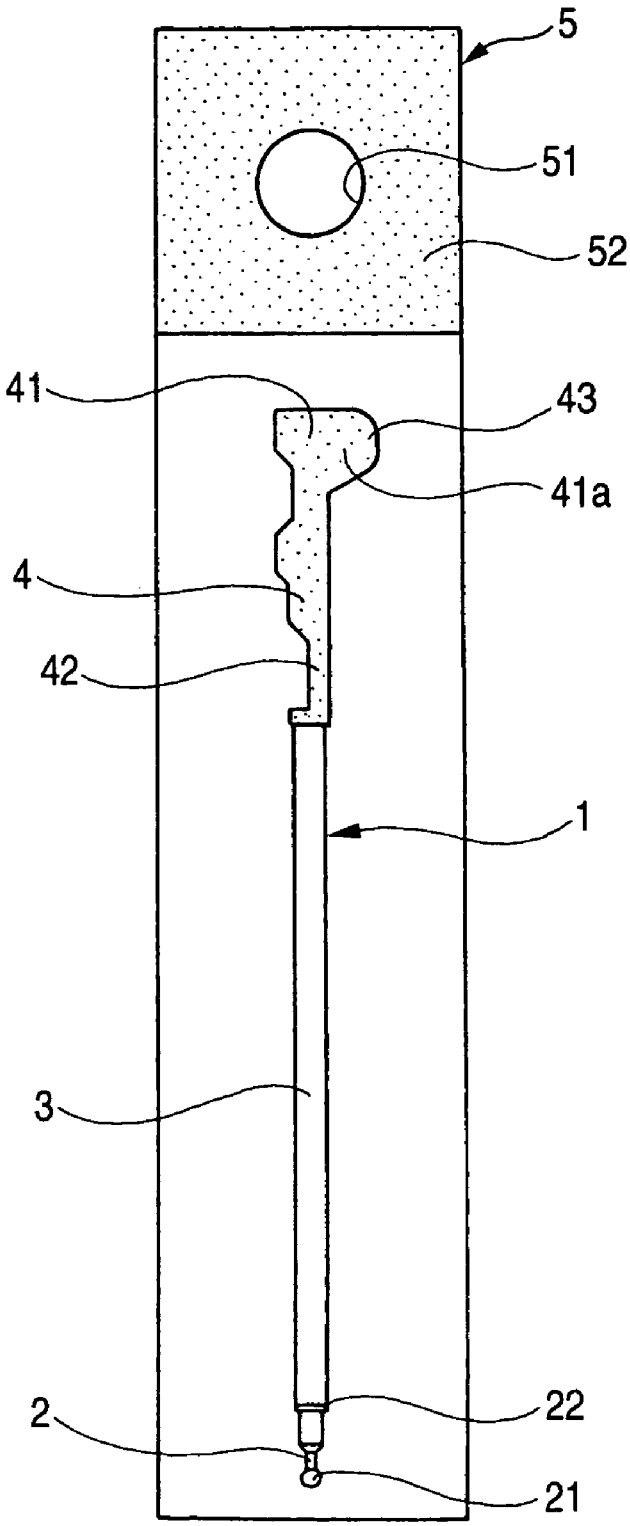
FIG. 59 is a front view illustrating a packing bag having the refill for a multi-refill writing instrument shown in FIG. 57 accommodated therein.
Figure 60:
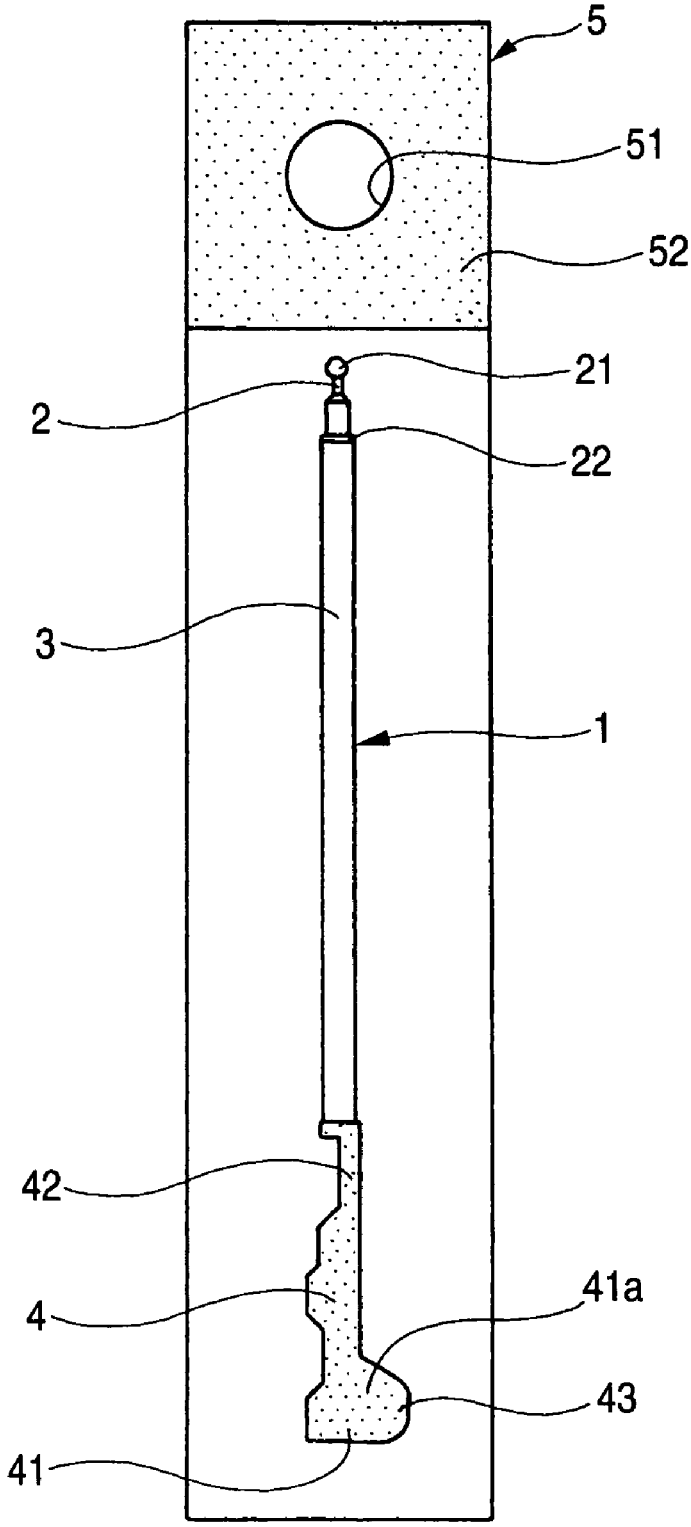
FIG. 60 is a front view illustrating a packing bag having the refill for a multi-refill writing instrument shown in FIG. 57 accommodated therein.

FIGS. 59 and 60 show a packing bag 5 having the refill 1 for a multi-refill writing instrument shown in FIGS. 57 and 58 accommodated therein. The refill 1 for a multi-refill writing instrument is accommodated in the packing bag 5 that has a rectangular shape and is made of a transparent material (a transparent plastic film). One refill 1 for a multi-refill writing instrument is accommodated in one packing bag 5, which makes it possible for a user to freely select a refill having an ink color that the user wants to buy and to combine the refill with the multi-refill writing instrument.

A hanging hole 51 is formed at one end of the packing bag 5. A colored portion 52 is provided in the periphery of the hanging hole 51 on the surface of the packing bag 5 (that is, a head portion having the hanging hole 51), and the colored portion 52 is colored in the same color as that of the ink contained in the refill 1 for a multi-refill writing instrument.

As shown in FIG. 59, the refill 1 for a multi-refill writing instrument is accommodated in the packing bag 5, with the operating body 4 positioned close to the hanging hole 51 and the ballpoint pen tip 2 positioned on the opposite side of the hanging hole 51. Therefore, the packing bag 5 is hung with the ballpoint pen tip 2 facing downward and the operating body 4 facing upward.

As shown in FIG. 60, the refill 1 for a multi-refill writing instrument is accommodated in the packing bag 5, with the ballpoint pen tip 2 positioned close to the hanging hole 51 and the operating body 4 positioned on the opposite side of the hanging hole 51. Therefore, the packing bag 5 is hung with the operating body 4 facing downward and the ballpoint pen tip 2 facing upward. As a result, there is no fear that ink may leak from a leading end of the ballpoint pen tip 2. In FIG. 60, there is no fear that an end portion of the packing bag 5 opposite to the hanging hole 51 may be damaged by the leading end of the ballpoint pen tip 2. In addition, in FIG. 60, since an opening/closing portion is provided at the end portion of the packing bag 5 opposite to the hanging hole 51, it is possible to easily put the refill into the packing bag 5 or take it out from the packing bag 5 through the opening/closing portion by using the operating body 4, without damaging the leading end of the ballpoint pen tip 2.

The refill 1 for a multi-refill writing instrument is accommodated in the packing bag 5 such that the flat portion 41*a* (having the maximum visible area) of the plate-shaped large-diameter portion 41 of the operating body 4 is arranged in a direction where the outer surface of the packing bag 5 is viewed. In this way, the thickness of a portion of the packing pack 5 having the operating body 4 accommodated therein does not increase, which makes it possible to pile up a plurality of packing bags 5 having the refills 1 for a multi-refill writing instrument therein in a limited space for storage.

When purchasing the refills 1 for a multi-refill writing instrument, each accommodated in the packing bag 5, displayed in a shop, the user can simultaneously view the operating body 4 and the colored portion 52 having the same color as that of ink and thus discriminate the colors of ink at a relatively long distance.

Figure 61:
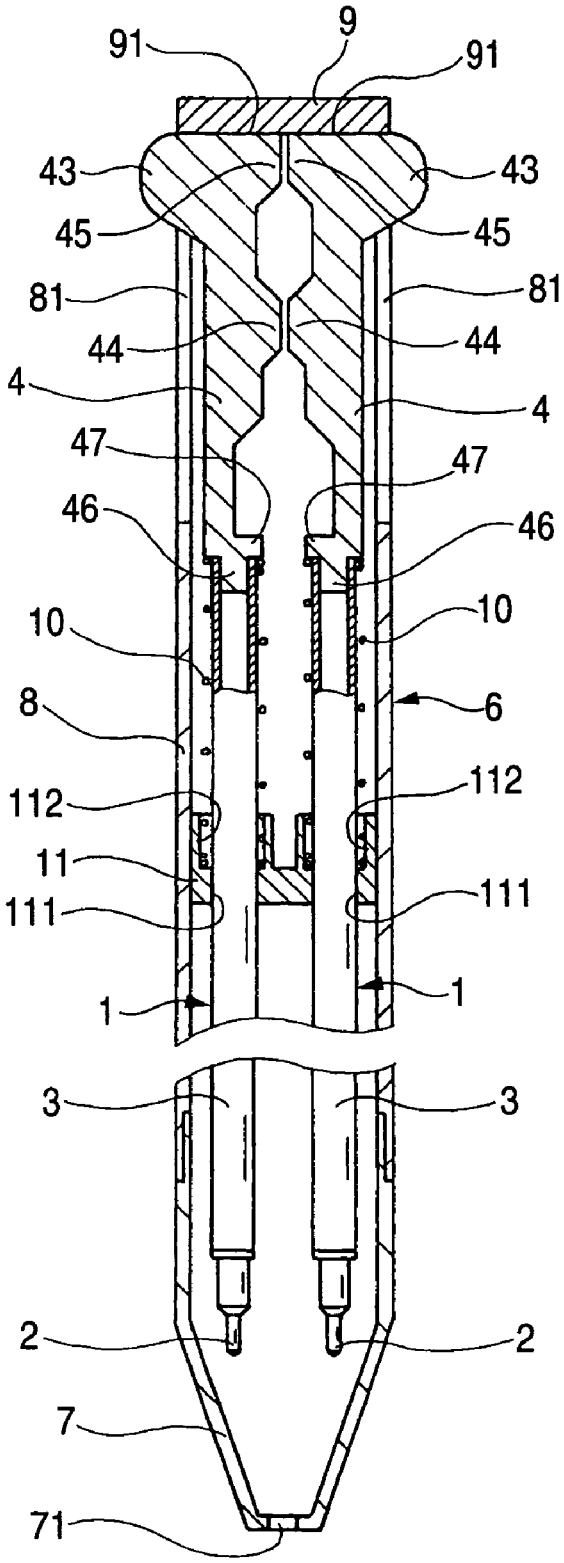
FIG. 61 is a longitudinal cross-sectional view illustrating the retracted state (at the time of non-writing) of pen tips of a plurality of refills accommodated in the multi-refill writing instrument shown in FIG. 57.
Figure 62:
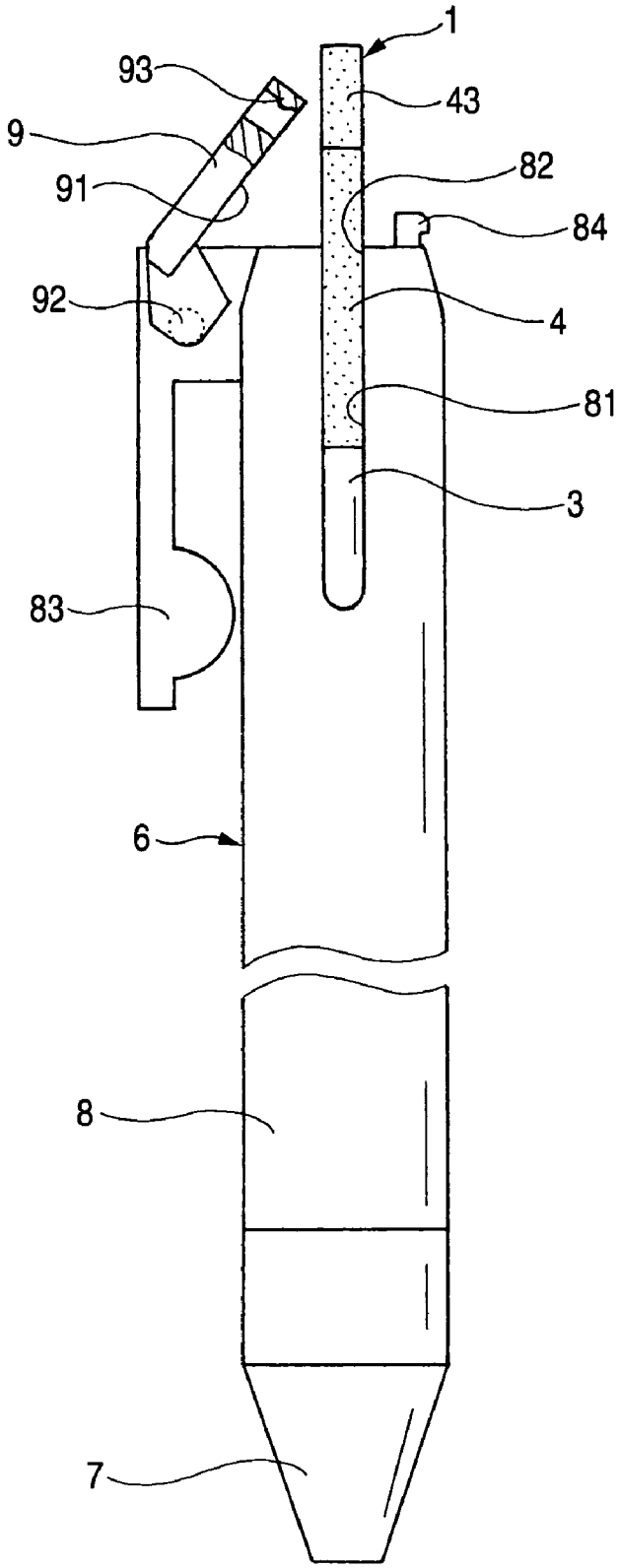
FIG. 62 is a side view illustrating a state in which a lid portion closes up a rear opening portion of the multi-refill writing instrument shown in FIG. 61.

FIG. 61 shows a barrel 6 of a multi-refill writing instrument having the refills 1 accommodated therein in this embodiment.

A plurality of refills (for example, two refills) 1 having different ink colors are accommodated in the multi-refill writing instrument such that they can move forward and backward. The refills 1 for the multi-refill writing instrument are urged backward by elastic bodies 10 (more specifically, compression coil springs).

The barrel 6 includes a front barrel 7 composed of a tapered cylinder and a cylindrical rear barrel 8 that is screwed to the rear end of the front barrel 7 or is fitted thereinto by pressing. A front hole 71 is provided in the front end of the front barrel 7 in the axial direction such that the ballpoint pen tip 2 of the refill 1 can protrude through the hole. The front barrel 7 and the rear barrel 8 are obtained by performing injection molding on a synthetic resin (for example, polycarbonate).

A plurality of elongating window holes (for example, two elongating window holes) 81 extending in the axial direction are provided in the radial direction in the side wall of the rear part of the rear barrel 8. The two window holes 81 are formed so as to be symmetric with respect to an axis line. In addition, an opening portion 82 is formed in the rear end of the rear barrel 8 in the axial direction. The opening portion 82 communicates with the window holes 81 at the rear end of the rear barrel 8 (that is, the rear end of the barrel 6). In this way, the rear ends of the window holes 81 are cut out, so that the rear ends of the window holes 81 are opened. Meanwhile, the front ends of the window holes 81 are always closed. The operating portions 43 of the operating bodies 4 protrude from the barrel through the window holes 81 to the outside in the radial direction.

Locking wall portions composed of ribs extending in the axial direction are formed on the inner surfaces of the side walls between the window portions 81 of the rear barrel 8. When the ballpoint pen tip protrudes from the barrel, the rear end of the operating body 4 of the refill 1 for a multi-refill writing instrument is locked to the locking wall portion.

A clip 83 is provided on the outer surface of the side wall between the window holes 81 of the rear barrel 8.

An openable lid portion 9 that closes the opening portion 82 is pivotally provided at the rear end of the rear barrel 8. One end of the lid portion 9 is pivotably connected to the base of the clip through a hinge portion 92. The hinge portion 92 extends in the right and left directions of the clip 83 as viewing the front side of the clip 83 from the downward direction of the ballpoint pen tip, and thus the lid portion 9 is pivotably moved substantially in the axial direction. An abutting wall portion 91 is formed oh the front surface of the lid portion 9. The rear ends of the operating bodies 4 connected to the rear ends of the refills 1 for a multi-refill writing instrument whose ballpoint pen tips are in the retracted state come in contact with the abutting wall portion 91. In this embodiment, more specifically, the lid portion is pivotably connected to the rear barrel using the hinge portion 92 as a rotational shaft. Note that, the lid portion may be integrally connected to the clip by a flexible connecting portion or a flexible thin portion.

An engaging portion 93 is provided on the front surface of the other end of the lid portion 9 (more specifically, an engaging concave portion or an engaging hole portion is formed). An engaged portion 84 that can engage with the engaging portion 93 is provided at the rear end of the rear barrel 8 (more specifically, an engaging convex portion is provided). An inward projection is formed on the inner surface of the engaging portion 93 (the engaging concave portion or the engaging hole portion), and an outward projection that can be fitted into the inward projection is formed on the outer surface of the engaged portion 84 (the engaging convex portion).

When the lid portion 9 closes up the opening portion 82, the engaging portion 93 and the engaged portion 84 are engaged with each other (more specifically, the outward projection is fitted into the inward projection), and rearwardly urging force is generated by the elastic body 10 causes the operating body 4 to come in contact with the abutting wall portion 91 of the lid portion 9. The lid portion 9 is not opened as long as the engaged state is not released.

The structure of the engaging portion 93 and the engaged portion 84 is not limited to the above. For example, the engaging portion 93 may be composed of the engaging convex portion, and the engaged portion 84 may be composed of the engaging concave portion or the engaging hole portion.

When the ballpoint pen tip of the refill 1 is in a retracted state, the rear end of the operating body 4 mounted to the rear end of the refill 1 comes in contact with the abutting wall portion 91 formed on the front surface of the lid portion 9. On the other hand, when the ballpoint pen tip of the refill 1 protrudes from the barrel, the rear end of the operating body 4 mounted to the rear end of the refill 1 is locked to a locking wall portion formed on the inner wall of the barrel 6.

When the operating portion 43 of the operating body 4 is operated to slide forward, the front protruding portion 44 of the operating body 4 connected to the rear end of the refill for a multi-refill writing instrument whose tip is in the retracted state comes in contact with the rear protruding portion 45 of the operating body 4 connected to another refill 1 for a multi-refill writing instrument whose tip protrudes from the barrel, which causes the protruding state of the tip of another refill 1 for a multi-refill writing instrument to be released.

(Elastic Body Supporting Portion)

An elastic body supporting portion 11 having a cylindrical shape is provided on the inner wall of the barrel 6 (that is, the inner wall of the rear barrel 8). A plurality of holes (for example, two holes) 111 through which the ink containing tubes 3 of the refills for a multi-refill writing instrument pass are formed in the elastic body supporting portion 11 in the axial direction. The elastic bodies 10 are arranged between the rear surface of the elastic body supporting portion 11 and the front surfaces of the flange portions 47 of the operating bodies 4. The ink containing tubes 3 of the refills 1 for a multi-refill writing instrument pass through the elastic bodies 10, and the front ends of the elastic bodies 10 are locked by the rear surface of the elastic body supporting portion 11. In addition, the rear ends of the elastic bodies 10 are locked to the front surfaces of the flange portions 47 of the operating bodies 4.

Holding portions 112, each composed of a cylindrical protruding portion that projects backward, are formed in the rear surface of the elastic body supporting portion 11 in the peripheries of the holes 111. The inner surfaces of the holding portions 112 hold the outer surfaces of the front end portions of the elastic bodies 10. In this way, when replacing the refills 1 for a multi-refill writing instrument, it is possible to prevent the elastic bodies 10 from falling off from the barrel 6 through the opening portion 82.

The elastic bodies 10 always urge the corresponding operating bodies 4 (that is, the refills 1 for a multi-refill writing instrument) backward. The elastic bodies 10 are compressed when the ballpoint pen tips are retracted and when they protrude from the barrel (that is, the refills 1 for a multi-refill writing instrument are urged toward the rear side), which makes it possible to the operating bodies 4 from being rattled in the axial direction.

(Replacement of Refill)

Next, the replacement of refills for a multi-refill writing instrument (see FIGS. 57 and 58) according to this embodiment will be described below. In order to replace the refills 1 for a multi-refill writing instrument, in a state in which the lid portion 9 closes up the rear opening portion 82 of the barrel 6, an operating end portion of the lid portion 9 opposite to the hinge portion 92 is pushed backward to release engagement between the engaging portion 93 and the engaged portion 84, thereby pivoting the lid portion 9 backward. Then, the rear opening portion 82 of the barrel 6 is exposed (see FIG. 62). When the opening portion 82 is opened, the operating bodies 4 protrude backward through the opening portion 82 by the urging force of the elastic bodies 10. The operating bodies 4 are pulled out from the rear end of the barrel 6 through the opening portion 82 (see FIG. 62), causing the refills 1 for a multi-refill writing instrument to be pulled out from the barrel 6 through the opening portion 82. Then, new refills 1 for a multi-refill writing instrument are inserted into the barrel 6 through the opening portion 82. Subsequently, the lid portion 9 is pivoted forward to press the operating bodies 4 forward, with the rear ends of the inserted operating bodies 4 coming in contact with the abutting wall portion 91 of the lid portion 9. Thereafter, the engaging portion 93 is engaged with the engaged portion 84 to close up the opening portion 82. In this way, the replacement of the refills 1 for a multi-refill writing instrument is completed.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A multi-refill writing instrument comprising:

a barrel;

a plurality of writing bodies accommodated in the barrel so as to be movable in a axial direction of the barrel;

a plurality of elastic bodies urging the writing bodies backward;

a plurality of operating bodies connected to rear ends of the corresponding writing bodies; and a plurality of window holes formed in a side wall of the barrel so as to extend in the axial direction, an opening portion, which is adapted to be opened and closed, is formed in a rear end of the barrel so that the window holes are opened rearward, and wherein the operating bodies protrude from the barrel to an outside through the window holes in the radial direction, one of the operating bodies slides forward along the window hole so that a nib of the writing body connected to the one operating body protrudes from the barrel through a front hole, and simultaneously, a nib of another writing body in a protruding state is retracted into the barrel, the writing bodies and the operating bodes are adapted to be pulled out from the barrel and to be inserted into the barrel, the writing bodies are adapted to be pulled out from the barrel for replacement, and the operating bodies are adapted to be pulled out from the barrel and to be inserted into the barrel through the opening portion.

2. The multi-refill writing instrument according to claim 1, wherein the writing bodies and the operating bodies are adapted to be pulled out from the barrel and to be inserted into the barrel through the opening portion.

3. The multi-refill writing instrument according to claim 2, wherein the writing bodies and the operating bodies connected to each other are adapted to be pulled out from the barrel and to be inserted into the barrel through the opening portion.

4. The multi-refill writing instrument accordingly to claim 1, wherein the writing bodies and the operating bodies connected to each other are adapted to be pulled out from the barrel and to be inserted into the barrel.

5. The multi-refill writing instrument according to claim 1, wherein an abutting wall portion is formed at the rear end of the barrel so as to contact with the operating bodies of the writing bodies whose nibs are in the retracted state when the opening portion is closed, and when the opening portion is opened, at least a part of the abutting wall portion is detached from the rear end of the barrel.

6. The multi-refill writing instrument according to claim 1, wherein, when the opening portion is opened, the operating bodies in the retracted state protrude from the barrel to the outside through the opening portion by urging force of the elastic bodies.

7. The multi-refill writing instrument according to claim 1, further comprising:

an elastic body supporting portion provided on an inner wall of the barrel, the front end of the elastic body contacting with the elastic body supporting portion in the axial direction, wherein a holding portion for holding the front end of the elastic body in the radial direction are formed in the elastic body supporting portion.

8. The multi-refill writing instrument according to claim 1, further comprising:

guide portions provided on both inner walls of the opening portion at the rear end of the barrel so as to regulate an inserting direction of side surfaces of the operating body.

9. The multi-refill writing instrument according to claim 1, further comprising:

a lid portion provided at the rear end of the barrel so as to open and close the opening portion.

10. The multi-refill writing instrument according to claim 9, wherein an abutting wall portion is formed on a front surface of the lid portion so as to contact with the operating bodies of the writing bodies in the retracted state.

11. The multi-refill writing instrument according to claim 10, wherein the lid portion closes the opening portion while pressing the operating bodies forward.

12. The multi-refill writing instrument according to claim 9, wherein a portion of the lid portion is pivotably connected to the rear end of the barrel.

13. The multi-refill writing instrument according to claim 12, wherein an engaging portion is provided at the other end of the lid portion, which is other than the portion to which the rear end of the barrel pivotably connects, and an engaged portion which engages with the engaging portion of the lid portion is provided at the rear end of the barrel.

14. The multi-refill writing instrument according to claim 9, wherein the lid portion closing the opening portion is detachably screwed to the rear end of the barrel.

15. The multi-refill writing instrument according to claim 14, wherein a female screw portion is provided on an inner peripheral surface of the lid portion, and a male screw portion engaged with the female screw portion is provided on an outer peripheral surface of the rear end of the barrel.

16. The multi-refill writing instrument according to claim 9, wherein at least two engaging portions are provided on the lid portion, and engaged portions engaged with the engaging portions are provided on the rear end portions of the barrel which are divided in the radial direction by the opening portion.

17. The multi-refill writing instrument according to claim 16, wherein the engaging portions are provided on the inner surface of the lid portion, and the engaged portions are provided on the outer surface of the rear end of the barrel.

18. The multi-refill writing instrument according to claim 16, wherein the abutting wall portion is inserted into the opening portion to regulate an inward deformation of the inner wall of the opening portion.

19. The multi-refill writing instrument according to claim 16, wherein the lid portion includes:

a main body; and at least two leg portions which protrude forward from the main body, wherein engaging portions are formed in an inner surfaces of the leg portions in the radial direction thereof, and engaged portions, with which the engaging portions engage in the axial direction by getting over the engaging portions, are formed on the outer surfaces of the side walls of the rear end of the barrel.

20. The multi-refill writing instrument according to claim 16, wherein the lid portion includes:

a main body; and at least two leg portions which protrude forward from the main body, wherein engaging portions are formed in an inner surfaces of the leg portions in the radial direction thereof, and engaged portions, with which the engaging portions slidably engage in the radial direction, are formed on both sides of the opening portion at the rear end of the barrel.

21. The multi-refill writing instrument according to claim 16, wherein the lid portion includes:

a main body; and two engaging portions which are formed on both sides of the main body in the radial direction, wherein engaged portions are formed on both sides of the opening portion of the rear end of the barrel, and the engaging portions and the engaged portions are engaged with each other by rotating the lid portion with respect to the rear end of the barrel in the circumferential direction.

22. The multi-refill writing instrument according to claim 1, wherein the operating bodies have the same colors as those of ink contained in the writing bodies connected thereto.

23. The multi-refill writing instrument according to claim 1, wherein at least one part of a peripheral wall of each of the window holes is separable from the barrel in the radial direction, and when the at least one part of the peripheral wall of each of the window holes is separated from the barrel in the radial direction, the operating bodies are adapted to be pulled out from the barrel and to be inserted into the barrel through the separated part of the peripheral wall of each of the window holes.

24. The multi-refill writing instrument according to claim 23, wherein the operating bodies and the writing bodies are adapted to be pulled out from the barrel and to be inserted into the barrel through the separated part of the peripheral wall of each of the window holes.

25. The multi-refill writing instrument according to claim 23, wherein a front end and/or a rear end of the peripheral wall of each of the window holes are separable in the radial direction, and the window holes are opened forward or backward by separating the front ends or the rear ends of the peripheral walls of the window holes in the radial direction.

26. The multi-refill writing instrument according to claim 23, wherein, as the rear ends of the peripheral walls of the window holes are separated in the radial direction, side walls of the rear end of the barrel are separated from each other in the radial direction, the lid portion is detachably mounted to the side walls of the rear end of the barrel, and the side walls of the rear end of the barrel are incorporated with each other by mounting the lid portion to the side walls of the rear end of the barrel.

27. The multi-refill writing instrument according to claim 23, wherein the operating bodies and the writing bodies connected to each other are adapted to be pulled out from the barrel and to be inserted into the barrel.

28. The multi-refill writing instrument according to claim 1, wherein the barrel includes:

a front barrel which has a front hole at a front end thereof; and a rear barrel which is detachably connected to a rear end of the front barrel, the rear barrel has the window holes and cut-out portions for opening the window holes forward, when the rear barrel is separated from the front barrel, the operating bodies are adapted to be pulled out from the barrel and to be inserted into the barrel through the cut-out portions.

29. The multi-refill writing instrument according to claim 28, wherein the operating bodies and the writing bodies connected to each other are adapted to be pulled out from the barrel and to be inserted into the barrel.

30. The multi-refill writing instrument according to claim 28, wherein a front end portion of the rear barrel is divided into a plurality of parts by the cut-out portions, and a plurality of engaging holes into which the front end portions of the rear barrel are adapted to be inserted are provided in the front barrel.

31. The multi-refill writing instrument according to claim 30, wherein an elastic body supporting portion contacting with the front ends of the elastic bodies in the axial direction is provided on an inner wall of the front barrel, and the engaging holes are formed between an outer wall of the elastic body supporting portion and the inner wall of the front barrel.

32. The multi-refill writing instrument according to claim 28, wherein the elastic body supporting portion contacting with the front ends of the elastic bodies in the axial direction is formed on the inner wall of the front barrel, and holding portions for holding the front ends of the elastic bodies in the radial direction thereof are formed at the elastic body supporting portion.

33. A refill for a multi-refill writing instrument according to claim 1, comprising:

a ballpoint pen tip holding a ball rotatably at a front end thereof;

an ink containing tube which has a front end connected to the ballpoint pen tip and contains ink therein; and an operating body which is connected to a rear end of the ink containing tube and has the same color as that of the ink contained in the ink containing tube, wherein a plurality of the refills are accommodated in the barrel at the time of use, the operating body connected to the rear end of the refill protrudes from the side wall of the barrel, and the ballpoint pen tip protrudes from or is retracted into the barrel by operating the operating body to slide forward.

34. The refill for a multi-refill writing instrument according to claim 33, wherein the operating body includes a small-diameter portion and a large-diameter portion having a dimension larger than that of the small-diameter portion in the radial direction.

35. The refill for a multi-refill writing instrument according to claim 34, wherein the large-diameter portion has a dimension larger than the external diameter of the ink containing tube in the radial direction.

36. The refill for a multi-refill writing instrument according to claim 34, wherein the large-diameter portion is a plate member having flat portions on both sides thereof.

37. The refill for a multi-refill writing instrument according to claim 34, wherein the large-diameter portion is provided at a rear portion of the operating body.

38. The refill for a multi-refill writing instrument according to claim 33, wherein the ink containing tube is formed of a transparent or semitransparent material, and the ink contained in the ink containing tube is a dye ink.

39. The refill for a multi-refill writing instrument according to claim 33, wherein a resin film is fixed to the front end of the ballpoint pen tip to prevent the ballpoint pen tip from being dried.

40. The refill for a multi-refill writing instrument according to claim 33, wherein in a state that a visible area of the operating body is maximum, the visible area of the operating body is set to be 10% or more of a visible area of the ink containing tube.

41. The refill for a multi-refill writing instrument according to claim 33, wherein the refill is accommodated in a packing bag made of a transparent material.

42. The refill for a multi-refill writing instrument according to claim 41, wherein the refill is accommodated in the packing bag such that the maximum visible area of the operating body is visible from an external front side of the packing bag.

43. The refill for a multi-refill writing instrument according to claim 41, wherein the operating body includes a large-diameter portion having a dimension larger than the external diameter of the ink containing tube, the large-diameter portion is a plate member having flat portions on both sides thereof, and the refill is accommodated in the packing bag such that the flat portion of the large-diameter portion of the operating body is visible from an external front side of the packing bag.

44. The refill for a multi-refill writing instrument according to claim 41, wherein the packing bag has a hanging hole at one end thereof, and the refill is accommodated in the packing bag such that the operating body is arranged close to the hanging hole.

45. The refill for a multi-refill writing instrument according to claim 41, wherein the packing bag has a hanging hole at one end thereof, and the refill is accommodated in the packing bag such that the ballpoint pen tip is arranged close to the hanging hole.

46. The refill for a multi-refill writing instrument according to claim 41, wherein the packing bag includes:

a hanging hole that is provided at one end thereof; and a colored portion that is provided around the hanging hole on the surface thereof and is colored in the same color as that of the ink contained in the ink containing tube.

* * * * *